US007796934B2

(12) United States Patent
Teshigawara

(10) Patent No.: US 7,796,934 B2
(45) Date of Patent: Sep. 14, 2010

(54) IMAGE FORMING METHOD USING CLEANING BLADE AND IMAGE FORMING APPARATUS WITH CLEANING BLADE

(75) Inventor: Toru Teshigawara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 143 days.

(21) Appl. No.: 11/518,288

(22) Filed: Sep. 11, 2006

(65) Prior Publication Data

US 2007/0201917 A1 Aug. 30, 2007

(30) Foreign Application Priority Data

Feb. 24, 2006 (JP) ..... 2006-049170

(51) Int. Cl.
*G03G 21/00* (2006.01)

(52) U.S. Cl. ..... 399/350; 399/302; 399/346; 430/126.2

(58) Field of Classification Search ..... 399/350, 399/343, 101, 346, 302, 308; 430/126.2
See application file for complete search history.

(56) References Cited

U.S. PATENT DOCUMENTS

| | | | | |
|---|---|---|---|---|
| 4,568,176 | A * | 2/1986 | Murasawa | 430/126.2 X |
| 4,823,161 | A * | 4/1989 | Yamada et al. | 399/350 |
| 6,534,228 | B2 * | 3/2003 | Kawada et al. | 430/66 |
| 6,703,472 | B2 * | 3/2004 | Miura et al. | 399/350 X |
| 7,160,663 | B2 * | 1/2007 | Komoto et al. | 430/109.1 |
| 7,400,844 | B2 * | 7/2008 | Murakami et al. | 399/346 X |
| 2002/0037990 | A1 * | 3/2002 | Hitoshi et al. | 528/80 |
| 2002/0192430 | A1 | 12/2002 | Miura et al. | 428/157 |
| 2003/0044203 | A1 * | 3/2003 | Watanabe | 399/302 |
| 2003/0044713 | A1 * | 3/2003 | Yamaguchi et al. | 430/122 |
| 2003/0096183 | A1 * | 5/2003 | Katoh et al. | 399/302 X |
| 2003/0186145 | A1 | 10/2003 | Morikawa et al. | 430/58.8 |
| 2005/0084271 | A1 * | 4/2005 | Koike et al. | 399/346 X |
| 2006/0127138 | A1 * | 6/2006 | Egawa | 399/308 X |
| 2006/0140684 | A1 * | 6/2006 | Matayoshi | 399/302 X |
| 2006/0210326 | A1 * | 9/2006 | Takehara et al. | 399/302 |
| 2006/0216084 | A1 * | 9/2006 | Kojima et al. | 399/350 |
| 2007/0020005 | A1 * | 1/2007 | Shigezaki et al. | 399/349 |

FOREIGN PATENT DOCUMENTS

| | | | |
|---|---|---|---|
| CN | 1387095 | A | 12/2002 |

(Continued)

*Primary Examiner*—Sophia S Chen
(74) *Attorney, Agent, or Firm*—Morgan, Lewis & Bockius LLP

(57) ABSTRACT

An image forming method in which an image carrier that has a surface layer containing a resin having a crosslinking structure is used; a material of a portion of the cleaning blade which portion contacts the surface of the image carrier satisfies $3.92 \leqq M \leqq 29.42$, $0 > \alpha \leqq 0.294$, and $S \geqq 250$; an absolute value of difference in circumferential velocity between the image carrier and the intermediate transfer member is larger than zero; a polishing agent is present at a contact portion between the image carrier and the intermediate transfer member; M represents 100% modulus; $\alpha$ represents a ratio of a change in stress ($\Delta$ stress) to a change in a strain amount ($\Delta$ strain amount) from 100% strain to 200% strain in a stress-strain curve; and S represents a breaking elongation measured according to JIS K6251 using a dumbbell type #3 test piece.

26 Claims, 4 Drawing Sheets

FOREIGN PATENT DOCUMENTS

| | | |
|---|---|---|
| CN | 1430107 A | 7/2003 |
| CN | 1828453 | 9/2006 |
| CN | 1828454 | 9/2006 |
| JP | A-04-305666 | 10/1992 |
| JP | A-08-176293 | 7/1996 |
| JP | A-08-208820 | 8/1996 |
| JP | A-2002-082573 | 3/2002 |
| JP | 2002-296993 | 10/2002 |

* cited by examiner

IMAGE FORMING METHOD USING CLEANING BLADE AND IMAGE FORMING APPARATUS WITH CLEANING BLADE

BACKGROUND

1. Technical Field

The present invention relates to an image forming method that can be utilized in a copy machine and the like that forms an image electrophotographically and an image forming apparatus using the same.

2. Related Art

In an image forming apparatus that uses an electrophotography method, periodical maintenance has been necessary. Accordingly, maintenance cost has been a large burden from the viewpoint of users. Furthermore, from the viewpoint of eco-friendliness, the image forming apparatus and a process cartridge are desired to have a longer life.

In order to realize a long-lasting image forming apparatus and a process cartridge, it is necessary to improve the rate-determining factor of wearing type service life; e.g., (1) making an image carrier hard to abrade, and making the surface of the image carrier slippy, (2) reducing damage on the image carrier by a blade, and simultaneously (3) the blade itself is hard to abrade.

Furthermore, in particular, when the image carrier is hard to abrade, a discharge product generated by discharge from a charging unit that imparts electric charge onto the surface of an image carrier makes the image deletion easily occur under a high humidity environment. Accordingly, suppression of the image deletion is an important issue in a long-lasting image forming apparatus and process cartridge, in which an image carrier and a cleaning blade both excellent in wear resistance are combined.

SUMMARY

According to a first aspect of the invention, there is provided an image forming method that includes:

charging a surface of an image carrier that has a surface layer containing a resin having a crosslinking structure, the image carrier being rotatable in one direction;

forming an electrostatic latent image by exposing the charged surface of the image carrier to light;

developing the electrostatic latent image with a developer containing a toner to form a toner image;

transferring the toner image formed on the surface of the image carrier onto a surface of a rotatable intermediate transfer member that contacts the surface of the image carrier; and cleaning the surface of the image carrier with a cleaning blade that contacts the surface of the image carrier after the toner image is transferred onto the intermediate transfer member, a portion of the cleaning blade that contacts the surface of the image carrier having a material that satisfies formulas (1) to (3) below, an absolute value of a difference in circumferential velocity between the image carrier and the intermediate transfer member being larger than zero, and a polishing agent being present at least at a portion where the image carrier and the intermediate transfer member contact each other:

$$3.92 \leqq M \leqq 29.42 \quad \text{Formula (1)}$$

$$0 < \alpha \leqq 0.294 \quad \text{Formula (2)}$$

$$S \geqq 250 \quad \text{Formula (3)}$$

In formulas (1) to (3), M representing 100% modulus (MPa), α representing a ratio of a change in stress (Δ stress) to a change in a strain amount (Δ strain amount) from 100% strain to 200% strain {Δ stress/Δ strain amount=(stress at a strain amount of 200%−stress at a strain amount of 100%)/(200−100)} (MPa/%) in a stress-strain curve, and S representing the breaking elongation (%) measured according to JIS K6251 (using a dumbbell type #3 test piece).

BRIEF DESCRIPTION OF THE DRAWINGS

Exemplary embodiments of the present invention will be described in detail based on the following figures, wherein.

DETAILED DESCRIPTION

Figure 1:
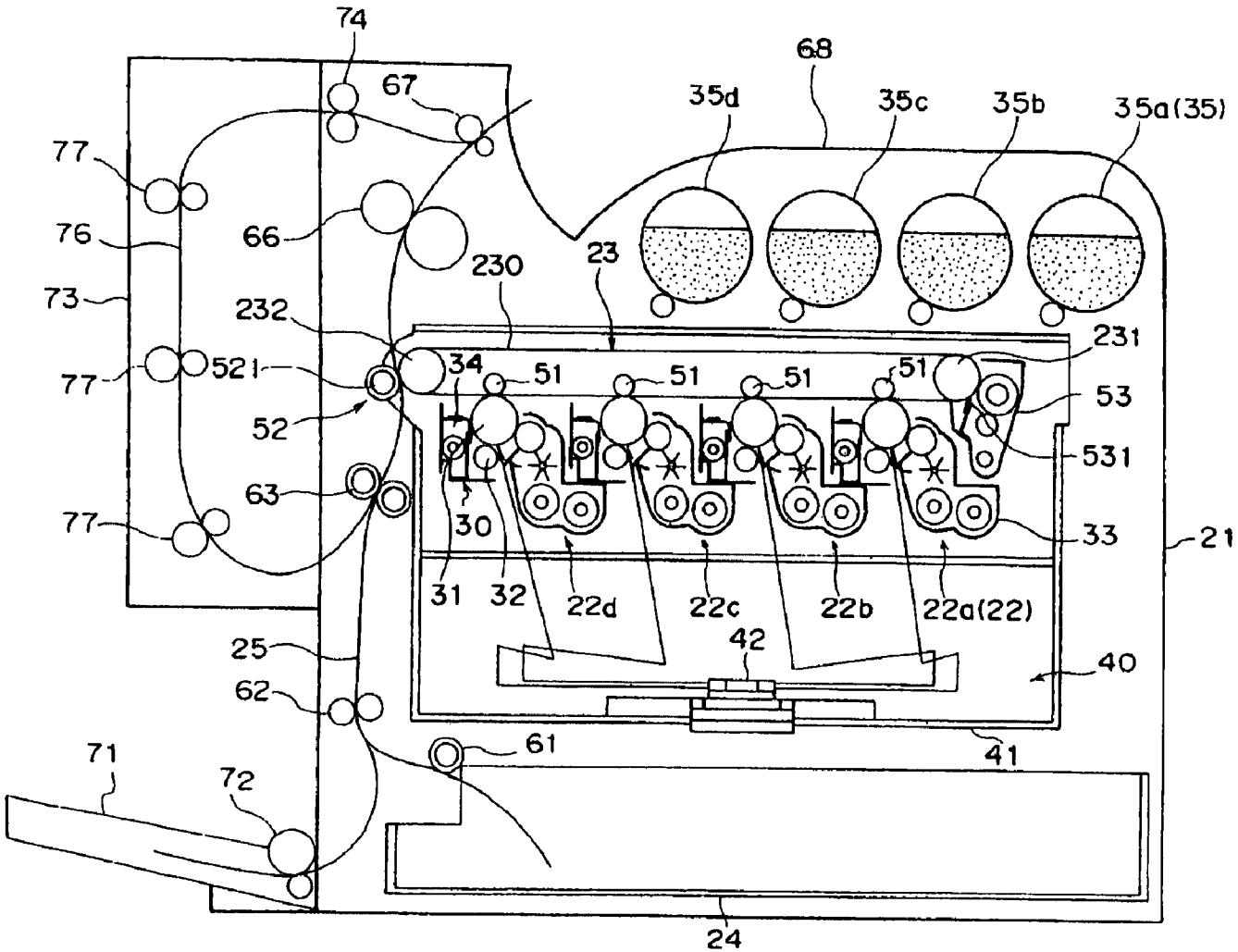
FIG. 1 is a rough schematic diagram showing an example of an image forming apparatus according to an aspect of the present invention.

An image forming method according to an aspect of the invention includes: charging a surface of an image carrier that has a surface layer containing a resin having a crosslinking structure, the image carrier being rotatable in one direction;

forming an electrostatic latent image by exposing the charged surface of the image carrier to light;

developing the electrostatic latent image with a developer containing a toner to form a toner image;

transferring the toner image formed on the surface of the image carrier onto a surface of a rotatable intermediate transfer member that contacts the surface of the image carrier; and cleaning the surface of the image carrier with a cleaning blade that contacts the surface of the image carrier after the toner image is transferred onto the intermediate transfer member, wherein a material of a portion of the cleaning blade which portion contacts the surface of the image carrier satisfies formulas (1) to (3) below, an absolute value of a difference in circumferential velocity between the image carrier and the intermediate transfer member is larger than zero, and a polishing agent is present at least at a portion where the image carrier and the intermediate transfer member contact each other:

$$3.92 \leqq M \leqq 29.42 \quad \text{Formula (1)}$$

$$0 < \alpha \leqq 0.294 \quad \text{Formula (2)}$$

$$S \geqq 250 \quad \text{Formula (3)}$$

In formulas (1) to (3), M represents 100% modulus (MPa), α represents a ratio of a change in stress (Δ stress) to a change in a strain amount (Δ strain amount) from 100% strain to 200% strain {Δ stress/Δ strain amount=(stress at a strain amount of 200%−stress at a strain amount of 100%)/(200−100)} (MPa/%) in a stress-strain curve, and S represents the breaking elongation (%) measured according to JIS K6251 (using a dumbbell type #3 test piece).

As a result of earnest research, the present inventor has found that the image deletion may be sufficiently suppressed even at a wear rate of about one tenth of a conventional wear rate of approximately 40 to 60 nm/1000 revolutions when an image carrier having a high strength surface is used. With such a wear rate that is far smaller than the conventional wear rate, the service life of the image carrier is practically hardly affected. The inventor has found that it is effective to use a polishing agent and introduce a difference in circumferential velocity between the image carrier and the intermediate transfer member in order to adjust the wear rate of the surface of the image carrier to about one tenth of the conventional wear rate in a system having an image carrier having a high strength surface and a cleaning blade with excellent wear resistance, without adversely affecting other characteristics.

The absolute value of the difference in circumferential velocity between the image carrier and the intermediate transfer member may be greater from the viewpoint of improving the effect of suppressing the image deletion. However, when the absolute value of the difference is excessively large, the banding (generation of regions with slightly different image concentrations extending in a direction orthogonal to the process direction, that is, a belt-shaped image defects) occurs in some cases. Accordingly, the absolute value of the difference in circumferential velocity between the image carrier and the intermediate transfer member is preferably in the range of 1 to 5% and more preferably in the range of 2 to 4% in terms of the relative speed difference (100×|(circumferential velocity of the image carrier−circumferential velocity of the intermediate transfer member)|/(circumferential velocity of the intermediate transfer member)).

The toner may be a one-component developer containing a toner or a two-component developer containing a toner and a carrier. The toner and the carrier may be selected from known toners and carriers. The carrier may be a known carrier, such as a generally used resin-coated carrier comprising a core material made of a magnetic material, such as ferrite, coated with a resin.

However, when the resin-coated carrier is broken under the stress applied in a developing machine, a core material portion becomes splinters, which are then brought to a portion of contact between the image carrier and the intermediate transfer member. Such splinters have a sharp protrusion and are large in size in comparison with the polishing agent. Therefore, when an image is formed while rotating the image carrier and the intermediate transfer member such that the absolute value of the difference in circumferential velocity between the image carrier and the intermediate transfer member exceeds zero as in an aspect of the invention, the splinters make rotational movement in the contact portion, and damage the surface of the image carrier or the surface of the intermediate transfer member in some cases.

Accordingly, when a two-component developer is used in an aspect of the invention, it is possible to use, as the carrier, a carrier that contains a resin matrix and magnetic powder dispersed in the resin matrix. Unlike resin-coated carriers, such a carrier containing magnetic powder dispersed in the resin matrix hardly generates splinters that damage the surface of the image carrier even when the carrier is broken under the stress applied in the developing machine, and thus damage on the surface of the image carrier may be suppressed. Furthermore, a carrier having a shape closer to a spherical shape is preferred since the rotational movement at the contact portion is facilitated. The carrier will be detailed below.

In the following, an image forming apparatus that uses the image forming method according to an aspect of the invention will be described. The structure of the image forming apparatus according to an aspect of the invention is not particularly limited as long as the configuration can use the image forming method according to an aspect of the invention. However, specifically, the configuration described below may be adopted.

That is, the image forming apparatus according to an aspect of the invention may include an image carrier that has a surface layer containing a resin having a crosslinking structure and is rotatable in one direction, a charging unit that charges a surface of the image carrier, an electrostatic latent image forming unit that exposes the charged surface of the image carrier to form an electrostatic latent image, a developing unit that develops the electrostatic latent image with a developer containing a toner to form a toner image, a rotatable intermediate transfer member having a surface onto which the toner image transferred onto the surface of the image carrier is transferred while the intermediate transfer member contacts the surface of the image carrier, and a cleaning blade that contacts the surface of the image carrier and cleans the surface of the image carrier after the toner image is transferred onto the intermediate transfer member.

In an exemplary embodiment of the structure, the material of the portion of the cleaning blade which portion contacts the surface of the image carrier satisfies formulas (1) to (3) below, the absolute value of the difference between the circumferential velocity of the image carrier and that of the intermediate transfer member is larger than zero, and a polishing agent is present at least at a portion where the image carrier and the intermediate transfer member contact each other.

The image forming apparatus according to an aspect of the invention may comprise a process cartridge that is attachable to and separable from the body of the image forming apparatus and includes at least the image carrier and the cleaning blade.

Next, the cleaning blade and various members such as the image carrier used in the image forming method and the image forming apparatus according to an aspect of the invention, and specific examples of the image forming apparatus according to an aspect of the invention will be detailed in more detail below.

(Cleaning Blade)

In the cleaning blade used in an aspect of the invention, as described above, the material of at least a portion that contacts the surface of the image carrier satisfies formulas (1) to (3) above.

Since the material of the portion of the cleaning blade that contacts the surface of the image carrier satisfies formula (1), the cleaning blade has excellent cleaning property and excellent wear resistance. Hereinafter, the portion contacting the surface of the image carrier is occasionally referred to as "edge portion" or "edge tip", and the material constituting the portion is occasionally referred to as "edge portion material" or "edge tip material".

When the 100% modulus M is less than 3.92 MPa (40 kgf/cm$^2$), the wear resistance is insufficient; therefore, the cleaning blade cannot maintain good cleaning property over a long time. On the other hand, when the 100% modulus M exceeds 29.42 MPa (300 kgf/cm$^2$), the cleaning blade does not follow the surface of the image carrier well due to excessive hardness of the edge portion material, and thus excellent cleaning property cannot be exerted. In addition, the blade tends to damage the surface of the image carrier in some cases.

The 100% modulus M is preferably in the range of 5 to 20 MPa, and more preferably in the range of 6.5 to 15 MPa.

Since the edge portion material satisfies formulas (2) and (3), the cleaning blade has excellent crack resistance.

When α shown in formula (2) exceeds 0.294, the edge portion material does has inferior flexibility. This inferior flexibility leads to chipped edge in a relatively short period of time when a two-component developer is used. The edge chipping occurs as follows. When BCO occurs, foreign matter present on the surface of the image carrier (foreign matter buried in or fixed on the surface of the image carrier in particular) repeatedly passes the portion of contact between the surface of the image carrier and the cleaning blade. BCO refers to Bead Carry Over, which is a phenomenon in which a part of the carrier is transferred onto the surface of the image carrier owing to an electrostatic attraction force when a two-component developer is used. When the foreign matter passes the contact portion repeatedly, the edge tip of the cleaning blade experiences large stress repeatedly. However, the edge portion cannot deform to effectively disperse the stress, and the edge is chipped in a relatively short period of time. Since the edge is chipped in a short time, excellent cleaning property cannot be maintained over a long period of time.

In formula (2), α is preferably 0.2 or less, more preferably 0.1 or less. α is preferably closer to zero, which is the physical lower limit value.

When the breaking elongation S shown in formula (3) is less than 250%, edge is chipped in a relatively short period of time. This is because the edge tip elongates when the foreign matter on the surface of the image carrier and the edge tip collide with strong force, and the edge loses its ability to follow and deform. Since the edge is chipped in a short period of time, excellent cleaning property cannot be maintained over a long period of time.

The breaking elongation S is preferably 300% or more, and more preferably 350% or more. A larger breaking elongation S is preferred from the viewpoint of the edge chipping. However, when the breaking elongation S is larger than 500%, the tracking property (adhesiveness) to the surface of the image carrier increases and the friction force with the surface of the image carrier increases, resulting in enhanced edge wear in some cases. Accordingly, from the viewpoints of the edge wear, the breaking elongation S is preferably 500% or less, more preferably 450% or less, and still more preferably 400% or less.

Furthermore, the ambient temperature, that is, the environmental temperature at use, around the cleaning blade of the image forming apparatus may be approximately in the range of 10 to 60° C. Accordingly, when the glass transition temperature Tg of the material of the portion that contacts the surface of the image carrier is higher than the environmental temperature at use, the cleaning blade loses its rubber-like property, and the contact pressure of the cleaning blade thereby becomes instable in some cases. Accordingly, the glass transition temperature Tg of the material of the portion that contacts the surface of the image carrier may be not more than the lower limit value (10° C.) of the environmental temperature at use.

When the glass transition temperature Tg of the material of the portion that contacts the surface of the image carrier is 10° C. or less, the rebound resilience R of the material is decreased as the glass transition temperature Tg is lower. In particular, when the rebound resilience R is less than 10%, the stick & slip behavior at the edge tip is slow, and there easily occurs a portion that rubs against the surface of the image carrier while maintaining a certain deformed shape in contact with the surface, in some cases.

When the deformed shape is not canceled by the stick and slip behavior, the edge tip rubs against the surface while maintaining the shape of the edge tip, whereby localized plastic deformation tends to occur. When such localized plastic deformation occurs, the adhesiveness between the edge tip and the surface of the image carrier is lowered and cleaning failure thereby occurs more easily in some cases. In order to suppress such localized plastic deformation, it is preferable that the stick and slip behavior always occurs at the edge tip. In order that the stick and slip behavior always occurs at the edge tip, the rebound resilience R is preferably 10% or more, more preferably 15% or more, and still more preferably 20% or more in an environment of a temperature of not lower than 10° C., which is substantially the lower limit value of the environmental temperature at use.

The 100% modulus M shown in formula (1) is measured in accordance with JIS K6251 with a dumbbell #3 test piece at a tensile testing speed of 500 mm/min and obtained from the stress at 100% strain. As a measurement device, STROGRAPH AE ELASTOMER (trade name, manufactured by Toyo Seiki Seisakusho, Ltd.) is used.

The value a shown in formula (2) is obtained from a stress-strain curve. The stress and the amount of strain are obtained by a procedure and method described below. That is, in accordance with JIS K6251 (, which is incorporated herein by reference), a measurement is carried out with a dumbbell #3 test piece at a tensile testing speed of 500 mm/min, and α is obtained from stresses at 100% strain and 200% strain. As a measurement device, STROGRAPH AE ELASTOMER (trade name, manufactured by Toyo Seiki Seisakusho, Ltd.) is used.

Furthermore, in an aspect of the invention, the glass transition temperature of the material of the portion that contacts the surface of the member to be cleaned, and the glass transition temperatures of the soft segment material and the hard segment material described below, are obtained as a peak temperature of tan δ (loss tangent) after the temperature dispersion is measured with a viscoelastometer.

The value, tan δ, is obtained from the storage and loss elastic moduli described below.

When a sine-wave strain as a stationary vibration is applied to a linear elastic body, the stress is represented by formula (4). Here, |E*| is called a complex elastic modulus. From the Theological theory, the elastic component and the viscous component are represented by formulas (5) and (6), respectively. In the formulae, E' represents the storage elastic modulus and E" represents the loss elastic modulus. Furthermore, δ represents a phase difference angle between the stress and the strain, and is called "a mechanical loss angle".

The value, tan δ, is represented by E"/E' as shown in formula (7), and is called "loss tangent". As the loss tangent is increased, the linear elastic body has a property more closer to rubber elasticity.

$$\sigma=|E^*|\gamma\cos(\omega t) \quad \text{Formula (4)}$$

$$E'=|E^*|\cos\delta \quad \text{Formula (5)}$$

$$E''=|E^*|\sin\delta \quad \text{Formula (6)}$$

$$\tan\delta=E''/E' \quad \text{Formula (7)}$$

The value, tan δ, is measured with RHEOPECTROLER-DVE-V4 (trade name, manufactured by Rheology Co., Ltd.) under a static strain of 5% and a 10 Hz sine-wave tensile vibration in the temperature range of −60 to 100° C.

In the cleaning blade of an aspect of the invention, at least the edge portion material is a material satisfying formulas (1) to (3). In addition to the edge portion, other parts may also be made of a material satisfying formulas (1) to (3).

The material satisfying formulas (1) to (3) is not particularly limited as long as it is an elastomer material. However, the material may be specifically an elastomer material containing a hard segment and a soft segment. When the elastomer material contains both of the hard segment and the soft segment, the elastomer material may easily satisfy the physical properties defined by formulas (1) to (3), and may achieve both of high wear resistance and high chipping resistance at a high level.

The terms, "hard segments" and "soft segments", refers to that the material constituting the former is relatively harder than the material constituting the latter and the material constituting the latter is relatively softer than the material constituting the former.

The elastomer material containing a hard segment and a soft segment preferably has a glass transition temperature in the range of −50 to 30° C., and more preferably in the range of −30 to 10° C. If the glass transition temperature exceeds 30° C., the cleaning blade becomes fragile in a temperature range for practical use of the cleaning blade in some cases. If the glass transition temperature is lower than −50° C., the cleaning blade does not exhibit sufficient hardness and stress in a temperature range for practical use in some cases.

Consequently, in order to realize the above-mentioned glass transition temperature, the glass transition temperature of the material constituting the hard segment of the elastomer material (hereinafter occasionally referred to as a hard segment material) is preferably in the range of 30 to 100° C., and more preferably in the range of 35 to 60° C., and the glass transition temperature of the material constituting the soft segment of the elastomer material (hereinafter occasionally referred to as a soft segment material) is preferably in the range of −100 to −50° C., and more preferably in the range of −90 to −60° C.

When a hard segment material and a soft segment material having such a glass transition temperature is used, the weight ratio of the hard segment material to the total weight of the hard segment material and the soft segment material (hereinafter occasionally referred to as hard segment material ratio) is preferably in the range of 46 to 96% by weight, more preferably in the range of 50 to 90% by weight, and still more preferably 60 to 85% by weight.

If the hard segment material ratio is less than 46% by weight, the wear resistance of the edge tip is insufficient, and wear occurs in a short period of time; therefore, good cleaning property cannot be maintained over a long time in some cases. If the hard segment material ratio exceeds 96% by weight, there are cases where the edge tip is too hard, and the flexibility and the tensibility are insufficient; in such a case, chipping occurs in a short period of time, and good cleaning property cannot be maintained over a long period of time.

The combination of the hard segment material and the soft segment material is not particularly limited, and materials may be selected from conventionally known resin materials such that one material is relatively harder than the other. In an aspect of the invention, the following combinations may be adopted.

The hard segment material may be a polyurethane resin. The weight average molecular weight of the polyurethane resin is preferably in the range of 1,000 to 4,000, and more preferably in the range of 1,500 to 3,500.

When the weight average molecular weight is less than 1,000, there are cases where cleaning failure easily occurs upon use of the cleaning blade at low temperature environment, owing to reduction in the elasticity of the polyurethane resin constituting the hard segments. When the weight average molecular weight exceeds 4,000, the permanent strain of the polyurethane resin constituting the hard segments becomes significant, and the edge tip cannot maintain the contact force against the surface of the image carrier; as a result, cleaning failures occur in some cases.

As the polyurethane resin to be used as the hard segment material, PLACCEL 205 and PLACCEL 240 manufactured by Daicel Chemical Industries, Ltd. can be exemplified.

When a polyurethane resin is used as the hard segment material, the soft segment material may be (1) a resin having a functional group reactive to an isocyanate group. The resin may have physical properties satisfying: (2) a glass transition temperature of 0° C. or lower; (3) a viscosity of 600 to 35,000 mPa·s at 25° C.; and (4) a weight average molecular weight in the range of 700 to 3,000. If these physical properties are not satisfied, there are cases where the moldability at the production of the cleaning blade or the properties of the cleaning blade are insufficient.

Regarding the physical properties, the glass transition temperature is more preferably −10° C. or lower; the viscosity at 25° C. is more preferably in the range of 1,000 to 3,000 mPa·s; and the weight average molecular weight is more preferably in the range of 900 to 2,800. When the cleaning blade is produced by centrifugal molding, the viscosity is preferably in the range of 600 to 3,500 mPa·s at 25° C.

The soft segment material satisfying the above-mentioned structure and physical properties defined by (1) to (4) may be selected appropriately from conventionally known resins, and may be a flexible resin having, at at least a terminal thereof, a functional group reactive to an isocyanate group. Further, the resin is preferably an aliphatic resin having a straight chain structure in view of the flexibility. Examples thereof include acrylic resins having two or more hydroxyl groups, polybutadiene resins having two or more hydroxyl groups, and epoxy resins having two or more epoxy groups.

Examples of the acrylic resins having two or more hydroxyl groups include ACTFLOW (grade: UMB-2005B, UMB-2005P, UMB-2005, UME-2005, and the like) manufactured by Soken Chemical Engineering Co., Ltd. Examples of the polybutadiene resins having two or more hydroxyl groups include R-45HT manufactured by Idemitsu Kosan Co., Ltd. and the like.

An example of the epoxy resin having two or more epoxy groups is not a conventional epoxy resin having hard and fragile properties, but is a more flexible and tougher epoxy resin than conventional epoxy resins.

Such an epoxy resin may have, in the main chain structure, a structure (a flexible skeleton) that improves the flexibility of the main chain in terms of molecular structure. The flexible structure may be an alkylene skeleton, a cycloalkane skeleton, or a polyoxyalkylene skeleton, and preferably a polyoxyalkylene skeleton.

In terms of physical properties, epoxy resins with a low viscosity for its molecular weight as compared with conventional epoxy resins are preferable. Specifically, an exemplary epoxy resin has a weight average molecular weight of about 900±100 and a viscosity at 25° C. of 15,000±5,000 mPa·s (more preferably 15,000±3,000 mPa·s). An example of epoxy resins having such properties is EPLICON EXA-4850-150 manufactured by Dainippon Ink and Chemicals, Inc. or the like.

The cleaning blade used in an aspect of the invention is not particularly restricted as far as at least the edge portion is made of a material that satisfies formulas (1) to (3) as mentioned above. In an exemplary embodiment, the entire cleaning blade is made of such a material. When two or more layers are laminated to form a cleaning blade, the layer contacting the surface of the image carrier may be made of a material that satisfies formulas (1) to (3).

The method for preparing the cleaning blade used in an aspect of the invention may be selected from conventionally known methods, in accordance with the raw material for the preparation of the cleaning blade. For example, the cleaning blade can be prepared by forming a sheet by centrifugal molding, extrusion molding, or the like, followed by cutting into a predetermined shape. As an alternative, the cleaning blade can be prepared by adhering two or more sheets to each other.

The use of the cleaning blade used in an aspect of the invention is not limited to the cleaning on the surface of the image carrier. The cleaning blade may be used for cleaning other members in the image forming apparatus that need surface cleaning, such as an intermediate transfer member, a charging roil, a transfer roll, an image receiving member transportation belt, and a paper transportation roll.

When the cleaning blade according to an aspect of the invention is used, various kinds of substances adhered to the surface of the image carrier, such as the toner, external additives, discharge products, talc, and paper powder, may be stably cleaned over a long period of time. BCO upon use of a two-component developer conventionally may lead to chipping through generation of foreign matter buried in or fixed to the surface of the image carrier such as carrier splinters. However, generation of such chipping may be suppressed by using the cleaning blade according to an aspect of the invention.

In order to ensure suppression of the image deletion, the normal force of the cleaning blade toward the image carrier is preferably 35 N/m or more, and more preferably 40 N/m or more. However, when the normal force is excessively large, there are cases where the tip portion of the cleaning blade is chipped or worn unevenly or the driving torque of the image carrier is increased; in such cases the cleaning property tends to deteriorate faster with time and/or a large motor is required. From a practical point of view, the normal force may be 55 N/m or less.

-Image Carrier (Photoreceptor)-

The image carrier used in an aspect of the invention is not particularly limited as far as it has a surface layer that contains a resin having a crosslinking structure. Such an image carrier may be an organic photoreceptor having a structure in which at least a photosensitive layer is provided on an electrically conductive substrate. The photosensitive layer may be a function separation type photosensitive layer having a layer structure in which a charge generation layer and a charge transport layer are disposed in this order. As needs arise, an intermediate layer may be disposed between the photosensitive layer and the electrically conductive substrate, or between the photosensitive layer and a surface protective layer.

The surface layer that contains a resin having a crosslinking structure may serve as a surface protective layer that is separately formed on the photosensitive layer, or may be a layer that constitutes at least the neighborhood of the outermost surface of the photosensitive layer. In the description below, a surface layer is basically assumed to be provided separately on the photosensitive layer. The resin having the crosslinking structure may have charge transporting property.

Hereinafter, the image carrier used in an aspect of the invention is described in more detail, assuming that the image carrier is a function separation type organic photoreceptor. However, the layer configuration of the image carrier used in an aspect of the invention is not restricted to those described below.

Examples of the conductive substrate include: a metal drum of aluminum, copper, iron, stainless steel, zinc, nickel or the like; those obtained by depositing a metals such as aluminum, copper, gold, silver, platinum, palladium titanium, nickel-chromium, stainless steel, or copper-indium on a substrate such as a sheet, paper, plastic, or glass; those obtained by depositing a conductive metal compound such as indium oxide or tin oxide on the above-mentioned substrates; those obtained by laminating a metal foil on the above-mentioned substrates; and those obtained by dispersing carbon black, indium oxide, tin oxide-antimony oxide powder, metal powder, or copper iodide in a binder resin and applying the mixtures to the above-mentioned substrates so as to impart conductivity. The shape of the conductive substrate may be drum-like, sheet-like, or plate-like shape.

Further, when a pipe substrate made of metal is used as a conductive substrate, the surface of the metal pipe substrate may be non-treated or may be subjected to a surface roughening treatment in advance. Such surface roughening may prevent wood grain-like concentration unevenness, which may be generated in the photoreceptor due to interference light rays when source that may cause interference, such as laser beam, is used as an exposure light source. Examples of the surface treatment method include specular cutting, etching, anodization, rough cutting, center-less grinding, sand blast, and wet horning.

In particular, it is possible to use an aluminum substrate whose surface has been anodized as a conductive substrate in view of improvements in the adhesion to the photosensitive layer and in the film forming property.

The charge generation layer is formed by depositing a charge generating material by a vacuum evaporation method or by applying a solution containing a charge generating material, an organic solvent, and a binder resin.

Examples of the charge generating material include inorganic photoconductors such as amorphous selenium, crystalline selenium, selenium-tellurium alloy, selenium-arsenic alloy, other selenium compounds, selenium alloy, zinc oxide, and titanium oxide; those obtained by dye-sensitizing the above inorganic photoconductors; various kinds of phthalocyanine compounds such as metal-free phthalocyanine, titanyl phthalocyanine, copper phthalocyanine, tin phthalocyanine, and gallium phthalocyanine; various kinds of organic pigments such as squarilium pigments, anthoanthrone pigments, perylene pigments, azo pigments, anthraquinone pigments, pyrene pigments, pyrylium salts, and thiapyrylium salts; and dyes.

These organic pigments generally have several types of crystal structures. In particular, phthalocyanine compounds are known to have various crystal structures such as $\alpha$-type and $\beta$-type; and any crystal structure may be used if the pigment imparts sensitivity and other properties adapted to the purpose.

Among the above-mentioned charge generating materials, phthalocyanine compounds are preferable. When a phthalocyanine compound is used, the phthalocyanine compound contained in the photosensitive layer absorbs photon upon irradiation of the photosensitive layer with light, and generates a carrier. Since the phthalocyanine compound has a high quantum efficiency, the compound may generate the carrier efficiently upon absorption of photons.

Examples of the binder resin to be used in the charge generation layer include bisphenol A type or bisphenol Z type polycarbonate resin and copolymers thereof, polyarylate resins, polyester resins, methacrylic resins, acrylic resins, poly (vinyl chloride) resins, polystyrene resins, poly(vinyl acetate) resins, styrene-butadiene copolymer resins, vinylidene chloride-acrylonitrile copolymer resins, vinyl chloride-vinyl acetate-maleic anhydride resins, silicone resins, silicon-alkyd resins, phenol-formaldehyde resins, styrene-alkyd resins, and poly(N-vinylcarbazole).

Only a single binder may be used, or a mixture of two or more binders may be used. The mixing ratio of the charge generating material to the binder resin (charge generating material: binder resin) may be in the range of 10:1 to 1:10 by weight. The thickness of the charge generation layer is, in general, preferably in the range of 0.01 to 5 μm, and more preferably in the range of 0.05 to 2.0 μm.

The charge generation layer may contain at least one electron acceptor substance for the purpose of improving the sensitivity and reducing the residual potential and the fatigue during repeated use. Examples of the electron acceptor substance to be used in the electron generation layer include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorene, picric acid, o-nitrobenzoic acid, p-nitrobenzoic acid, and phthalic acid. Among them, fluorenone-containing compounds, quinone-containing compounds, and benzene derivatives having an electron attracting substituent such as Cl, CN, or $NO_2$ are preferable.

The dispersing of the charge generating material in the resin may be conducted using a roll mill, a ball mill, a vibration ball mill, an attriter, a Dyno-mill, a sand mill, a colloid mill or the like.

The solvent of a coating liquid for forming the charge generation layer may be a known organic solvent, and examples thereof include aromatic hydrocarbon solvents such as toluene and chlorobenzene; aliphatic alcohol solvents such as methanol, ethanol, n-propanol, iso-propanol, and n-butanol; ketone solvents such as acetone, cyclohexanone, and 2-butanone; halogenated aliphatic hydrocarbon solvents such as methylene chloride, chloroform, and ethylene chloride; cyclic or straight chain ether solvents such as tetrahydrofuran, dioxane, ethylene glycol, and diethyl ether; and ester solvents such as methyl acetate, ethyl acetate, and n-butyl acetate.

The charge transport layer may be one formed by a conventionally known method. The charge transport layer may comprise a charge transport material and a binder resin, or a polymer charge transport material.

Examples of the charge transport material include electron transport compounds such as quinone compounds (e.g., p-benzoquinone, chloranil, bromanil, and anthraquinone), tetracyanoquinodimethane compounds, fluorenone compounds (e.g., 2,4,7-trinitroflurenone), xanthone compounds, benzophenone compounds, cyanovinyl compounds, and ethylenic compounds; and electron hole transport compounds such as triarylaamine compounds, benzidine compounds, arylalkane compounds, aryl-substituted ethylene compounds; stilbene compounds, anthracene compounds, and hydrazone compounds.

Only one charge transport material may be used, or a mixture of two or more charge transport materials may be used. Usable charge transport materials are not limited to those described above. In terms of the mobility, materials represented by structural formulas (1) to (3) are preferably used.

Structural formula (1)

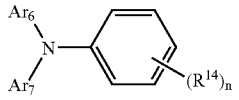

In structural formula (1), $R^{14}$ represents a hydrogen atom or a methyl group; n represents 1 or 2; $Ar_6$ and $Ar_7$ each independently represent a substituted or unsubstituted aryl group, —C($R^{18}$)=C($R^{19}$)($R^{20}$), or —CH=CH—CH=C$(Ar)_2$, and the substituent may be a halogen atom, an alkyl group having 1 to 5 carbon atoms, an alkoxy group having 1 to 5 carbon atoms, or an amino group substituted by an alkyl group having 1 to 3 carbon atoms.

Structural formula (2)

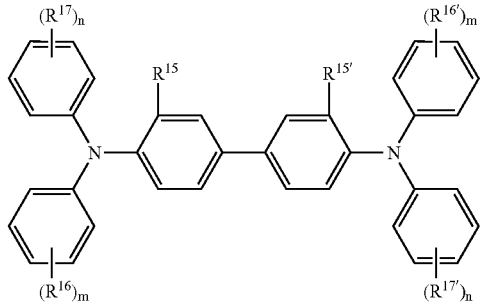

In structural formula (2), $R^{15}$ and $R^{15'}$ may be the same or different, and each independently represent a hydrogen atom, a halogen atom, an alkyl group having 1 to 5 carbon atoms, or an alkoxy group having 1 to 5 carbon atoms; $R^{16}$, $R^{16'}$, $R^{17}$, and $R^{17'}$ may be the same or different, and each independently represent a hydrogen atom, a halogen atom, an alkyl group having 1 to 5 carbon atoms, an alkoxy group having 1 to 5 carbon atoms, an amino group substituted by an alkyl group having 1 to 2 carbon atoms, a substituted or unsubstituted aryl group, —C($R^{18}$)=C($R^{19}$)($R^{20}$), or —CH=CH—CH=C$(Ar)_2$.

In structural formulas (1) and (2), $R^{18}$, $R^{19}$, and $R^{20}$ each independently represent a hydrogen atom, a substituted or unsubstituted alkyl group, or a substituted or unsubstituted aryl group; and m and n each independently represent an integer of 0 to 2.

Structural formula (3)

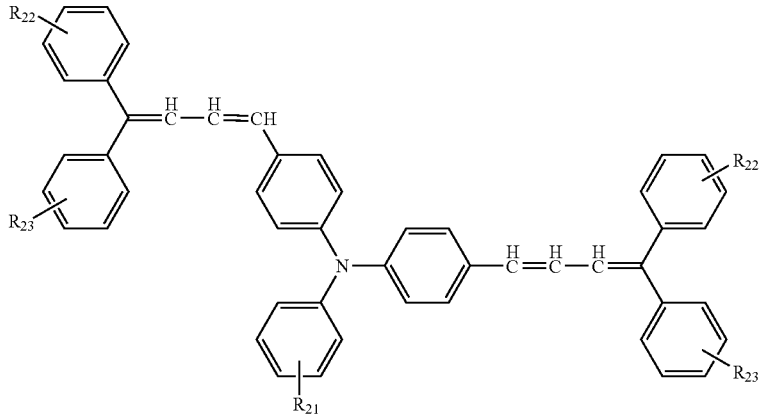

In structural formula (3), $R^{21}$ represents a hydrogen atom, an alkyl group having 1 to 5 carbon atoms, an alkoxy group having 1 to 5 carbon atoms, a substituted or unsubstituted aryl group, or —CH═CH—CH═C(Ar)$_2$; $R^{22}$ and $R^{23}$ may be the same or different, and each independently represent a hydrogen atom, a halogen atom, an alkyl group having 1 to 5 carbon atoms, an alkoxy group having 1 to 5 carbon atoms, an amino group substituted by an alkyl group having 1 to 2 carbon atoms, or a substituted or unsubstituted aryl group.

In structural formulas (1) to (3), Ar represents a substituted or unsubstituted aryl group.

Examples of the binder resin to be used in the charge transport layer include polycarbonate resins, polyester resins, methacrylic resins, acrylic resins, poly (vinyl chloride) resins, poly(vinylidene chloride) resins, polystyrene resins, poly(vinyl acetate) resins, styrene-butadiene copolymers, vinylidene chloride-acrylonitrile copolymers, vinyl chloride-vinyl acetate copolymers, vinyl chloride-vinyl acetate-maleic anhydride copolymers, silicon resins, silicon-alkyd resins, phenol-formaldehyde resins, styrene-alkyd resins, and polymer charge transport materials such as poly (N-vinylcarbazole), polysilane, and polyester type polymer charge transport materials described in JP-A Nos. 8-176293 and 8-208820. Only one binder resin may be used, or a mixture of two or more binder resins may be used. The mixing ratio of the charge transport material to the binder resin may be from 10:1 to 1:5 by weight.

The polymer charge transport material may be used alone. As the polymer charge transport material, conventionally known materials having charge transporting property such as poly (N-vinylcarbazole) and polysilane may be used. In particular, the polyester type polymer charge transport materials shown in JP-A Nos. 8-176293 and 8-208820 are particularly preferable because of their high charge transporting property. The polymer charge transport material alone may form a charge transport layer. As an alternative, a charge transport layer may be formed from a mixture of the polymer charge transport material and any of the above-mentioned binder resins.

The thickness of the charge transport layer is, in general, preferably from 5 to 50 μm, and more preferably from 10 to 30 μm. The coating method may be a conventional method such as a blade coating method, a Mayor bar coating method, a spray coating method, a dip coating method, a bead coating method, an air knife coating method, or a curtain coating method. Further, the solvent used for forming the charge transport layer may be an ordinary organic solvent or a mixture of two or more ordinary organic solvents. Examples of ordinary organic solvents include: aromatic hydrocarbons such as benzene, toluene, xylene, and chlorobenzene; ketones such as acetone and 2-butanone; halogenated aliphatic alcohol solvents such as methylene chloride, chloroform, and ethylene chloride; cyclic or straight chain ether solvents such as tetrahydrofuran and ethyl ether.

In order to prevent deterioration of the photoreceptor by light or heat, or by ozone or an oxidative gas generated in a copying machine, additives such as an antioxidant, a photostabilizer, or a heat stabilizer may be incorporated into the photosensitive layer. For example, as an antioxidant, hindered phenols, hindered amines, p-phenylenediamine, arylalkanes, hydroquinone, spirochroman, spiroindanone, and their derivatives, organic sulfur compounds, and organic phosphorus compounds can be cited. Examples of the photostabilizer include benzophenone, benzotriazole, dithiocarbamate, tetramethylpiperidine, and derivatives thereof.

Furthermore, at least one electron attracting material may be incorporated for the purpose of improving the sensitivity, reducing the residual potential, and reducing fatigue over repeated use. Examples of electron attracting materials usable in the photoreceptor used in an aspect of the invention include succinic anhydride, maleic anhydride, dibromo maleic anhydride, phthalic anhydride, tetrabromo phthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, phthalic acid, and compounds represented by formula (I). Among these, fluorenone compounds, quinone compounds, and benzene derivatives having an electron attracting substituent such as Cl, CN or $NO_2$ are preferable.

The surface layer of the image carrier contains at least a resin having a crosslinking structure. Examples of resins having a crosslinking structure include phenolic resins having a crosslinking structure, urethane resins having a crosslinking structure, and siloxane resins having a crosslinking structure. Since the resins having a crosslinking structure have excellent wear resistance, wear and damage on the surface of the image carrier may be suppressed even when the image carrier is used over a long period of time. The resin having a crosslinking structure may have electron transporting property.

As the resins having a crosslinking structure, various materials may be used. From the viewpoint of characteristics, phenolic resins, urethane resins, and siloxane resins are preferable. In particular, siloxane resins can be mentioned. Among these, those having structures derived from compounds represented by formulas (I) and (II) are preferable because of their excellent strength and stability.

$$F\text{-}[D\text{-}Si(R^2)_{(3-a)}Q_a]_b \quad (I)$$

In formula (I), F represents an organic group derived from a compound having hole transporting property, D represents a flexible subunit, $R^2$ represents a hydrogen atom, an alkyl group, or a substituted or unsubstituted aryl group, Q represents a hydrolyzable group, "a" represents an integer of 1 to 3, and "b" represents an integer of 1 to 4.

The flexible subunit represented by D in formula (I) may be a divalent straight chain group that contains a $—(CH_2)_n—$ group in combination with one or more of —COO—, —O—, —CH═CH—, and —CH═N— groups. Here, "n" in the $—(CH_2)_n—$ group represents an integer of 1 to 5. Furthermore, a hydrolyzable group represented by Q is a —OR group (R represents an alkyl group).

$$F\text{-}((X)_nR_1\text{-}ZH)_m \quad (II)$$

In formula (II), F represents an organic group derived from a compound having hole transporting property, $R^1$ represents an alkylene group, Z represents —O—, —S—, —NH—, or —COO—, and m represents an integer of 1 to 4. X represents —O— or —S—, and n represents 0 or 1.

Example of compounds represented by formulas (I) and (II) have a group represented by formula (III) as the organic group F.

(III)

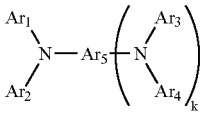

In formula (III), $Ar_1$ to $Ar_4$ each independently represent a substituted or unsubstituted aryl group, $Ar_5$ represents a substituted or unsubstituted aryl group or arylene group, and two to four of $Ar_1$ to $Ar_5$ are connected to $\text{-}D\text{-}Si(R^2)_{(3-a)}Q_a$ in formula (I). D represents a flexible subunit, $R^2$ represents a hydrogen atom, an alkyl group, or a substituted or unsubstituted aryl group, Q represents a hydrolyzable group, and "a" represents an integer of 1 to 3.

In formula (III), $Ar_1$ to $Ar_4$ each independently represent a substituted or unsubstituted aryl group. Specifically, those shown in structure group 1 below may be mentioned as examples.

Structure Group 1

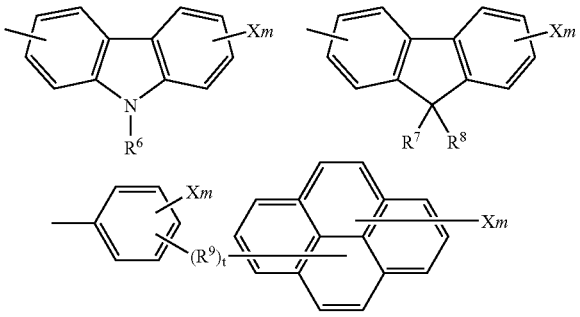

-continued

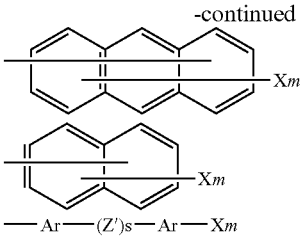

The group Ar shown in structure group 1 may be selected from those shown in structure group 2 below, and Z' may be selected from those shown in structure group 3 below.

Structure Group 2

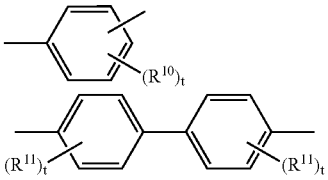

Structure Group 3

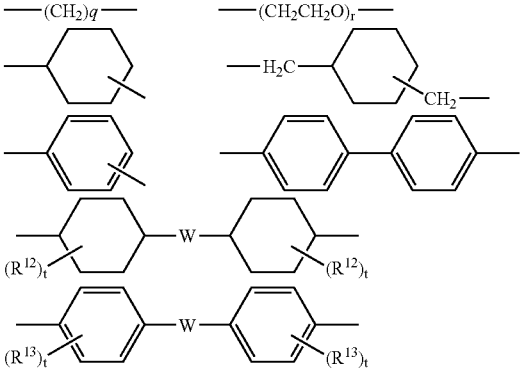

Among the structure groups 1 to 3, $R^6$ is selected from a hydrogen atom, an alkyl group having 1 to 4 carbon atoms, a phenyl group substituted by an alkyl group having 1 to 4 carbon atoms or an alkoxy group having 1 to 4 carbon atoms, an unsubstituted phenyl group, or an aralkyl group having 7 to 10 carbon atoms.

$R^7$ to $R^{13}$ are each independently selected from a hydrogen atom, an alkyl group having 1 to 4 carbon atoms, an alkoxy group having 1 to 4 carbon atoms, a phenyl group substituted by an alkoxy group having 1 to 4 carbon atoms, an unsubstituted phenyl group, an aralkyl group having 7 to 10 carbon atoms, or a halogen atom.

Further, m and s each represent 0 or 1, q and r each represent an integer from 1 to 10, and t represents an integer from 1 to 3. X represents a group represented by $\text{-}D\text{-}Si(R^2)_{(3-a)}Q_a$ shown in formula (I).

W shown in structure group 3 may be selected from those shown in structure group 4 below. In structure group 4, s' represents an integer from 0 to 3.

Structure Group 4

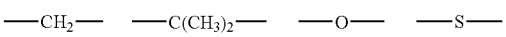

-continued

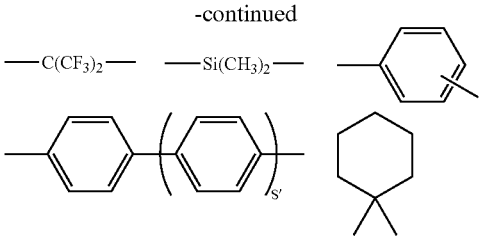

Regarding specific structures of $Ar_5$ in formula (III), the structures shown in the structure group 1 in which m of $Ar_1$ to $Ar_4$ is one can be cited when k=0, and the structures shown in the structure group 1 in which m of $Ar_1$ to $Ar_4$ is zero can be cited when k=1.

Specific examples of compounds represented by formula (III) include compounds (III-1) to (III-61) shown in Tables 1 to 7 below. However, the compounds represented by formula (III) used in an aspect of the invention are not limited thereto.

In structural formulas shown in columns of "$Ar_1$" to "$Ar_5$" in Tables 1 to 7, "—S" group connected to a benzene ring represents a monovalent group shown in a column of "S" in Tables 1 to 7 (a group equivalent to the structure represented by $-D-Si(R^2)_{(3-a)}Q_a$ shown in formula (I)).

TABLE 1
| No. | $Ar^1$ | $Ar^2$ | $Ar^3$ | $Ar^4$ | $Ar^5$ | k | S |
|---|---|---|---|---|---|---|---|
| III-1 | 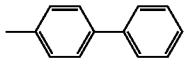 | 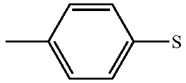 | — | — | 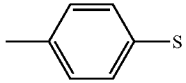 | 0 | —$(CH_2)_2$—COO—$(CH_2)_3$—Si(OiPr)$_3$ |
| III-2 | 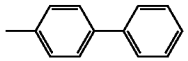 | 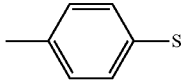 | — | — | 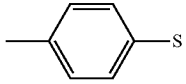 | 0 | —$(CH_2)_2$—COO—$(CH_2)_3$—Si(OiPr)$_2$Me |
| III-3 | 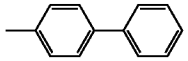 | 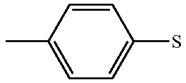 | — | — | 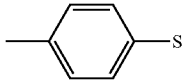 | 0 | —$(CH_2)_2$—COO—$(CH_2)_3$—Si(OiPr)Me$_2$ |
| III-4 | 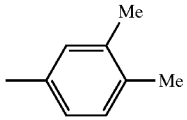 | 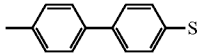 | — | — | 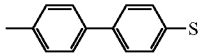 | 0 | —COO—$(CH_2)_3$—Si(OiPr)$_3$ |
| III-5 | 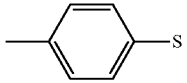 | 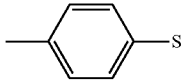 | — | — | 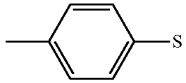 | 0 | —$(CH_2)_2$—COO—$(CH_2)_3$—Si(OiPr)$_3$ |
| III-6 | 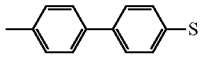 | 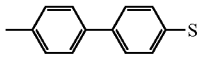 | — | — | 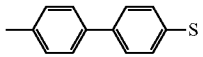 | 0 | —COO—$(CH_2)_3$—Si(OiPr)$_3$ |

TABLE 1-continued
| No. | $Ar^1$ | $Ar^2$ | $Ar^3$ | $Ar^4$ | $Ar^5$ | k | S |
|---|---|---|---|---|---|---|---|
| III-7 | 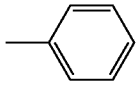 | 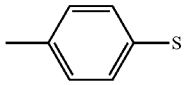 | 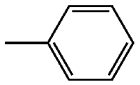 | 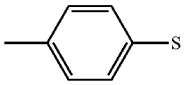 | 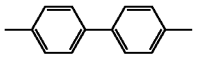 | 1 | $—(CH_2)_4—Si(OEt)_3$ |
| III-8 | 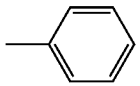 | 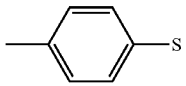 | 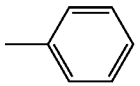 | 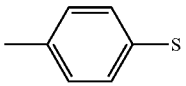 | 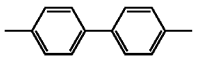 | 1 | $—(CH_2)_4—Si(OiPr)_3$ |
| III-9 | 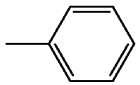 | 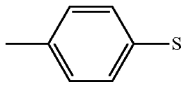 | 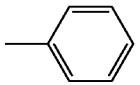 | 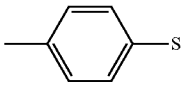 | 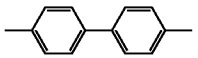 | 1 | $—CH═CH—(CH_2)_2—Si(OiPr)_3$ |
| III-10 | 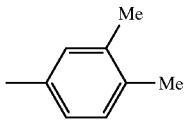 | 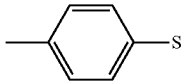 | 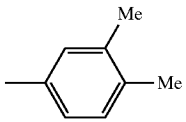 | 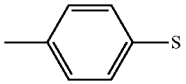 | 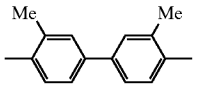 | 1 | $—(CH_2)_4—Si(OMe)_3$ |

TABLE 2
| No. | $Ar^1$ | $Ar^2$ | $Ar^3$ | $Ar^4$ | $Ar^5$ | k | S |
|---|---|---|---|---|---|---|---|
| III-11 | 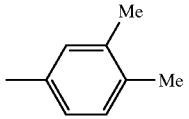 | 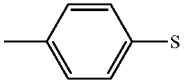 | 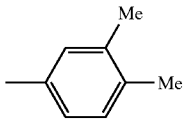 | 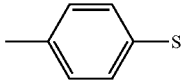 | 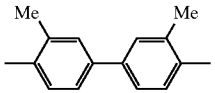 | 1 | $—(CH_2)_4—Si(OiPr)_3$ |
| III-12 | 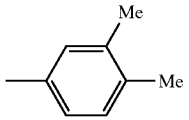 | 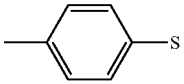 | 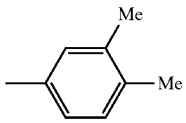 | 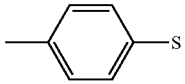 | 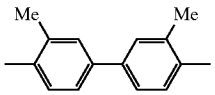 | 1 | $—CH═CH—(CH_2)_2—Si(OiPr)_3$ |
| III-13 | 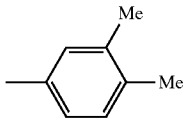 | 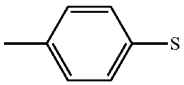 | 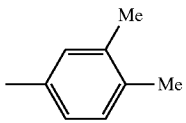 | 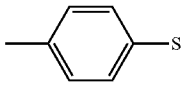 | 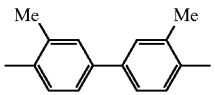 | 1 | $—CH═N—(CH_2)_3—Si(OiPr)_3$ |
| III-14 | 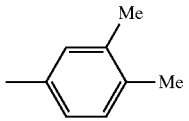 | 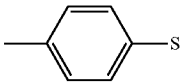 | 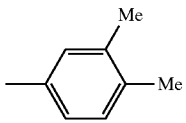 | 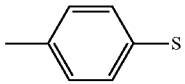 | 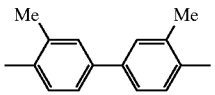 | 1 | $—O—(CH_2)_3—Si(OiPr)_3$ |
| III-15 | 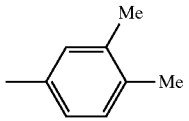 | 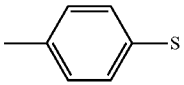 | 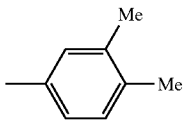 | 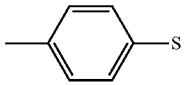 | 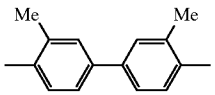 | 1 | $—COO—(CH_2)_3—Si(OiPr)_3$ |
| III-16 | 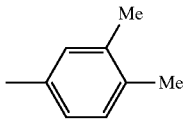 | 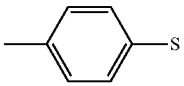 | 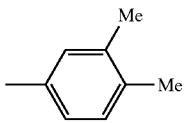 | 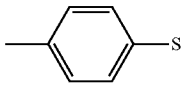 | 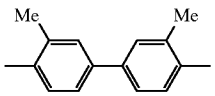 | 1 | $—(CH_2)_2—COO—(CH_2)_3—Si(OiPr)_3$ |
| III-17 | 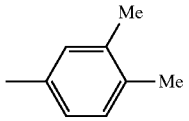 | 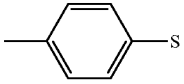 | 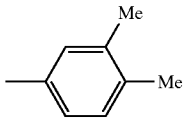 | 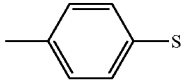 | 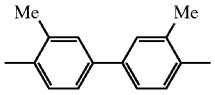 | 1 | $—(CH_2)_2—COO—(CH_2)_3—Si(OiPr)_2Me$ |

TABLE 2-continued
| No. | $Ar^1$ | $Ar^2$ | $Ar^3$ | $Ar^4$ | $Ar^5$ | k | S |
|---|---|---|---|---|---|---|---|
| III-18 | 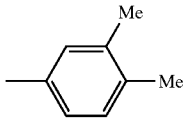 | 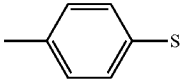 | 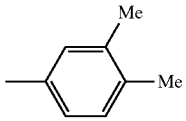 | 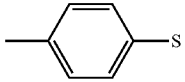 | 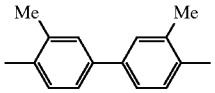 | 1 | $—(CH_2)_2—COO—(CH_2)_3—Si(OiPr)Me_2$ |
| III-19 | 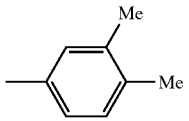 | 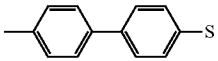 | 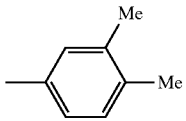 | 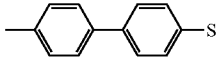 | 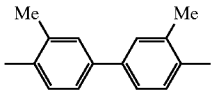 | 1 | $—COO—(CH_2)_3—Si(OiPr)_3$ |
| III-20 | 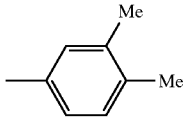 | 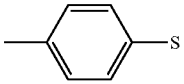 | 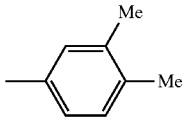 | 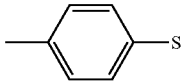 | 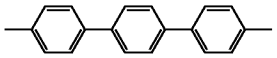 | 1 | $—(CH_2)_4—Si(OiPr)_3$ |

TABLE 3
| No. | $Ar^1$ | $Ar^2$ | $Ar^3$ | $Ar^4$ | $Ar^5$ | k | S |
|---|---|---|---|---|---|---|---|
| III-21 | 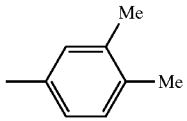 | 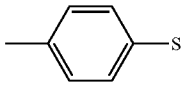 | 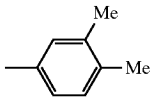 | 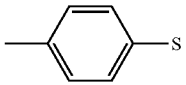 | 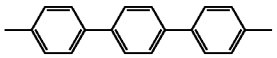 | 1 | —CH═CH—$(CH_2)_2$—Si(OiPr)$_3$ |
| III-22 | 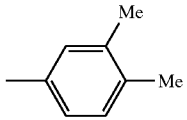 | 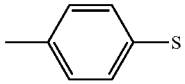 | 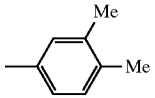 | 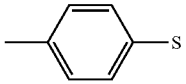 | 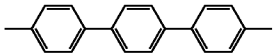 | 1 | —$(CH_2)_2$—COO—$(CH_2)_3$—Si(OiPr)$_3$ |
| III-23 | 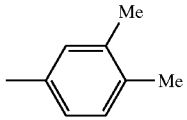 | 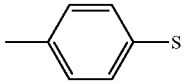 | 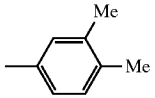 | 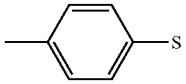 | 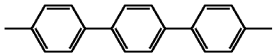 | 1 | —$(CH_2)_2$—COO—$(CH_2)_3$—Si(OiPr)$_2$Me |
| III-24 | 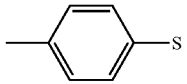 | 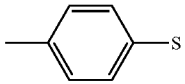 | 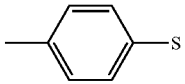 | 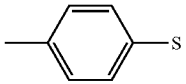 | 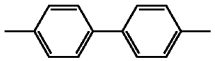 | 1 | —COO—$(CH_2)_3$—Si(OiPr)$_3$ |
| III-25 | 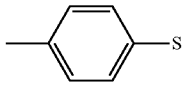 | 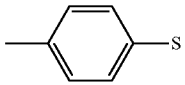 | 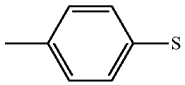 | 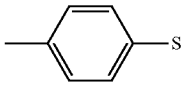 | 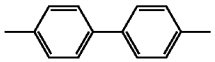 | 1 | —$(CH_2)_2$—COO—$(CH_2)_3$—Si(OiPr)$_3$ |
| III-26 | 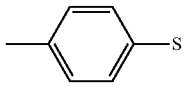 | 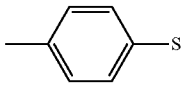 | 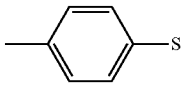 | 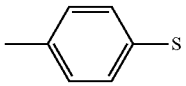 | 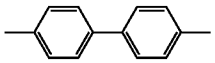 | 1 | —$(CH_2)_2$—COO—$(CH_2)_3$—Si(OiPr)$_2$Me |
| III-27 | 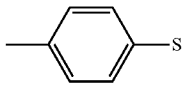 | 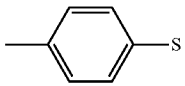 | 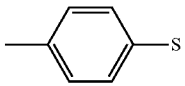 | 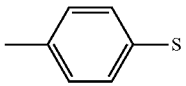 | 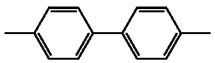 | 1 | —$(CH_2)_2$—COO—$(CH_2)_3$—Si(OiPr)Me$_2$ |

TABLE 3-continued
| No. | $Ar^1$ | $Ar^2$ | $Ar^3$ | $Ar^4$ | $Ar^5$ | k | S |
|---|---|---|---|---|---|---|---|
| III-28 | 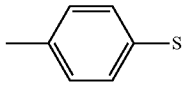 | 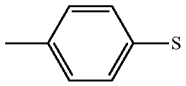 | 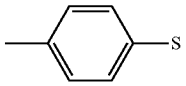 | 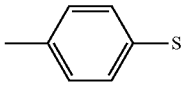 | 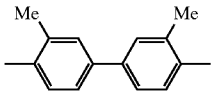 | 1 | —COO—$(CH_2)_3$—Si(OiPr)$_3$ |
| III-29 | 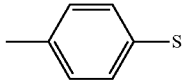 | 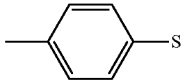 | 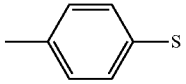 | 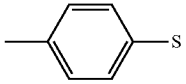 | 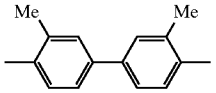 | 1 | —$(CH_2)_2$—COO—$(CH_2)_3$—Si(OiPr)$_3$ |
| III-30 | 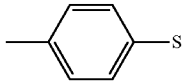 | 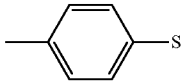 | 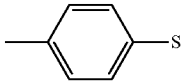 | 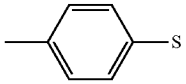 | 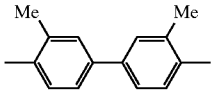 | 1 | —$(CH_2)_2$—COO—$(CH_2)_3$—Si(OiPr)$_2$Me |

TABLE 4
| No. | $Ar^1$ | $Ar^2$ | $Ar^3$ | $Ar^4$ | $Ar^5$ | k | S |
|---|---|---|---|---|---|---|---|
| III-31 | 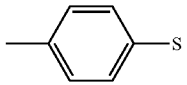 | 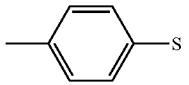 | 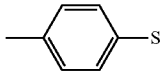 | 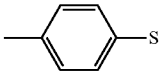 | 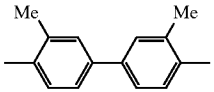 | 1 | —$(CH_2)_2$—COO—$(CH_2)_3$—Si(OiPr)$Me_2$ |
| III-32 | 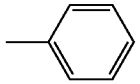 | 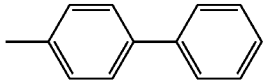 | — | — | 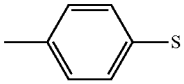 | 0 | —$(CH_2)_4$—Si(OiPr)$_3$ |
| III-33 | 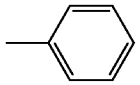 | 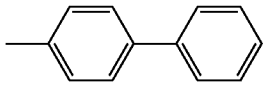 | — | — | 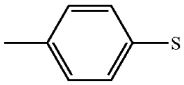 | 0 | —$(CH_2)_4$—Si(OEt)$_3$ |
| III-34 | 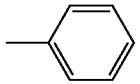 | 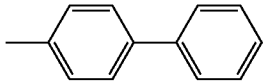 | — | — | 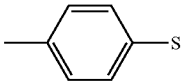 | 0 | —$(CH_2)_4$—Si(OMe)$_3$ |
| III-35 | 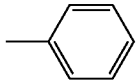 | 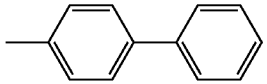 | — | — | 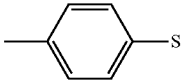 | 0 | —$(CH_2)_4$—SiMe(OMe)$_2$ |
| III-36 | 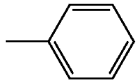 | 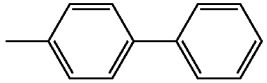 | — | — | 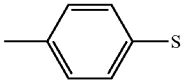 | 0 | —$(CH_2)_4$—SiMe(OiPr)$_2$ |
| III-37 | 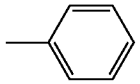 | 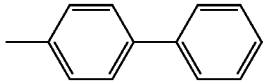 | — | — | 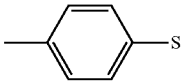 | 0 | —CH═CH—$(CH_2)_2$—Si(OiPr)$_3$ |
| III-38 | 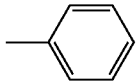 | 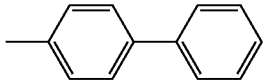 | — | — | 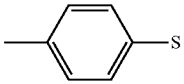 | 0 | —CH═CH—$(CH_2)_2$—Si(OMe)$_3$ |
| III-39 | 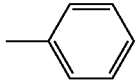 | 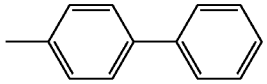 | — | — | 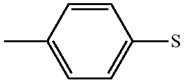 | 0 | —CH═N—$(CH_2)_3$—Si(OiMe)$_3$ |
| III-40 | 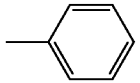 | 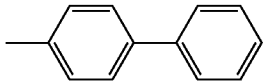 | — | — | 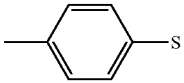 | 0 | —CH═N—$(CH_2)_3$—Si(OiPr)$_3$ |

TABLE 5
| No. | $Ar^1$ | $Ar^2$ | $Ar^3$ | $Ar^4$ | $Ar^5$ | k | S |
|---|---|---|---|---|---|---|---|
| III-41 | 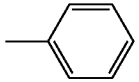 | 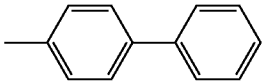 | — | — | 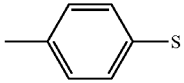 | 0 | —O—$(CH_2)_3$—Si(OiPr)$_3$ |
| III-42 | 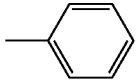 | 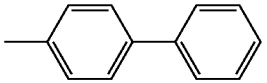 | — | — | 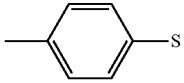 | 0 | —COO—$(CH_2)_3$—Si(OiPr)$_3$ |
| III-43 | 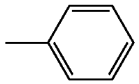 | 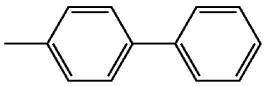 | — | — | 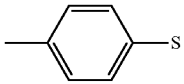 | 0 | —$(CH_2)_2$—COO—$(CH_2)_3$—Si(OiPr)$_3$ |
| III-44 | 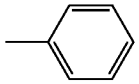 | 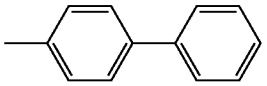 | — | — | 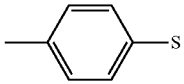 | 0 | —$(CH_3)_2$—COO—$(CH_2)_3$—Si(OiPr)$_2$Me |
| III-45 | 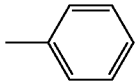 | 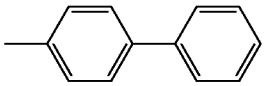 | — | — | 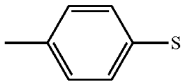 | 0 | —$(CH_2)_2$—COO—$(CH_2)_3$—Si(OiPr)Me$_2$ |
| III-46 | 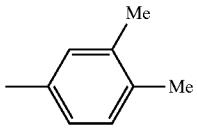 | 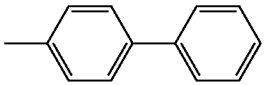 | — | — | 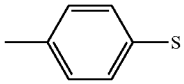 | 0 | —$(CH_2)_4$—Si(OMe)$_3$ |
| III-47 | 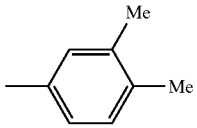 | 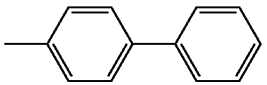 | — | — | 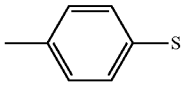 | 0 | —$(CH_2)_2$—COO—$(CH_2)_3$—Si(OiPr)$_3$ |

TABLE 5-continued
| No. | $Ar^1$ | $Ar^2$ | $Ar^3$ | $Ar^4$ | $Ar^5$ | k | S |
|---|---|---|---|---|---|---|---|
| III-48 | 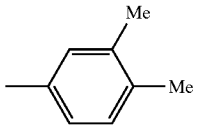 | 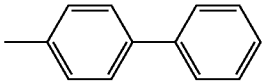 | — | — | 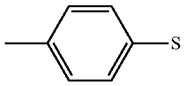 | 0 | —$(CH_2)_2$—COO—$(CH_2)_3$—SiMe$(OiPr)_2$ |
| III-49 | 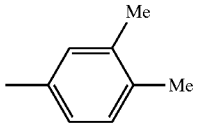 | 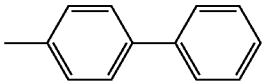 | — | — | 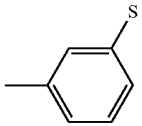 | 0 | —O—$(CH_2)_3$—Si$(OiPr)_3$ |
| III-50 | 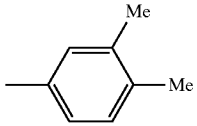 | 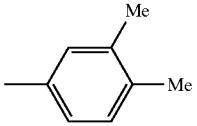 | — | — | 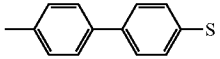 | 0 | —COO—$(CH_2)_3$—Si$(OiPr)_3$ |

TABLE 6
| No. | $Ar^1$ | $Ar^2$ | $Ar^3$ | $Ar^4$ | $Ar^5$ | k | S |
|---|---|---|---|---|---|---|---|
| III-51 | 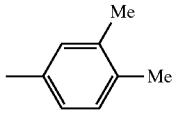 | 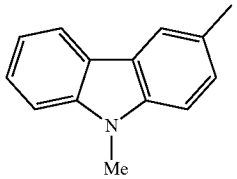 | — | — | 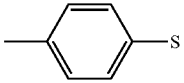 | 0 | —$(CH_2)_4$—$Si(OiPr)_3$ |
| III-52 | 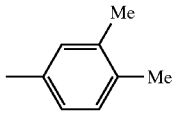 | 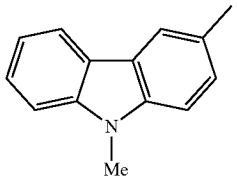 | — | — | 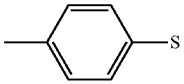 | 0 | –$(CH_2)_2$—COO—$(CH_2)_3$—$Si(OiPr)_3$ |
| III-53 | 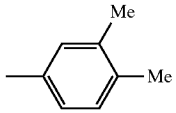 | 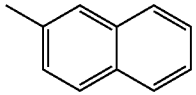 | — | — | 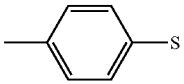 | 0 | —$(CH_2)_4$—$Si(OiPr)_3$ |
| III-54 | 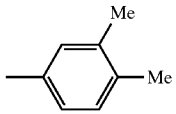 | 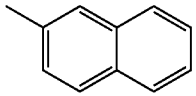 | — | — | 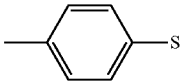 | 0 | —$(CH_2)_2$—COO—$(CH_2)_3$—$Si(OiPr)_3$ |
| III-55 | 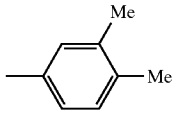 | 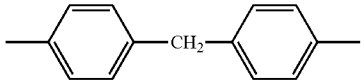 | — | — | 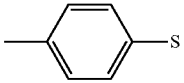 | 0 | —$(CH_2)_4$—$Si(OiPr)_3$ |
| III-56 | 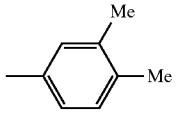 | 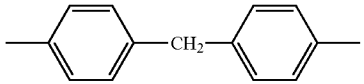 | — | — | 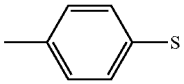 | 0 | —$(CH_2)_2$—COO—$(CH_2)_3$—$Si(OiPr)_3$ |

TABLE 6-continued
| No. | $Ar^1$ | $Ar^2$ | $Ar^3$ | $Ar^4$ | $Ar^5$ | k | S |
|---|---|---|---|---|---|---|---|
| III-57 | 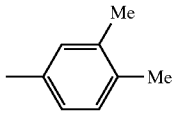 | 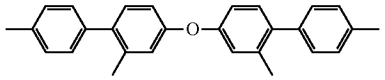 | — | — | 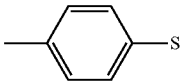 | 0 | —$(CH_2)_4$—Si(OiPr)$_3$ |
| III-58 | 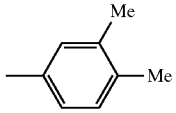 | 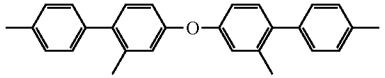 | — | — | 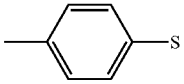 | 0 | —$(CH_2)_2$—COO—$(CH_2)_3$—Si(OiPr)$_3$ |
| III-59 | 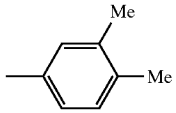 | 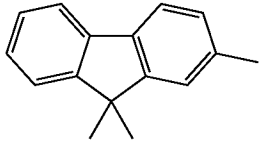 | — | — | 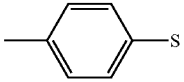 | 0 | —$(CH_2)_2$—COO—$(CH_2)_3$—Si(OiPr)$_3$ |

TABLE 7
| No. | $Ar^1$ | $Ar^2$ | $Ar^3$ | $Ar^4$ | $Ar^5$ | k | S |
|---|---|---|---|---|---|---|---|
| III-60 | 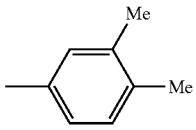 | 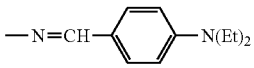 | — | — | 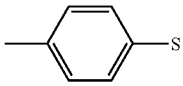 | 0 | $—(CH_2)_2—COO—(CH_2)_3—Si(OiPr)_3$ |
| III-61 | 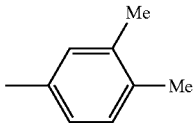 | 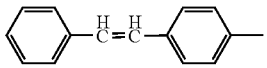 | — | — | 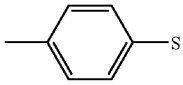 | 0 | $—(CH_2)_2—COO—(CH_2)_3—Si(OiPr)_3$ |
As specific examples of formula (II), compounds (II)-1 to (II)-26 shown below can be cited. However, the invention is not restricted thereto.
(II)-1
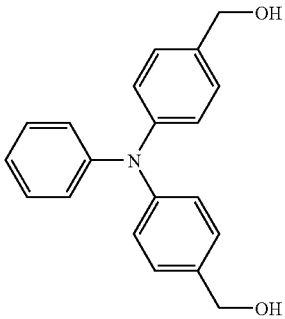
(II)-2
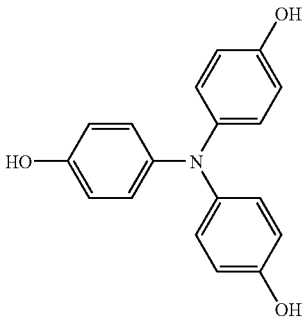
(II)-3
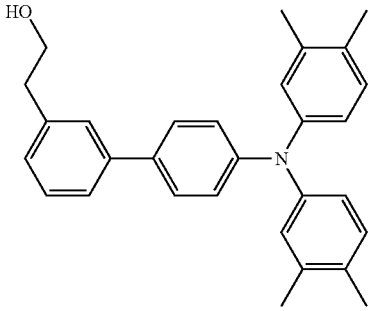
-continued
(II)-4
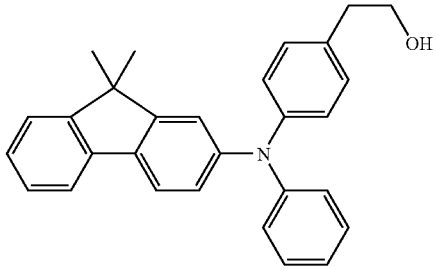
(II)-5
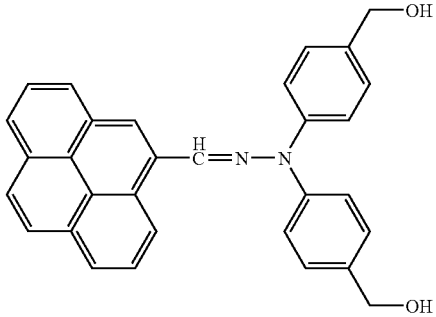
(II)-6
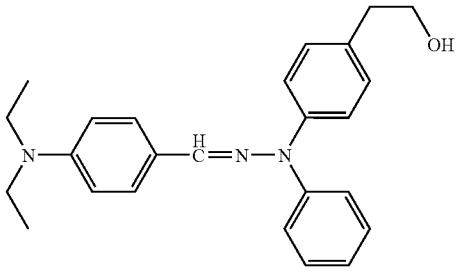
(II)-7
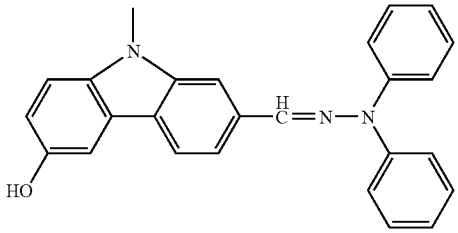

-continued
(II)-8
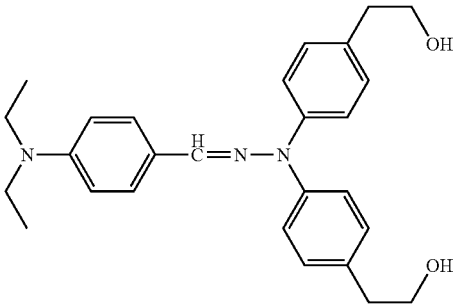
(II)-9
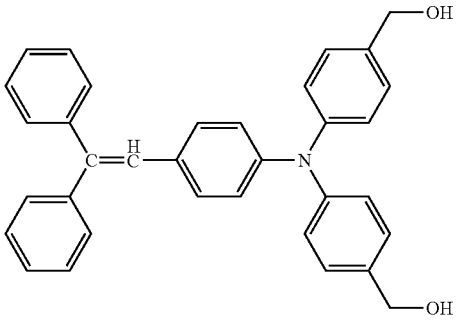
(II)-10
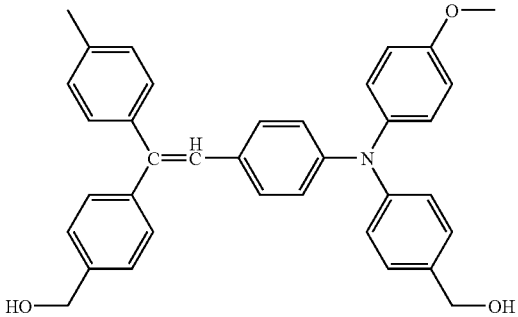
(II)-11
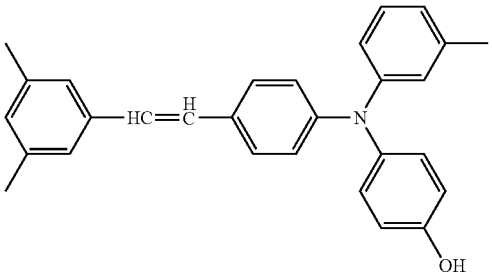
-continued
(II)-12
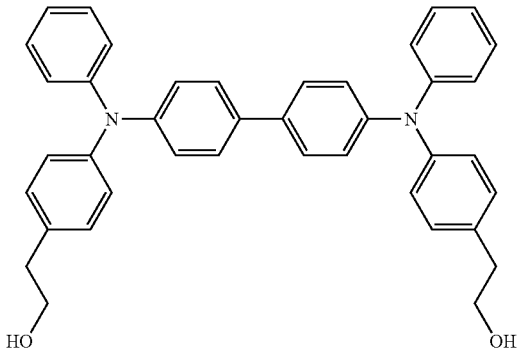
(II)-13
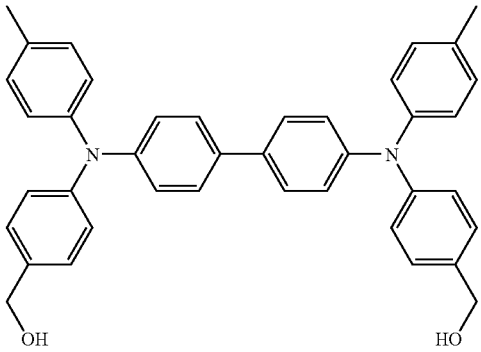
(II)-14
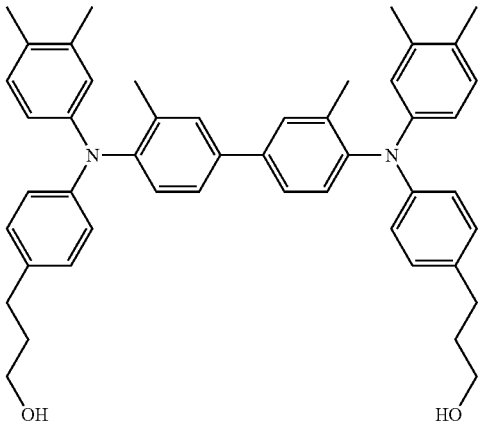
(II)-15
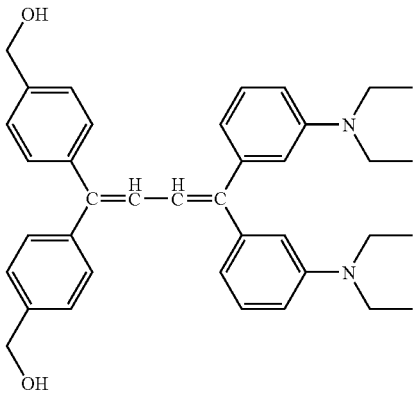

-continued
(II)-16
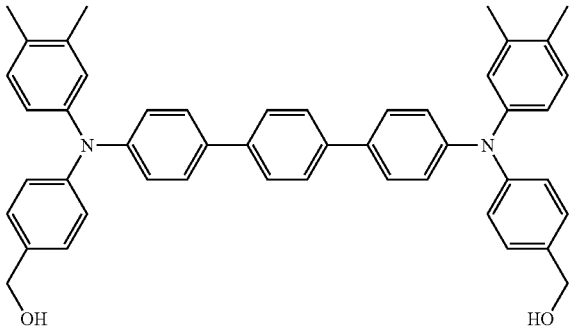
(II)-17
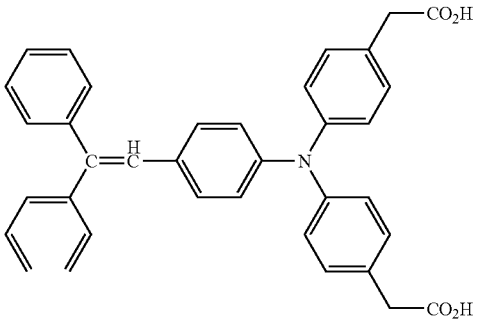
(II)-18
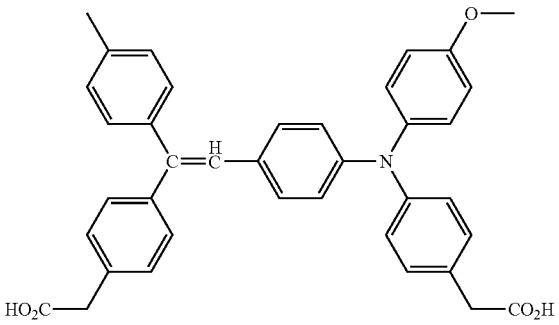
(II)-19
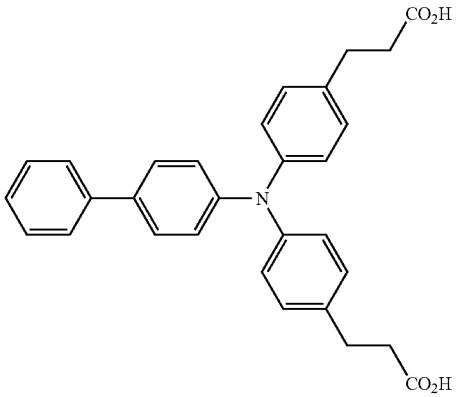
-continued
(II)-20
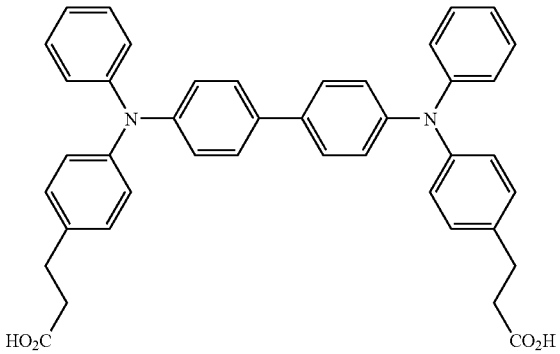
(II)-21
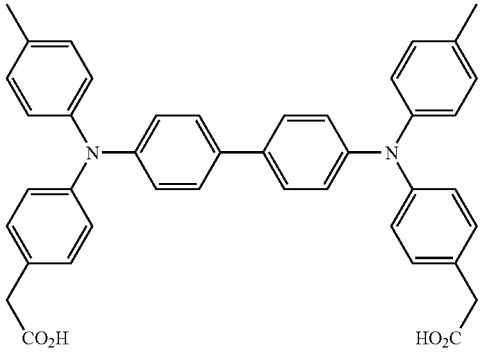
(II)-22
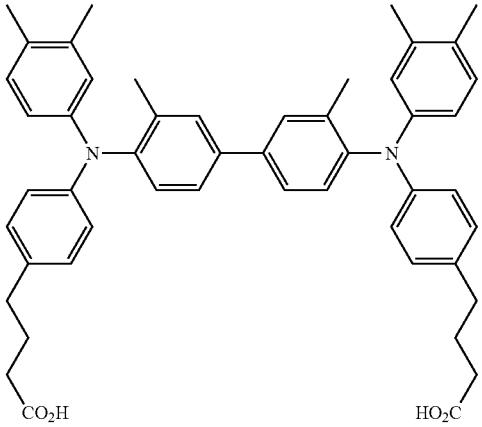
(II)-23
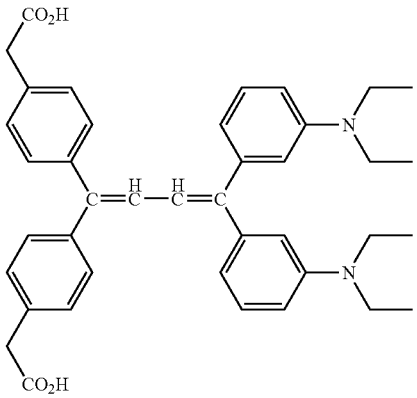

-continued (II)-24

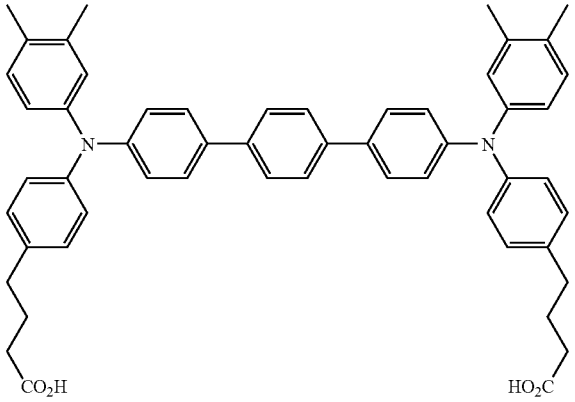

(II)-25

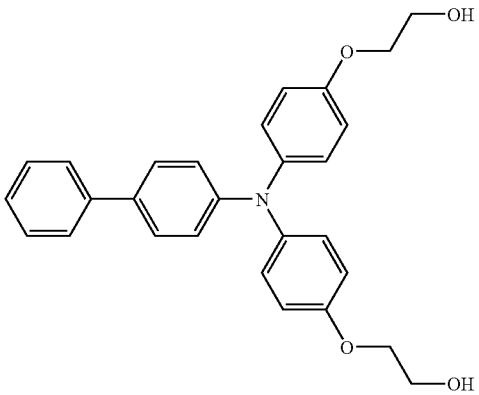

(II)-26

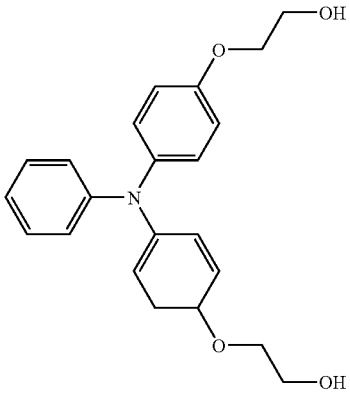

Furthermore, a compound represented by formula (IV) below may be added in order to control various physical properties such as mechanical strength and film resistance.

$$Si(R^2)_{(4-c)}Q_c \quad (IV)$$

In formula (IV), $R^2$ represents a hydrogen atom, an alkyl group, or a substituted or unsubstituted aryl group, Q represents a hydrolyzable group, and c represents an integer of 1 to 4.

Specific examples of compounds represented by formula (IV) include the following silane coupling agents: tetrafunctional alkoxysilanes (c=4) such as tetramethoxysilane and tetraethoxysilane; trifunctional alkoxysilanes (c=3) such as methyltrimethoxysilane, methyltriethoxysilane, ethyltriethoxysilane, methyltrimethyoxyethoxysilane, vinyltrimethoxysilane, vinyltriethoxysilane, phenyltrimethoxysilane, γ-glycidoxypropylmethyldiethoxysilane, γ-glycidoxypropyltrimethoxysilane, γ-aminopropyltriethoxysilane, γ-aminopropyltrimethoxysilane, γ-aminopropylmethyldimethoxysilane, N-β(aminoethyl)γ-aminopropyltriethoxysilane, (tridecafluoro-1,1,2,2-tetrahydrooctyl) triethoxysilane, (3,3,3-trifluoropropyl) trimethoxysilane, 3-(heptafluoroisopropoxy)propyltriethoxysilane, 1H, 1H, 2H, 2H-perfluoroalkyltriethoxysilane, 1H, 1H, 2H, 2H-perfluorodecyltriethoxysilane and 1H, 1H, 2H, 2H-perfluorooctyl triethoxysilane; bifunctional alkoxysilanes (c=2) such as dimethyldimethoxysilane, diphenyldimethoxysilane and methylphenyldimethoxysilane; and monofunctional alkoxysilanes (c=1) such as trimethylmethoxysilane. In order to increase the strength of the film, trifunctional and tetrafunctional alkoxysilanes are preferable, and monofunctional or bifunctional alkoxysilanes are preferable for improving the flexibility and the film forming property.

Silicon-containing hardcoat agents prepared mainly from the above coupling agents may be used as well. Commercially available hardcoat agents include, for example, KP-85, X-40-9740 and X-40-2239 (produced by Shin-Etsu Silicone Co, Ltd.) and AY42-440, AY42-441 and AY49-208 (produced by Toray Dow Coning Co., Ltd.).

In order to increase the strength, compounds having two or more silicon atoms, such as those represented by formula (V), may be used.

$$B—(Si(R^2)_{(3-a)}Q_a)_2 \quad (V)$$

In formula (V), B represents a divalent organic group, $R^2$ represents a hydrogen atom, an alkyl group, or a substituted or unsubstituted aryl group, Q represents a hydrolyzable group, and a represents an integer of 1 to 3.

Specifically, materials shown in Table 8 below can be cited as examples. However, the examples should not be construed as limiting the invention.

TABLE 8

| No. | Structural Formula |
|---|---|
| V-1 | $(MeO)_3Si—(CH_2)_2—Si(OMe)_3$ |
| V-2 | $(MeO)_2MeSi—(CH_2)_2—SiMe(OMe)_2$ |
| V-3 | $(MeO)_2MeSi—(CH_2)_6—SiMe(OMe)_2$ |
| V-4 | $(MeO)_3Si—(CH_2)_6—Si(OMe)_3$ |
| V-5 | $(EtO)_3Si—(CH_2)_6—Si(OEt)_3$ |
| V-6 | $(MeO)_2MeSi—(CH_2)_{10}—SiMe(OMe)_2$ |
| V-7 | $(MeO)_3Si—(CH_2)_3—NH—(CH_2)_3—Si(OMe)_3$ |
| V-8 | $(MeO)_3Si—(CH_2)_3—NH—(CH_2)_2—NH—(CH_2)_3—Si(OMe)_3$ |

TABLE 8-continued

| No. | Structural Formula |
|---|---|
| V-9 | 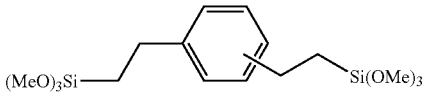 |
| V-10 | 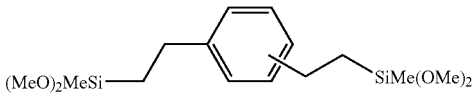 |
| V-11 | 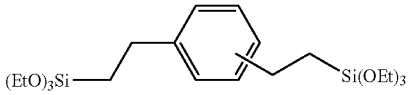 |
| V-12 | 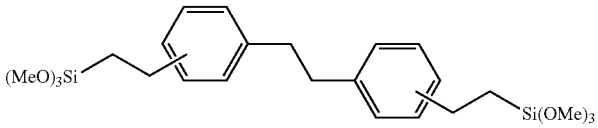 |
| V-13 | 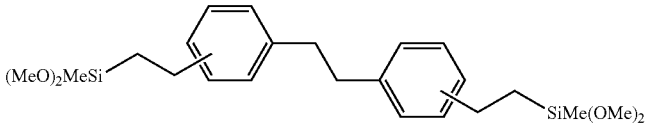 |
| V-14 | 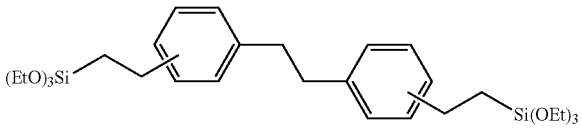 |
| V-15 | $(MeO)_3SiC_3H_6$—O—$CH_2CH\{$—O—$C_3H_6Si(OMe)_3\}$—$CH_2\{$—O—$C_3H_6Si(Ome)_3\}$ |
| V-16 | $(MeO)_3SiC_2H_4$—$SiMe_2$—O—$SiMe_2$—O—$SiMe_2$—$C_2H_4Si(OMe)_3$ |

Furthermore, a resin that is soluble in an alcohol solvent or ketone solvent may be added in order to control the film property and elongate liquid service life. Examples thereof include polyvinyl butyral resins, polyvinyl formal resins, polyvinyl acetal resins such as a partially acetalized polyvinyl acetal resin whose butyral is partially modified with formal or acetoacetal (e.g., trade name: S-LEC B and K, manufactured by Sekisui Chemical Co., Ltd.), polyamide resins, cellulose resins, and phenol resins. In particular, polyvinyl acetal resins are preferable from the viewpoint of electrical characteristics.

Various resins may be added for the purposes of controlling the discharge gas resistance, mechanical strength, scratch resistance, particle dispersibility and viscosity, reducing torque, controlling wear amount, and extending the pot life. In particular, when a siloxane-containing resin is used, a resin that is soluble in alcohol may be added.

Examples of the resin that is soluble in an alcoholic solvent include polyvinyl butyral resins, polyvinyl formal resins, polyvinyl acetal resins such as a partially acetalized polyvinyl acetal resin whose butyral is partially modified with formal or acetoacetal (e.g., trade name: S-LEC B and K, manufactured by Sekisui Chemical Co., Ltd.), polyamide resins, cellulose resins, and phenol resins. In particular, polyvinyl acetal resins are preferable from the viewpoint of electrical characteristics.

The molecular weights of the resins are preferably in the range of 2000 to 100000, and more preferably in the range of 5000 to 50000. When the molecular weight is smaller than 2000, desired effects cannot be obtained; on the other hand, when it is larger than 100000, the addition amount is restricted due to reduced solubility or the addition of resin causes film formation defects at the time of coating. The addition amount is preferably in the range of 1 to 40% by weight, more preferably in the range of 1 to 30% by weight, and most preferably in the range of 5 to 20% by weight. When the addition amount is less than 1% by weight, desired effects cannot be obtained; on the other hand, when it exceeds 40% by weight, image blurring easily occurs under a high temperature and high humidity condition in some cases. Only one of such resins may be used, or a mixture of two or more of such resins may be used.

In order to extend the pot life and control the film characteristics, a cyclic compound having a repeated structural unit represented by formula (VI) below or a derivative of the compound may be contained.

(VI)

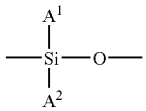

In formula (VI), $A^1$ and $A^2$ each independently represent a monovalent organic group.

The cyclic compound having a repeated structural unit represented by formula (VI) may be a commercially available cyclic siloxane. Specific examples thereof include cyclic dimethylcyclosiloxanes such as hexamethylcyclotrisiloxane, octamethylcyclotetrasiloxane, decamethylcyclopentasiloxane and dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as 3-(3,3,3-trifluoropropyl)methylcyclotrisiloxane; hydrosilyl group-containing cyclosiloxanes such as a methylhydrosiloxane mixture, pentamethylcyclopentasiloxane and phenylhydrocyclosiloxane; and vinyl group-containing cyclosiloxanes such as pentavinylpentamethylcyclopentasiloxane. Only one of the above cyclic siloxane compounds may be used, or a mixture of two or more of the cyclic siloxane compounds may be used.

Various kinds of fine particles may be added in order to improve the contaminant adhesion-resistance and lubricity of the surface of the photoreceptor. Only one kind of fine particles may be used, or two or more kinds of fine particles may be used in combination. An example of the fine particles is silicon-containing fine particles. The silicon-containing fine particles are fine particles that contain silicon as a constituent element, and specific examples thereof include colloidal silica and silicone fine particles. The colloidal silica that is used as the silicon-containing fine particles are selected from an acidic or basic water dispersion liquid containing fine particles having an average particle diameter of 1 to 100 nm (preferably 10 to 30 nm) dispersed therein, or an organic solvent, such as an alcohol, a ketone, or an ester, containing such fine particles dispersed therein. The colloidal silica may be selected from commercially available products. The solid content of the colloidal silica in a surface layer is not particularly restricted. From the viewpoint of film forming property, electrical properties, and the mechanical strength, the ratio of the solid of the colloidal silica to the total solid of the surface layer is preferably in the range of 0.1 to 50% by weight, and more preferably in the range of 0.1 to 30% by weight.

The fine silicone particles used as silicon-containing fine particles are selected from silicone resin particles, silicone rubber particles, and silica particles whose surface has been treated with silicone, which are spherical and have an average particle diameter of 1 to 500 nm (preferably 10 to 100 nm), and commercially available products may be used. The fine silicon particles are small diameter particles that is chemically inactive and have excellent dispersibility in the resin. Since the quantity of the fine silicone particles required for achieving sufficient characteristics is low, the surface property of the photoreceptor may be improved without disturbing the crosslinking reaction. That is, the fine silicon particles in the state of being uniformly incorporated in a strong crosslinking structure may improve the lubricating property and the water-repellency of the surface of the photoreceptor, and may maintain excellent wear resistance and contaminant adhesion resistance over a long period of time. The content of the silicon fine particles in the surface layer of the photoreceptor according to an aspect of the invention may be, relative to the total solid content of the surface layer, from 0.1 to 30% by weight, and preferably from 0.5 to 10% by weight.

Other examples of fine particles include fluorine-containing fine particles such as ethylene tetrafluoride, ethylene trifluoride, propylene hexafluoride, vinyl fluoride, and vinylidene fluoride; fine particles made of resins obtained by copolymerizing a fluorine resin and a monomer having a hydroxyl group (e.g., those shown in "Proceedings of 8th polymer material forum, p89"; and semiconductive metal oxides such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $In_2O_3$, ZnO and MgO.

Further, oils such as silicone oils may be added for the same purpose. Examples of silicone oils include silicone oils such as dimethylpolysiloxane, diphenylpolysiloxane, and phenylmethylsiloxane; and reactive silicone oils such as amino-modified polysiloxane, epoxy-modified polysiloxane, carboxyl-modified polysiloxane, carbinol-modified polysiloxane, methacryl-modified polysiloxane, mercapto-modified polysiloxane, and phenol-modified polysiloxane.

The ratio of exposure of the fine particles on the surface of the surface layer may be 40% or less. When the exposure ratio is above the range, the nature of the particles largely affects the property of the surface layer, whereby image deletion easily occurs due to reduced electric resistance. The exposure ratio is more preferably 30% or less. With an exposure ratio of 30% or less, particles exposed on the surface are effectively refreshed by a cleaning member, so that the toner component filming on the surface of the photoreceptor is prevented, a discharge product is removed, and wear of the cleaning member is reduced due to a decrease in the torque, over a long period of time.

Furthermore, additives such as a plasticizer, a surface modifier, an antioxidant, and a photodegradation preventing agent may be used. Examples of the plasticizer include biphenyl, biphenyl chloride, terphenyl, dibutyl phthalate, diethylene glycol phthalate, dioctyl phthalate, triphenyl phosphate, methylnaphthalene, benzophenone, chlorinated paraffin, polypropylene, polystyrene, and various fluoro hydrocarbons.

To a surface layer, an antioxidant having a hindered phenol, hindered amine, thioether or phosphate moiety structure may be added, which are effective in improving the potential stability and image quality in varied environments. Examples of the antioxidants include hindered phenol-containing antioxidants such as "SUMILIZER BHT-R", "SUMILIZER MDP-S", "SUMILIZER BBM-S", "SUMILIZER WX-R", "SUMILIZER NW", "SUMILIZER BP-76", "SUMILIZER BP-101", "SUMILIZER GA-80", "SUMILIZER GM" and "SUMILIZER GS" (all produced by SUMITOMO Chemical Co., Ltd.), "IRGANOX 1010", "IRGANOX 1035", "IRGANOX 1076", "IRGANOX 1098", "IRGANOX 1135", "IRGANOX 1141", "IRGANOX 1222", "IRGANOX 1330", "IRGANOX 1425WL", "IRGANOX 1520L", "IRGANOX 245", "IRGANOX 259", "IRGANOX 3114", "IRGANOX 3790", "IRGANOX 5057" and "IRGANOX 565" (all produced by Chiba Speciality Chemicals Co., Ltd.), and "ADECASTAB AO-20", "ADECASTAB AO-30", "ADECASTAB AO-40", "ADECASTAB AO-50", "ADECASTAB AO-60", "ADECASTAB AO-70", "ADECASTAB AO-80" and "ADECASTAB AO-330" (all produced by ASAHI DENKA Co., Ltd.); hindered amine-containing antioxidants such as "SANOL LS2626", "SANOL LS765", "SANOL LS770", "SANOL LS744", "TINUBIN 144", "TINUBIN 622LD", "MARK LA57", "MARK LA67", "MARK LA62", "MARK LA68", "MARK LA63" and "SUMILIZER TPS"; and thioether-containing antioxidants such as "SUMILIZER TP-D"; and phosphite-containing antioxidants such as "MARK 2112", "MARK PEP•8", "MARK PEP•24G", "MARK PEP•36", "MARK 329K" and "MARK HP•10". In particular, hindered phenol-containing antioxidants and hindered amine-containing antioxidants are preferable. Furthermore, these antioxidants may be modified with a substituent capable of cross-linking with the material that forms a cross-linked film, such as an alkoxysilyl group.

It is possible to add a catalyst to a coating liquid for forming a surface layer or use a catalyst during the preparation of the coating liquid. Examples of the catalyst include: inorganic acids such as hydrochloric acid, acetic acid, phosphoric acid, and sulfuric acid; organic acids such as formic acid, propionic acid, oxalic acid, p-toluenesulfonic acid, benzoic acid, phthalic acid, and maleic acid; and alkali catalysts such as potassium hydroxide, sodium hydroxide, calcium hydroxide, ammonia, and triethylamine. Furthermore, solid catalysts that are insoluble in the system, such as the catalysts shown below may be used as well.

Examples include cation-exchange resins such as AMBERLITE 15, AMBERLITE 200C and AMBERLITE 15E (all produced by Rohm and Haas Co., Ltd.), Dow X MWC-1-H, Dow X 88 and Dow X HCR-W2 (all produced by Dow Chemical Co., Ltd.), LEWATIT SPC 108 and LEWATIT SPC 118 (all produced by Bayer Co., Ltd.), DIAION RCP-150H (produced by Mitsubishi Chemical Corporation), Sumika Ion KC-470, DUOLITE C26-C, DUOLITE C-433 and DUOLITE C-464 (all produced by Sumitomo Chemical Co., Ltd.), and NAFION H (produced by DuPont Co., Ltd.); anion-exchange resins such as AMBERLITE IRA-400 and AMBERLITE IRA-45 (all produced by Rohm and Hass Co., Ltd.); inorganic solids having a surface to which a group containing a proton acid group—such as $Zr(O_3PCH_2CH_2SO_3H)_2$ or $Th(O_3PCH_2CH_2COOH)_2$—is bonded; polyorganosiloxane containing a proton acid group, such as polyorganosiloxane having a sulfonic acid group; heteropoly acids such as cobalt tungstic acid and phosphorus molybdic acid; isopolyacids such as niobic acid, tantalic acid and molybdic acid; simple metal oxides such as silica gel, alumina, chromia, zirconia, CaO and MgO; composite metal oxides such as silica-alumina, silica-magnesia, silica-zirconia and zeolite; clay minerals such as acid clay, activated clay, montmorillonite and kaolinite; metal sulfates such as $LiSO_4$ and $MgSO_4$; metal phosphates such as zirconium phosphate and lanthanum phosphate; metal nitrates such as $LiNO_3$ and $Mn(NO_3)O_2$; inorganic solids having a surface to which a group containing an amino group is bonded, such as a solid obtained by reacting aminopropyltriethoxysilane with a surface of silica gel; and polyorganosiloxane containing an amino group such as an amino-modified silicone resin.

Furthermore, it is possible to use a solid catalyst that is insoluble in neither of the photofunctional compound, reaction products, water, or the solvent, at preparation of the coating liquid, because the stability of the coating liquid may be improved. The solid catalyst that is insoluble in the system is not particularly restricted as far as the catalyst component is insoluble in compounds shown by formulas (I), (II), (III) and (V), other additives, water, and the solvent. Although there is no particular restriction on the amount of the solid catalyst to be used, the amount may be in the range of 0.1 to 100 parts by mass per 100 parts by mass of the compounds having a hydrolyzable group. The solid catalysts are, as mentioned above, insoluble in the raw material compounds, reaction products, the solvent, etc.; accordingly, the solid catalyst may be readily removed by a conventional method after the reaction. Although the reaction temperature and the reaction time are appropriately selected in accordance with the kind and amount of the raw material compounds and the solid catalyst to be used, the reaction temperature is usually in the range of 0 to 100° C., preferably in the range of 10 to 70° C., and more preferably in the range of 15 to 50° C., and the reaction time may be in the range of 10 min to 100 hrs. When the reaction time exceeds the above-mentioned upper limit value, gelation tends to occur easily.

When a catalyst that is insoluble in the system is used during the preparation of the coating liquid, it is possible to additionally use a catalyst that is soluble in the system so as to improve the strength and the liquid storage stability. Examples of such an additional catalyst include, in addition to those described above, organic aluminum compounds such as aluminum triethylate, aluminum triisopropylate, aluminum tri(sec-butyrate), mono(sec-butoxy) aluminum diisopropylate, diisopropoxyaluminum (ethylacetoacetate), aluminum tris(ethylacetoacetate), aluminum bis(ethylacetoacetate) monoacetylacetonate, aluminum tris(acetylacetonate), aluminum diisopropoxy(acetylacetonate), aluminum isopropoxy-bis(acetylacetonate), aluminum tris(trifluoroacetylacetonate), and aluminum tris(hexafluoroacetylacetonate).

Besides the organic aluminum compounds, examples of the additional catalyst further include: organic tin compounds such as dibutyltin dilaurate, dibutyltin dioctylate, and dibutyltin diacetate; organic titanium compounds such as titanium tetrakis(acetylacetonate), titanium bis(butoxy)bis(acetylacetonate), and titanium bis(isopropoxy)bis(acetylacetonate); and zirconium compounds such as zirconium tetrakis(acetylacetonate), zirconium bis(butoxy)bis(acetylacetonate), and zirconium bis(isopropoxy)bis(acetylacetonate). However, from the viewpoints of safety, low cost and long pot life, it is preferable to use an organic aluminum compounds, and it is more preferable to use an aluminum chelate compound. Although there is no particular restriction on the amount of the catalyst to be used, the amount is preferably in the range of 0.1 to 20 parts by mass, and particularly preferably in the range of 0.3 to 10 parts by mass, per 100 parts by mass of the compounds having a hydrolysable group.

Furthermore, when an organic metal compound is used as a catalyst, it is preferable to add a polydentate ligand from the viewpoints of the pot life and curing efficiency. As the polydentate ligand like this, those described below and the derivatives thereof can be cited. However, the invention is not restricted thereto.

Specifically, examples of the polydentate ligand include β-diketones such as acetylacetone, trifluoroacetylacetone, hexafluoroacetylacetone, and dipivaloyl methyl acetone; acetoacetic acid esters such as methyl acetoacetate and ethyl acetoacetate; bipyridine and derivatives thereof; glycine and derivatives thereof; ethylene diamine and derivatives thereof; 8-oxyquinoline and derivatives thereof; salicylaldehyde and derivatives thereof; catechol and derivatives thereof; bidentate ligand such as a 2-oxyazo compound; diethyl triamine and derivatives thereof; tridentate ligand such as nitrilotriacetic acid and derivatives thereof; and hexadentate ligand such as ethylenediaminetetraacetic acid (EDTA) and derivatives thereof. In addition to the organic ligands described above, inorganic ligands such as pyrophosphoric acid and triphosphoric acid are also usable. As the polydentate ligand, specifically, bidentate ligands can be cited, and may specifically be a bidentate ligand represented by the following formula (VII), besides those described above. In particular, bidentate ligands represented by formula (VII) below are more preferable, and those in which $R^5$ and $R^6$ in formula (VII) are the same are particularly preferable. When $R^5$ and $R^6$ are the same, the coordination force of the ligand around room temperature is strong, and the stability of the coating liquid may be further improved thereby.

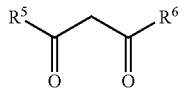

(VII)

In formula (VII), $R^5$ and $R^6$ each independently represent an alkyl or fluoroalkyl group having 1 to 10 carbon atoms or an alkoxy group having 1 to 10 carbon atoms.

The amount of the polydentate ligand to be added may be determined arbitrarily, and may be 0.01 mol or more, preferably 0.1 mol or more, and more preferably 1 mol or more, relative to 1 mol of the organic metal compound to be used.

The preparation of the coating liquid may be conducted without using a solvent, or may be conducted using, as necessary, various solvents whose examples include alcohols such as methanol, ethanol, propanol and butanol; ketones such as acetone and methyl ethyl ketone; tetrahydrofuran; and ethers such as diethyl ether and dioxane. As such solvents, those having a boiling temperature of 100° C. or less can be mentioned. In an exemplary embodiment, an arbitrary mixture of two or more of such solvents is used. The amount of the solvent may be determined arbitrarily. Since an organosilicon compound tends to precipitate when the amount of the solvent is too small, the amount is preferably from 0.5 to 30 parts by mass and preferably from 1 to 20 parts by mass, relative to one part by mass of the organosilicon compound.

The reaction temperature and the reaction time upon curing of the coating liquid is not particularly restricted. The reaction temperature is preferably 60° C. or more and more preferably in the range of 80 to 200° C., and the reaction time may be in the range of 10 min to 5 hrs from the viewpoints of the mechanical strength and chemical stability of the resultant silicon resin. For stabilizing the characteristics of the surface layer, it is possible to keep the surface layer, which is obtained by curing the coating liquid, in a high humidity state. Further, hydrophobicity may be imparted to the surface layer by a surface treatment using hexamethyldisilazane or trimethylchlorosilane, in accordance with the application.

When a charge transport material is added to a resin having the crosslinking structure or a charge transporting function is imparted to the resin, the resultant resin has excellent mechanical strength and sufficient photoconductive property. Therefore, such a resin may be used as it is as a charge transport layer of a laminate type photoreceptor. When the charge transport layer is provided, ordinary coating methods may be used such as a blade coating method, a Mayer bar coating method, a spray coating method, a dip coating method, a bead coating method, an air knife coating method, and a curtain coating method. However, when a sufficient film thickness cannot be obtained by one-time coating, a coating operation may be repeated plural times to obtain the necessary film thickness. When a coating operation is repeated plural times, a heat treatment may be applied for each coating operation, or may be applied after the plural coating operations.

In the case of a monolayer type photosensitive layer, the photosensitive layer contains the charge generating material and a binder resin. The binder resin may be a resin selected from the resins described above that are usable in the charge generation layer and the charge transport layer. The content of the charge generating material in the monolayer type photosensitive layer is in the range of 10 to 85% by weight, and preferably in the range of 20 to 50% by weight. In the monolayer type photosensitive layer, a charge transport material or a polymer charge transport material may be added to improve the photoconductive characteristics. The addition amount thereof may be in the range of 5 to 50% by weight. Furthermore, a compound represented by formula (I) may be added. The solvent and the coating method used for coating may be selected from those described above. The film thickness is preferably in the range of approximately 5 to 50 μm, and more preferably in the range of 10 to 40 μm.

-Intermediate Transfer Member-

The intermediate transfer member used in an aspect of the invention may be a drum-like known intermediate transfer member or an endless belt type known intermediate transfer member, specifically, for example, an intermediate transfer belt. This is because the width of contact between the intermediate transfer belt and the image carrier in the circumferential direction can be enlarged and easily controlled, as compared to the case of using an intermediate transfer drum, so that the polishing rate of the surface of the image carrier can be readily controlled in the range that is appropriate to prevent the occurrence of image deletion while not deteriorating the service life of the image carrier. From the viewpoint of achieving both the suppression of the image deletion and the long service life of the image carrier, the length of contact between the image carrier and the intermediate transfer belt in the direction of rotation may be in the range of 1 to 3 mm. Furthermore, the pressure at the contact portion should be in a usual pressure range for the primary transfer, and may be in the range of 20 to 40 N/m.

The intermediate transfer belt may be a known intermediate transfer belt, and examples thereof include a semiconducting endless belt made of a substrate alone, a semiconducting endless belt having an elastic layer provided at the outer surface side of a substrate, or a semiconducting endless belt having an elastic layer and a surface layer provided in this order on the outer surface of a substrate. In an aspect of the invention, an endless belt made of a polyimide resin having a thickness of 80 to 100 μm may be used. The hardness thereof may be in the range of 20 to 50° as measured with a commercially available micro-hardness meter.

-Toner-

The toner used in an aspect of the invention may be any known toner without particular restrictions. In an exemplary embodiment, a polishing agent or a lubricant or both are externally added as an external additive.

The shape factor SF1 of the toner may be less than 140. When the shape factor SF is 140 or more, in some cases, improvement of the image quality is hard to achieve because satisfactory transfer property cannot be obtained.

The shape factor SF1 is a value defined by formula (8) below.

$$SF1=(ML^2/A)\times(\pi/4)\times 100 \qquad \text{Formula (8)}$$

In formula (8), ML represents the maximum length (μm) of the toner, and A represents a projection area ($\mu m^2$) of the toner.

The shape factor SF1 can be measured with a LUZEX image analyzer FT (trade name, manufactured by Nireco Corp.) in the following manner.

First, optical microscope images of toner particles scattered on a slide glass are taken through a video camera into the LUZEX image analyzer, and the maximum length (ML) and the projection area (A) of each of 50 or more toner particles are measured. Then, for each of the toner particles, SF1 is calculated based on formula (8). The average value thereof is assumed as the shape factor SF.

The toner used in an aspect of the invention may have a volume average particle diameter of 2 to 8 μm from the viewpoint of obtaining high image quality.

The toner used in an aspect of the invention contains a binder resin and a colorant, and optionally further contains a release agent and other additives. The binder resin may be selected from those conventionally used in toner, and is not particularly restricted.

The binder resin may be a homopolymer, and examples thereof include homopolymers of: styrenes such as styrene, p-chlorostyrene and α-methylstyrene; acrylic monomers such as methyl acrylate, ethyl acrylate, n-propyl acrylate, lauryl acrylate, and 2-ethylhexyl acrylate; methacrylic monomers such as methyl methacrylate, ethyl methacrylate, n-propyl methacrylate, lauryl methacrylate, and 2-ethylhexyl methacrylate; ethylenic unsaturated acid monomers such as acrylic acid, methacrylic acid, and sodium styrenesulfonate; vinylnitriles such as acrylonitrile and methacrylonitrile; vinyl ethers such as vinyl methyl ether and vinyl isobutyl ether; vinyl ketones such as vinyl methyl ketone, vinyl ethyl ketone, and vinyl isopropenyl ketone; and olefins such as ethylene, propylene, and butadiene. As alternatives, the binder resin may be a copolymer of two or more of these monomers, or a mixture of two or more of such polymers.

Further examples of the binder resin include non-vinyl condensation resins such as epoxy resins, polyester resins, polyurethane resins, polyamide resins, cellulose resins, and polyether resins; mixtures of one or more non-vinyl resins and one or more vinyl resins; and graft polymers obtained by polymerizing one or more vinyl monomers in the presence of one ore more non-vinyl resins.

The coloring agent may be selected from conventionally known coloring agents without particular restriction. For example, the coloring agent may be a dye or pigment, or a mixture of two or more colorants selected from dyes and pigments. Examples of pigments include carbon black, Chrome Yellow, Hansa Yellow, Benzidine Yellow, Threne Yellow, Quinoline Yellow, Permanent orange GTR, Pyrazolone Orange, Vulcan Orange, Watchung Red, Permanent Red, Brilliant Carmine 3B, Brilliant Carmine 6B, Du-pont Oil Red, Pyrazolone Red, Lithol Red, Rhodamine B Lake, Lake Red C, Rose Bengal, Aniline Blue, Ultramarine Blue, Chalco Oil Blue, Methylene Blue Chloride, Phthalocyanine Blue, Phthalocyanine Green, and Malachite Green Oxalate. Examples of dyes include acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenyl methane dyes, and thioazole dyes.

Examples of release agents that may be optionally added to the toner used in an aspect of the invention include low molecular weight polyolefins such as polyethylene, polypropylene, and polybutene; silicones; fatty acid amides such as oleic acid amide, erucic acid amide, ricinoleic acid amide, and stearic acid amide; plant type waxes such as carnauba wax, rice wax, candelilla wax, haze wax, and jojoba oil; animal type waxes such as bees wax; mineral type or petroleum type waxes such as montan wax, ozocerite, ceresine, paraffin wax, microcrystalline wax, and Fischer-Tropsch wax; and denatured products thereof. It is possible to incorporate at least one of these waxes into toner particles.

In order to control various properties, various components other than the above-mentioned components may be added to the toner. For example, when the toner is used as a magnetic toner, the toner may contain magnetic powder (e.g. ferrite and magnetite), a metal such as reduced iron, cobalt, nickel or manganese, an alloy of one or more of such metals, or a compound containing one or more of such metals. Further, the toner may contain, as necessary, a charge control agent appropriately selected from those which are commonly used, such as quaternary ammonium salts, Nigrosine type compounds, and triphenylmethane type pigments.

To the toner, known external additives may be externally added such as a polishing agent, a lubricant and a transfer aid. When a polishing agent feed unit that directly supplies a polishing agent to the surface of the image carrier or to the outer surface of the intermediate transfer member is not disposed, the polishing agent should be externally added to the toner. It is more preferable for the toner to contain a lubricant together with the polishing agent.

As the polishing agent, well known polishing agents for the toner may be used. Examples thereof include cerium oxide, strontium titanate, magnesium oxide, alumina, silicon carbide, zinc oxide, silica, titanium oxide, boron nitride, calcium pyrophosphate, zirconia, barium titanate, calcium titanate and calcium carbonate. Furthermore, composite materials thereof are also usable. Among these, in an aspect of the invention, at least cerium oxide may be used. In an exemplary embodiment, two or more polishing agents may be used in combination, in accordance with the necessity.

The volume average particle diameter (hereinafter occasionally referred to as "particle diameter") of the polishing agent is not particularly restricted, and is preferably in the range of 100 nm to 3.0 μm and more preferably in the range of 200 nm to 2.0 μm. When the particle diameter is smaller than 100 nm, the image deletion tends to occur easily in some cases because the removing of the adhered matter such as a discharge product adhered onto the surface of the image carrier by polishing cannot proceed effectively. When the particle diameter is larger than 3.0 μm, the surface of the image carrier is likely to be damaged, and the service life of the image carrier is shortened in some cases.

The volume average primary particle diameter of external additives such as the polishing agent and the lubricant may be measured with a MULTISIZER (trade name, manufactured by Nikkaki Bios Co., Ltd.) with an aperture diameter set to 100 μm.

The amount of the polishing agent to be added relative to the total of the toner particles and all the additives externally added onto the surface thereof is preferably in the range of 0.1 to 2.0 mass %, and more preferably in the range of 0.3 to 1.0 mass %. When the addition amount is smaller than 0.1 mass %, the effect of removing the adhered matter by polishing is insufficient, and the removal of the discharge product adhered onto the image carrier is insufficient in some cases. When the addition amount is larger than 2.0 mass %, in some cases, a toner cloud tends to occur.

The lubricant externally added to the toner may be a lubricative particle.

Examples of the lubricative particle include fatty acid metal salts such as zinc stearate, solid lubricating agents such as graphite, molybdenum disulfide, talc, and fatty acid; low molecular weight polyolefins such as polypropylene, polyethylene, and polybutene; silicones having a softening point upon heating; aliphatic amides such as oleic amide, erucic amide, ricinoleic amide, and stearic amide; vegetable waxes such as carnauba wax, rice wax, candililla wax, haze wax, and jojoba oil; animal waxes such as bees wax; minerals such as montan wax, ozokerite, cerecin, paraffin wax, microcrystalline wax, and Fischer-Tropsch wax; petroleum waxes; and modified products thereof. Only one of these materials may be used, or two ore more of these materials may be used in combination. Among these, in an exemplary embodiment of the invention, zinc stearate is used.

The volume average primary particle diameter of the lubricative particle is preferably in the range of 0.1 to 10 μm, and more preferably in the range of 0.2 to 8 μm. The lubricative particle may be pulverized to make a particle size distribution smaller, and to thereby uniformize the particle diameters. The addition amount of the lubricative particle relative to the total of the toner particles and all the additives externally added to the surface thereof is preferably in the range of 0.05 to 2.0 mass %, and more preferably in the range of 0.1 to 1.5 mass %.

When a polishing agent feed unit that directly supplies the polishing agent to the surface of the image carrier and/or to the outer surface of the intermediate transfer member is disposed, a solid lubricant in which particles of the polishing agent are dispersed in a solidified lubricant may be used. The solidified lubricant may be, for example, one that is obtained by solidifying any of the above-described lubricants.

Specifically, an example of a usable polishing agent feed unit has a rotatable brush disposed to contact the photoreceptor and/or the surface of the intermediate transfer member and a solid lubricant that is disposed such that the tip of the brush digs into the solid lubricant to a constant depth. In this exemplary polishing agent feed unit, as the photoreceptor and the intermediate transfer member rotate, the polishing agent and the lubricant can be constantly supplied to the photoreceptor and/or to the surface of the intermediate transfer member.

The method for manufacturing the toner used in an aspect of the invention is not particularly restricted, and may be a toner manufacturing method involving an ordinary pulverization method, a wet melt conglobation method conducted in a dispersion medium, or a known polymerization method such as a suspension polymerization, a dispersion polymerization, or an emulsion polymerization coagulation method.

Furthermore, besides the foregoing polishing agents and lubricants, an appropriate amount of various external additives, such as inorganic fine particles of silica, titania, or the like having an average particle diameter of 10 to 300 nm, may be externally added to the toner used in an aspect of the invention.

-Carrier-

The carrier usable in a two-component developer is not particularly restricted, and may be a well-known carrier. For example, the carrier may be (1) a carrier (non-coat carrier) made only of a core material such as a magnetic metal (e.g., iron oxide, nickel, or cobalt), or a magnetic oxide (e.g., ferrite or magnetite), (2) a resin-coated carrier in which a resin layer is disposed on the surface of the core material, or (3) a resin dispersion type carrier having a structure in which a magnetic powder made of a magnetic material which may be selected from those described above is dispersed in a matrix resin.

The covering resin that is used in the resin-coated carrier may be any known resin that is used as a resin layer material for a carrier. A blend of two or more resins is also usable. Resins that constitute a resin layer can be roughly divided into charge imparting resins that impart charging property to toner and resins with a low surface energy that is used to inhibit the transfer of the toner component to the carrier.

Examples of the charge imparting resin that imparts negative charge to toner include amino resins such as a urea-formaldehyde resin, a melamine resin, a benzoguanamine resin, a urea resin, and a polyamide resin, epoxy resins, polyvinyl or polyvinylidene resins, acrylic resins, polymethyl methacrylate resins, polystyrene resins such as a styrene-acryl copolymer, polyacrylonitrile resins, polyvinyl acetate resins, polyvinyl alcohol resins, polyvinyl butyral resins, and cellulose resins such as an ethylcellulose resin.

Examples of the charge imparting resin that imparts positive charge to toner include a polystyrene resin, halogenated olefin resins such as polyvinyl chloride, polyester resins such as a polyethylene terephthalate resin and a polybutyrene terephthalate resin, and polycarbonate resins.

Examples of the low surface energy resin that is used to inhibit the transfer of the toner component to the carrier include a polyethylene resin, a polyvinyl fluoride resin, a polyvinylidene fluoride resin, a polytrifluoroethylene resin, a polyhexafluoropropylene resin, a copolymer of vinylidene fluoride and an acrylic monomer, a copolymer of vinylidene fluoride and vinyl fluoride, a fluoroterpolymer such as a terpolymer of tetrafluoroethylene, vinylidene fluoride, and a non-fluorine monomer, and a silicone resin.

Electroconductive particles may be added to the resin layer in order to control the resistance. Examples of the electroconductive particles include metal powder, carbon black, titanium oxide, tin oxide, and zinc oxide. The electroconductive powder may have an average particle diameter of 1 μm or less. As needs arise, plural electroconductive resins may be used in combination.

Furthermore, in order to control the charging, resin fine particles may be contained in the resin layer. The resin constituting the resin fine particles may be a thermoplastic resin, a thermosetting resin, or the like.

Specific examples of the thermoplastic resin include polyolefin resins such as polyethylene and polypropylene; polyvinyl resins and polyvinylidene resins such as polystyrene, an acrylic resin, polyacrylonitrile, polyvinyl acetate, polyvinyl alcohol, polyvinyl butyral, polyvinyl chloride, polyvinyl carbazole, polyvinyl ether, and polyvinyl ketone; vinyl chloride-vinyl acetate copolymers; styrene-acrylic acid copolymers; straight silicone resins containing organosiloxane bonds and modified products thereof; fluorinated resins such as polytetrafluoroethylene, polyvinyl fluoride, polyvinylidene fluoride, and polychlorotrifluoroethylene; polyesters; and polycarbonates.

Examples of the thermosetting resin include: phenol resins; amino resins such as a urea-formaldehyde resin, a melamine resin, a benzoguanamine resin, a urea resin, and a polyamide resin; and epoxy resins.

The core material of a non-coat carrier or a resin-coated carrier may be a magnetic metal such as iron, nickel, or cobalt, a magnetic oxide such as ferrite or magnetite, or glass beads. In order to use the carrier in a magnetic brush method, the core material may be a magnetic material.

The volume average particle diameter of the core material is generally in the range of 10 to 500 μm, and preferably in the range of 30 to 100 μm.

When a resin-coated carrier is prepared by forming a resin coating layer by coating the surface of a core material with a resin, a method may be used in which a coating layer forming solution containing the coating resin and, optionally, various additives dissolved in an appropriate solvent is used to coat the core material. The solvent is not particularly limited, and may be appropriately selected in consideration of the coating resin to be used and the coatability.

Examples of specific resin coating methods include a dip method of dipping the core material of the carrier in the coating layer forming solution, a spray method of spraying the coating layer forming solution onto the surface of the core material of the carrier, a fluidized bed method in which the coating layer forming solution is sprayed while the core material of the carrier is floated by an air flow, and a kneader coater method of blending the core material of the carrier and the coating layer forming solution in a kneader coater, followed by removing the solvent.

When the core material of the non-coat carrier or the resin-coated carrier is made of a polycrystalline material, the polycrystalline material may be made of crystal grains having an average grain diameter of 2.0 μm or less.

When the average particle diameter of the polycrystalline material that constitutes the core material is as small as the range described above, the core material tends to break into small pieces upon breakage of the carrier. As a result, sharp-edged fine powder is not generated easily. Therefore, even when carrier fragments are generated due to destruction of the carrier, there are not many sharp-edged components included in the fragments, and damage on the surface of the photoreceptor generated by rotational movement of the fragments at a portion of contact between the image carrier and the intermediate transfer member is suppressed, and the cleaning blade chipping caused by the fragments is also suppressed, as compared to the case where a conventional non-coat carrier or a resin-coated carrier is broken.

In addition, individual crystal grains constituting the polycrystalline material are small. Therefore, even when stress is applied to the carrier and the stress is concentrated on a part of the core material, the concentrated stress can be uniformly dispersed and absorbed over the entire core material. As a result, the carrier does not break easily, and the amount of fragments generated by the destruction of the carrier can be suppressed.

When the average grain diameter of the crystal grains contained in the polycrystalline material exceeds 2.0 μm, the core material tends to break into coarse pieces upon breakage of the carrier. As a result, sharp-edged fragments are easily generated. Moreover, when stress is applied to the carrier, the stress is concentrated on a part of the core material since individual crystal grains that constitute the polycrystalline material are large. Therefore, the stress cannot be uniformly dispersed, and the carrier is easily broken.

From such a viewpoint, the average grain diameter of crystal grains contained in the polycrystalline material may be 1.5 μm or less. However, when the average grain diameter is too small, the crystallinity of the polycrystalline material is lowered to lower the mechanical strength of the core material itself. as a result, the carrier becomes easily breakable in some cases. Accordingly, the average grain diameter of the polycrystalline material may be 1.0 μm or more.

The grain size distribution of the crystal grains contained in the polycrystalline material may satisfy formula (9) below.

$$D85/D50<1.5 \qquad \text{Formula (9)}$$

In formula (9), D50 represents the grain diameter at which the proportion of the cumulative number of grains from the small diameter side to the total number of grains in the grain size distribution of the grains reaches 50%, and D85 represents the grain diameter at which the proportion of the cumulative number of grains from the small diameter side to the total number of grains in the grain size distribution of the grains reaches 85%.

When the grain size distribution is broad, there are coarse grains among individual grains even when the average grain diameter is small. Therefore, there are cases where the core material is likely to break into coarse splinters upon breakage of the carrier, whereby sharp-edged splinters is easily generated. Furthermore, when coarse crystal grains are present, not only the effect of dispersing the external stress becomes smaller, but also relatively large voids remain inside of the core material to deteriorate the strength of the core material itself in some cases.

From such viewpoints, the ratio, D85/D50, may be 1.3 or less, and is preferably closer to the mono-dispersion.

The average grain diameter and the grain size distribution of the crystal grains that constitute the polycrystalline material that is used in the core material can be readily controlled by adjusting the sintering temperature in accordance with the material to be used. For example, if the composition is the same, a lower sintering temperature generally reduces the average grain diameter and narrows the grain size distribution.

The average grain diameter and the grain size distribution of the polycrystalline material contained in the core material are measured as described below.

A focused ion beam processing inspection system FB-2100 (trade name, manufactured by HITACHI LTD.,) is used to deposit platinum on a sample, and then grinding is conducted under an applied voltage of 40 kV and an applied current of 150 nA while controlling the grinding energy by adjusting the current value to form a section of the core material, and the section is observed.

The image of a cross section of the core material is taken under an accelerating voltage of 5 kV and a magnification of 5000 times. Then, the major axes of individual grains in the obtained image are measured with a scale, followed by conversion into the actual lengths. The measurement and image processing are carried out on sections of fifteen cores.

The average grain diameter is the grain diameter (D50), which is such a diameter that the number of crystal grains having a diameter that is not larger than D50 is 50% of the total number of crystal grains. D50 is obtained based on the measurement of the length of the major axis of each grain as described above. Furthermore, D85 is such a grain diameter that the number of crystal grains having a diameter that is not larger than D85 is 85% of the total number of crystal grains. The ratio, D85/D50, is the ratio of D85 to D50.

The observed section of the core of each grain is not necessarily a section of a center portion. Accordingly, the grain size distribution (hereinafter, referred to as "raw grain size distribution") obtained through a binarization process of sectional images include results of measurement of sections of end portions of the crystal grains, in addition to the results of measurement of sections of center portions of the crystal grains.

For the calculation of D50 and D85, using the raw grain size distribution, such a grain diameter x is determined that the number of grains having a grain diameter that is not larger than the diameter x is 50% of the total number of the crystal grains. A grain size distribution obtained by removing the grain diameter data that are not larger than the grain diameter x from the raw grain size distribution, is used for the calculation of D50 to D85 so that the results of measurement of the sections of end portion of grains included in the raw grain size distribution are approximately removed.

The resin dispersion type carrier may be a known resin dispersion type carrier having a configuration that includes a resin matrix and a magnetic particles dispersed in the resin matrix. However, the resin dispersion type carrier may have a configuration in which a core particle that contains a resin matrix and a magnetic particles dispersed in the resin matrix is coated with a resin. The resin composition used for coating the core particle may be selected from those usable for resin-coated carriers.

In the resin dispersion type carrier, a magnetic component having sufficient hardness to damage the surface of the photoreceptor is dispersed as relatively small sized magnetic powder in the carrier. Accordingly, even when fragments made of the magnetic powder are generated due to destruction of the resin dispersion type carrier, the fragments are smaller than the magnetic material fragments generated upon breakage of a conventional resin-coated carrier or non-coat carrier, and damage on the surface of the photoreceptor generated by rotational movement of the fragments at a portion of contact between the image carrier and the intermediate transfer member is suppressed, and the cleaning blade chipping caused by the fragments is also suppressed.

The material that constitutes the magnetic powder dispersed in the resin matrix may be selected from the above-mentioned materials for core materials used in non-coat carriers and resin-coated carriers.

The size of the magnetic powder depends on the particle diameter of the carrier, and the number average particle diameter may be in the range of 0.02 to 5 μm. In the resin matrix, two or more kinds of magnetic powders may be dispersed. The number average particle diameter of the magnetic particles can be obtained as shown below. That is, three hundred or more particles having a particle diameter of 0.01 μm or more are extracted at random from a photograph image magnified 5000 to 20000 times taken by a transmission electron microscope, and Feret's diameters thereof in a horizontal direction are measured with an image processor (LUZEX III: trade name, manufactured by Nireco Corp.) as a particle diameter of the metal oxide, and then the measured diameters are subjected to an averaging process to calculate a number average particle diameter.

Examples of the matrix resin in which the magnetic powder is dispersed include: vinyl resins; non-vinyl condensed resins such as polyester resins, epoxy resins, phenol resins, urea resins, polyurethane resins, polyimide resins, cellulose resins, and polyether resins; and mixtures of one or more non-vinyl condensed resins and one or more vinyl resins.

Examples of a vinyl monomer that forms a vinyl resin include: styrene; styrene derivatives such as o-methyl styrene, m-methyl styrene, p-methyl styrene, p-phenyl styrene, p-ethyl styrene, 2,4-dimethyl styrene, p-n-butyl styrene and p-tert-butyl styrene; ethylene and unsaturated monoolefins such as ethylene, propylene, butylene and isobutylene; unsaturated diolefins butadiene and isoprene; halogenated vinyls such as vinyl chloride, vinylidene chloride, vinyl bromide, and vinyl fluoride; vinyl esters such as vinyl acetate and vinyl propionate; methacrylic acid; α-methylene aliphatic monocarboxylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate and phenyl methacrylate; acrylic acid; acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; maleic acid and maleic acid half ester; vinyl ethers such as vinyl methyl ether, vinyl ethyl ether and vinyl isobutyl ether; vinyl ketones such as vinyl methyl ketone, vinyl hexyl ketone and methylisopropenyl ketone; N-vinyl compounds such as N-vinyl pyrrole, N-vinyl carbazole, N-vinyl indole and N-vinyl pyrrolidone; vinyl naphthalenes; acrylic acid derivatives and methacrylic acid derivatives such as acrylonitrile, methacrylonitrile and acryl amide; and acroleins. In an exemplary embodiment, a vinyl resin obtained by polymerizing one of the above monomers is used. In another exemplary embodiment, a vinyl resin obtained by polymerizing two or more of the above monomers is used.

The method for producing a core particle that includes a matrix resin and a magnetic powder dispersed in the matrix resin may include thoroughly blending a vinyl or non-vinyl thermoplastic resin, a magnetic metal oxide, and other additives such as a curing agent with a mixer, melting and kneading the mixture with a kneading machine such as a heating roll, a kneader, or an extruder, cooling the mixture, and pulverizing the mixture and classifying the resultant particles to form core particles. The obtained core particle may be conglobated thermally or mechanically.

There are other methods for producing a core particle besides the above-mentioned method of melting and kneading a resin and a magnetic metal oxide followed by pulverizing to obtain a core particle. For example, there is a method including mixing a monomer and a metal oxide and polymerizing the monomer to obtain a core particle. Examples of the monomer used for polymerization include, besides the foregoing vinyl monomers, a combination of a bisphenol and epichlorohydrin for forming an epoxy resin, a combination of a phenol and an aldehyde for forming a phenol resin, and a combination of urea and an aldehyde for forming a urea resin, and a combination of melamine and an aldehyde. In an exemplary method for producing a carrier core using a curable phenol resin, a metal oxide and a dispersion stabilizer are added to a combination of a phenol and an aldehyde in an aqueous medium in the presence of a basic catalyst to conduct suspension polymerization, whereby a core particle is obtained.

In an exemplary method for producing a core particle, a binder resin is crosslinked in order to improve the mechanical strength of the core particle and in order to more excellently coat the resin for coating. For example, there are: a method including adding a crosslinking component during melt-kneading to conduct crosslinking at the time of kneading; a method comprising polymerizing a monomer for forming a curable resin in the presence of a metal oxide to obtain a core; and a method comprising polymerizing a monomer composition containing a crosslinking agent in the presence of a metal oxide.

Examples of the method for coating core particles with a resin include: a method including spraying a coating resin solution is sprayed onto core particles while the core particles are floated and flown, to form a coating film on the surface of the core particles; and a spray dry method. In an alternative coating method, the solvent is gradually vaporized under shearing stress to coat the core particles with the resin. As specific examples of such methods, there are a method including vaporizing the solvent at a temperature that is equal to or higher than the glass transition temperature of the coating resin and separating aggregated carrier particles, and a method including curing the coating film and separating the particles under application of the shearing force.

The content of magnetic powder contained in the resin dispersion type carrier may be from 50 to 99% by weight. When the amount of the metal oxide is less than 50% by weight, the charging property tends to be instable in some cases. On the other hand, when it exceeds 99% by weight, the strength of the carrier particle is deteriorated and the carrier particles tend to be readily broken thereby in some cases.

In a two-component developer that uses the above-described carrier, the mixing ratio (weight ratio) of the toner to the carrier is approximately in the range of 1:100 to 30:100 and more preferably in the range of 3:100 to 20:100.

-Specific Examples of Cleaning Blade, Image Forming Apparatus and Cleaning Apparatus- In the next place, specific examples of a cleaning blade used in an aspect of the invention, and specific examples of an image forming apparatus and a cleaning apparatus using the same will be detailed with reference to the drawings.

FIG. 1 is a schematic view showing an example of an image forming apparatus of an aspect of the invention. The image forming apparatus shown in FIG. 1 is a so-called tandem type image forming apparatus.

In FIG. 1, 21 represents a main body housing; 22 and 22*a* to 22*d* represent image forming engines; 23 represents a belt module; 24 represents a recording material supply cassette; 25 represents a recording material transport path; 30 represents each photoreceptor unit (image carrier); 31 represents a photoreceptor drum; 33 represents each developing unit; 34 represents a cleaning apparatus; 35 and 35*a* to 35*d* represent toner cartridges; 40 represents an exposure unit; 41 represents a unit case; 42 represents a polygonal mirror; 51 represents a primary transfer apparatus; 52 represents a secondary transfer apparatus; 53 represents a belt cleaning apparatus; 61 represents a feed roll; 62 represents a take-away-roll; 63 represents a resist roll; 66 represents a fixing apparatus; 67 represents a discharge roll: 68 represents a discharge tray; 71 represents manual feeding apparatus; 72 represents a feed roll; 73 represents a double-side recording unit; 74 represents a guide roll; 76 represents a transport path; 77 represents a transport roll; 230 represents an intermediate transfer belt; 231 and 232 represent stretching rolls; 521 represents a secondary transfer roll; and 531 represents a cleaning blade.

The tandem type image forming apparatus shown in FIG. 1 includes: the four color (Black, Yellow, Magenta, and Cyane in this exemplary embodiment) image forming engines 22 (concretely 22*a* to 22*d*) arranged transversely in the main body housing 21; the belt module 23 disposed above the image forming engines, the belt module 23 comprising the intermediate transfer belt 230 circularly transported along the arrangement direction of the respective image forming engines 22; the recording material supply cassette 24 disposed in a lower part of the main body housing 21, the recording material supply cassette 24 housing recording material (not illustrated) such as paper; and the recording material transport path 25 arranged vertically, which is the transport path of the recording material supplied from the recording material supply cassette 24.

In this exemplary embodiment, the respective image forming engines 22 (22*a* to 22*d*) form toner images, and successively disposed from the upstream side in the circulation direction of the intermediate transfer belt 230 (for example, in the order of black, yellow, magenta, and cyan, but the order is not necessarily in this order). Each image forming engine comprises the photoreceptor unit 30, the developing unit 33, and the exposure unit 40 which is common to all image forming engines.

The photoreceptor unit 30 is an integrated subcartridge including, for example, the photoreceptor drum 31, a charging apparatus (in FIGS. 1 and 2, the charging roll 32, which will be described later) for previously charging the photoreceptor drum 31, and a cleaning apparatus 34 for removing residual toner on the photoreceptor drum 31.

Each developing unit 33 develops an electrostatic latent image formed by exposing the charged photoreceptor drum 31 with the exposure unit 40, the developing being conducted by using the corresponding color toner (which may, for example, have negative polarity in this exemplary embodiment). Each developing unit 33 is united with a sub cartridge comprising, for example, a photoreceptor unit 30, so that a process cartridge (so-called CRU: Customer Replaceable Unit) is formed.

Each photoreceptor unit 30 may be, of course, separated form the developing unit 33, so as to form an independent CRU. In FIG. 1, the toner cartridges 35 (toner cartridges 35*a* to 35*d*) supply respective color component toners to the respective developing units 33 (toner supplying paths are not illustrated).

The unit case 41 of the exposure unit 40 houses, for example, four semiconductor lasers (not illustrated), one polygonal mirror 42, an imaging lens (not illustrated), and mirrors (not illustrated) respectively corresponding to the respective photoreceptor units 30. The exposure unit 40 is configured to deflect the light from the semiconductor laser for each color component in a scanning manner using the polygonal mirror 42, and is configured to lead an optical image onto the corresponding exposure point on the photoreceptor drum 31 via the imaging lens and the mirror.

In this exemplary embodiment, the belt module 23 includes a pair of stretching rolls 231 and 232 (one of which is a driving roll) and the intermediate transfer belt 230 stretched therebetween. The primary transfer apparatus (in this example, a primary transfer roll) 51 is installed on the back surface of the intermediate transfer belt 230 corresponding to the photoreceptor drum 31 of each photoreceptor unit 30. A toner image on the photoreceptor drum 31 is electrostatically transferred to the intermediate transfer belt 230 side by applying, to the primary transfer apparatus 51, a voltage with the opposite polarity to the charge polarity of the toner. The secondary transfer apparatus 52 is installed at a position of the intermediate transfer belt 230 corresponding to the stretching roll 232 in the downstream side of the most-downstream image forming engine 22*d*. The secondary transfer apparatus 52 conducts secondary transfer (collective transfer) in which the primary transfer images on the intermediate transfer belt 230 are collectively transferred to the recording material.

In this exemplary embodiment, the secondary transfer apparatus 52 comprises a secondary transfer roll 521 disposed to push the toner image bearing face of the intermediate transfer belt 230 and a back up roll (serving also as the stretching roll 232 in this example) disposed on the back face side of the intermediate transfer belt 230, the back up roll working as a counter electrode of the secondary transfer roll 521. The secondary transfer roll 521 is earthed, and a bias of the same polarity as the charge polarity of the toner is applied to the back up roll (the stretching roll 232).

Further, a belt cleaning apparatus 53 is disposed at the intermediate transfer belt 230 at the upstream of the most-upstream image forming engine 22*a*, and removes the residual toner on the intermediate transfer belt 230.

In the recording material supply cassette 24, a feed roll 61 that picks up a recording material is installed, the take-away roll 62 that sends the recording material is installed immediately after the feed roll 61, the registration roll (resist roll) 63 that supplies the recording material to the secondary transfer position at a predetermined timing is installed immediately before the secondary transfer position on the recording material transfer path 25. On the other hand, the fixing apparatus 66 is installed at the downstream side of the secondary transfer position on the recording material transfer path 25, a discharge roll 67 that discharges the recording material is installed in the downstream side of the fixing apparatus 66, and the discharged recording material is housed in the discharge tray 68 formed above the main body housing 21.

In this exemplary embodiment, the manual feeding apparatus (MSI) 71 is installed at a side of the main body housing 21, and a recording material on the manual feeding apparatus 71 is sent toward the recording material transport path 25 by the feed roll 72 and the take-away roll 62.

Further, the double-side recording unit 73 is attached to the main body housing 21. When the double side mode of recording images on both sides of the recording material is selected, the recording material after recording on one surface is delivered to inside of the double-side recording unit 73 by reversely rotating the discharge roll 67 and using the guide roll 74 positioned in front of the entrance to the unit 73, transports the recording material along the recording material return transport path 76 inside the unit 73 using an adequate number of transport rolls 77, and supplies the recording material to the registration roll 63 again.

In the present exemplary embodiment, the rotation velocity of a driving source (not shown) that rotates the intermediate transfer belt 230 via the stretching roll 231 or 232 and the rotation velocity of another driving source (not shown) that rotates the photoreceptor drum 31 are adjusted such that a predetermined difference between the circumferential velocity of the intermediate transfer belt 230 and the circumferential velocity of the photoreceptor drum 31 is realized. The toner may be a toner to which at least a polishing agent is added as an external additive.

Next, the cleaning apparatus 34 installed in the inside of the tandem type image forming apparatus shown in FIG. 1 will be described in detail.

Figure 2:
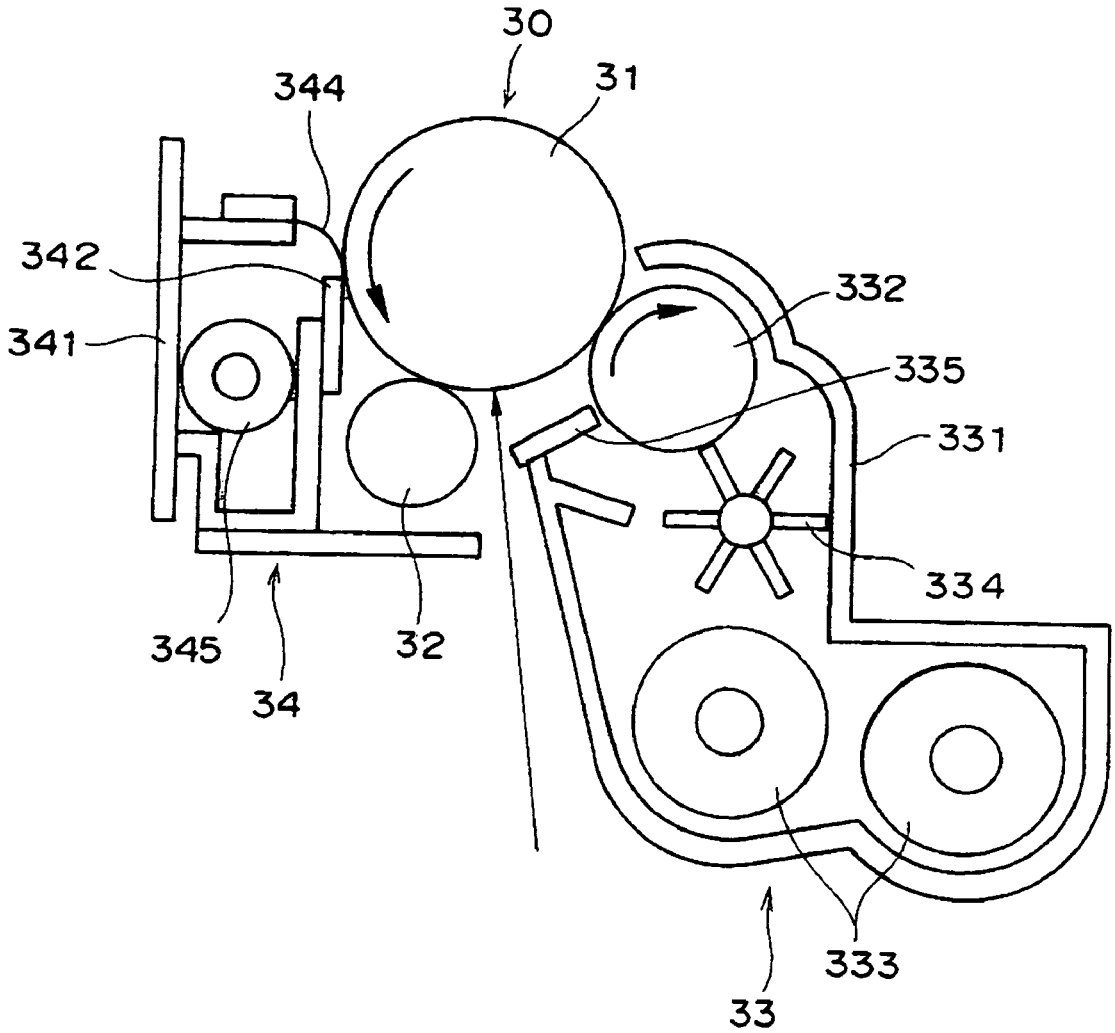
FIG. 2 is a rough schematic diagram showing an example of a cleaning apparatus according to an aspect of the invention.

FIG. 2 is a schematic drawing showing one example of the cleaning apparatus used in an aspect of the invention, and showing the photoreceptor drum 31 and the charging roll 32 that form a subcartridge, and the developing unit 33, simultaneously with the cleaning apparatus 34 shown in FIG. 1.

In FIG. 2, 30 represents a photoreceptor unit, 32 represents a charging roll (a charging apparatus), 331 represents a unit case, 332 represents a development roll, 333 represents a transport auger, 334 represents a transport paddle, 335 represents a trimming member, 341 represents a cleaning case, 342 represents a cleaning blade, 344 represents a film seal, and 345 represents a transport auger.

The cleaning apparatus 34 comprises the cleaning case 341 that house residual toner and has an opening facing the photoreceptor drum 31. The cleaning blade 342 is attached to the lower rim of the opening of the cleaning case 341 via a bracket (not shown), and is in contact with the photoreceptor drum 31. The film seal 344 is attached to the upper rim of the opening of the cleaning case 341, and serves as an airtight sheet between the photoreceptor drum 31 and the interior of the cleaning case 341. The reference character 345 represents the transport auger that leads the used toner housed in the cleaning case 341 to a waste toner container. A material satisfying formulae (1) to (3) is used as at least the edge tip material of the cleaning blade 342.

Next, the cleaning blade installed in the cleaning apparatus 34 will be described in detail with reference to a drawing.

Figure 3:
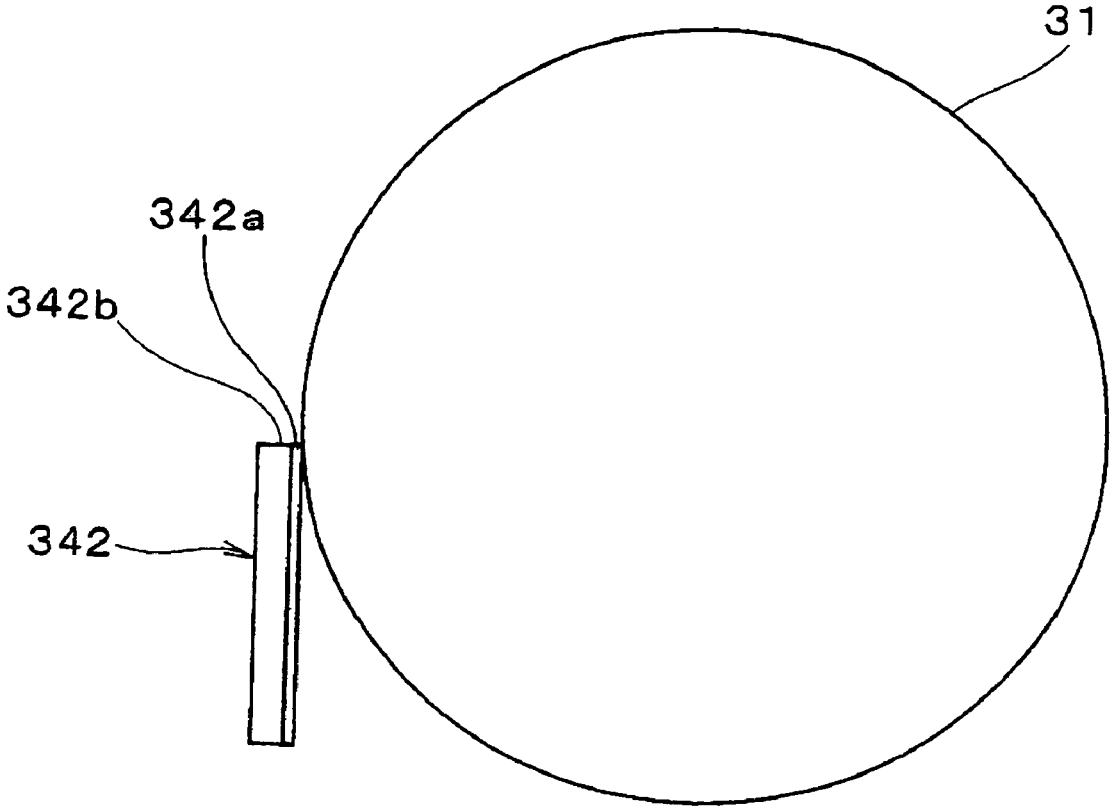
FIG. 3 is a schematic sectional view showing an example of a cleaning blade according to an aspect of the invention.

FIG. 3 is a schematic cross-sectional view showing one example of the cleaning blade of an aspect of the invention, in which the cleaning blade 342 shown in FIG. 2 is illustrated together with the photoreceptor drum 31 that contacts the cleaning blade. In FIG. 3, 342*a* represents a layer at the cleaning edge side, and 342*b* represents a layer at the rear face side. The cleaning blade 342 shown in FIG. 3 is composed of two layers, one of which is the layer 342*a* at the cleaning edge side, and the other of which is the layer 342*b* at the rear face side (i.e., at the opposite side to the side at which the photoreceptor drum 31 is provided). The cleaning blade 342 is made of an elastic material made of polyurethane rubber.

The polyurethane material constituting the layer 342*b* at the rear face side may be an ester type polyurethane or an ether type polyurethane. An ester type polyurethane is preferred.

When producing an ester type polyurethane rubber, a polyester polyol and a polyisocyanate may be used.

Examples of the polyisocyanate include 2,6-toluene diisocyanate (TDI), 4,4'-diphenylmethane diisocyanate (MDI), p-phenylene diisocyanate (PPDI), 1,5-naphthalene diisocyanate (NDI), and 3,3-dimethyldiphenyl-4,4'-diisocyanate (TODI). MDI is preferable in terms of properties and cost.

When producing a urethane rubber using the polyester polyol, the polyester polyol and a short chain polyol as a chain extension agent are mixed and reacted with a polyisocyanate. The reaction may be carried out by a conventional production method of polyurethane, such as a prepolymer method, a one-shot method, or the like.

The layer 342*a* at the cleaning edge side may be produced using a soft segment material satisfying the above-mentioned conditions defined by (1) to (4), such as acrylic resins having two or more hydroxyl groups, polybutadiene resins having two or more hydroxyl groups, or epoxy resins having two or more epoxy groups, in addition to the material used for forming the layer 342*b* at the rear face side.

The thickness of the layer 342*a* at the cleaning edge side is set to 0.5 mm, and the thickness of the layer 342*b* at the rear face side is set to 1.5 mm. The cleaning blade 342 may be produced by previously producing the layer 342*a* at the cleaning edge side and the layer 342*b* at the rear face side respectively in sheet-like forms, and adhering the materials for the respective layers to each other with an abrasive, a double-sided tape or the like. Further, when production is conducted by centrifugal molding, at the time of injecting the raw materials of the respective layers, the materials may be successively injected at intervals to form the cleaning blade.

In this exemplary embodiment, the cleaning blade of an aspect of the invention (as the cleaning blade 342) is used in all of the cleaning apparatuses 34 of the respective image forming engines 22 (22*a* to 22*d*). In addition, the cleaning blade 531 used in the belt cleaning apparatus 53 may be the cleaning blade of an aspect of the invention.

The developing unit (the developing apparatus) 33 used in this exemplary embodiment, as shown in FIG. 2, comprises the unit case 331 that stores the developer and has an opening facing the photoreceptor drum 31. The development roll 332 is installed at the position of the unit case 331 to face the opening, and the transport auger 333 that stirs and transports the developer is installed in the unit case 331. Further, the transport paddle 334 may be installed between the development roll 332 and the transport auger 333, in accordance with the necessity.

At development, the developer is transported to the development region facing the photoreceptor drum 31 while the layer thickness of the developer is controlled by the trimming member 335, after the developer is supplied to the development roll 332.

In this exemplary embodiment, the developing unit 33 uses a two-component developer comprising a toner and a carrier. However, a developing unit using a one-component developer comprising only a toner may also be used.

Next, the operation of the image forming apparatus of this exemplary embodiment will be descried. First, monotonous toner images corresponding to the respective colors are formed by the respective image forming engines 22 (22*a* to 22*d*), the monotonous toner images in the respective colors are successively overlaid on the surface of the intermediate transfer belt 230 in conformity with the original manuscript information (primary transfer). Thereafter, the color toner image which has been transferred onto the surface of the intermediate transfer belt 230 is then transferred onto the surface of a recording material by the secondary transfer apparatus 52. The recording material on which the color toner image is transferred is subjected to a fixing treatment by the fixing apparatus 66, and then is discharged to the discharge tray 68.

On the other hand, in the respective image forming engines 22 (22*a* to 22*d*), the residual toner on the photoreceptor drum 31 is cleaned off by the cleaning apparatuses 34 and the residual toner on the intermediate transfer belt 230 is cleaned off by the belt cleaning apparatus 53.

In such an image forming process, the residual toner is cleaned off by the cleaning apparatuses 34 (or the belt cleaning apparatus 53).

The fixing of the cleaning blade 342 to the frame member inside the cleaning apparatus 34 may be direct fixing as shown in FIG. 2, or may be fixing via a spring member.

Figure 4:
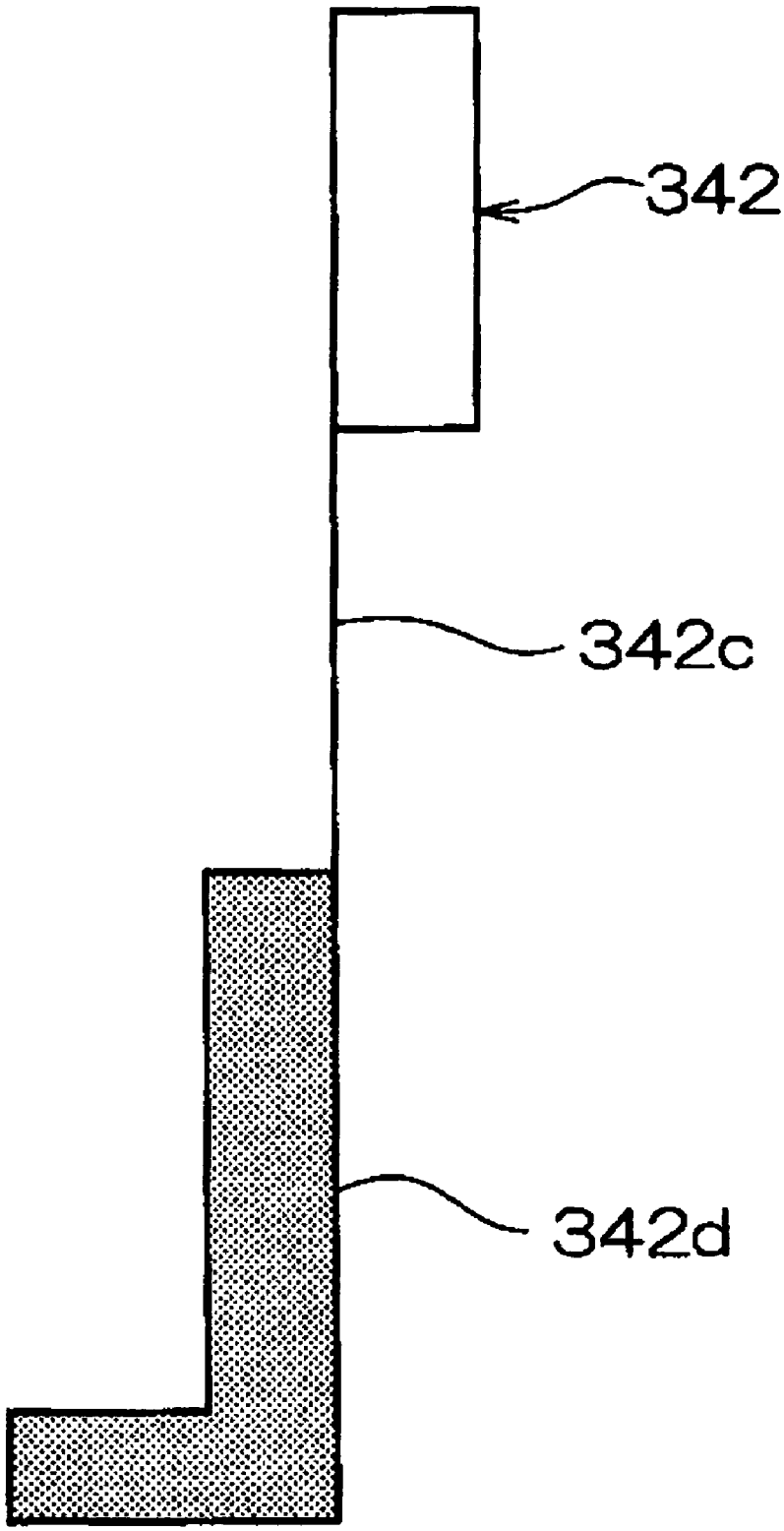
FIG. 4 is a rough schematic diagram showing an example of a method of fixing a cleaning blade according to an aspect of the invention.

FIG. 4 is a schematic diagram showing an example of a method for fixing the cleaning blade used in an aspect of the invention. In FIG. 4, 342 represents a cleaning blade, 342*c* represents a spring member, and 342*d* represents a holder. As shown in FIG. 4, one surface (the surface not contacting the photoreceptor) of the cleaning blade 342 is connected and fixed to the plate-shaped spring member 342*c*, and a portion of the spring member 342*c* at the other side to the side to which the cleaning blade is fixed is attached to the holder 342*d*. The spring member 342*c* may include a metal member having resistance to deformation and a Young's modulus with low dependence on temperature, such as SUS.

When the cleaning blade is fixed to the frame member of the cleaning apparatus via a spring member and a holder as shown in FIG. 4, the spring member works for applying pressure to the cleaning blade. Therefore, the fatigue of the cleaning blade is suppressed, and the environmental dependence of the contact pressure is reduced, compared to the case where the cleaning blade is fixed to the frame member of the cleaning apparatus. Therefore, the contact pressure of the cleaning blade against the photoreceptor is maintained stable for a long period of time, and excellent cleaning performance can be maintained.

EXAMPLES

Hereinafter, the invention will be described by reference to Examples. However, the Examples should not be construed as limiting the invention. In the following description, the term "part" refers to "part by mass".

-Production of Cleaning Blade-

<Cleaning Blade A1>

At first, a hard segment material composed of polycaprolactone polyol (PLACCEL 205, with an average molecular weight of 529 and a hydroxyl value of 212 mgKOH/g, manufactured by Daicel Chemical Industries, Ltd.) and polycaprolactone polyol (PLACCEL 240, with an average molecular weight of 4,155 and a hydroxyl value of 27 mgKOH/g, manufactured by Daicel Chemical Industries, Ltd.), which are polyol components, and a soft segment material made of an acrylic resin containing two or more hydroxyl group (ACTFLOW UMB-2005B, manufactured by Soken Chemical Engineering Co., Ltd.) are mixed in the ratio of 8:2 (by mass).

Next, 6.26 parts by mass of 4,4'-diphenylmethane diisocyanate (MILLIONATE MT, hereinafter referred to as MDI, manufactured by Nippon Polyurethane Industry Co., Ltd.), which is an isocyanate compound, is added to 100 parts by mass of the mixture of the hard segment material and the soft segment material, and the reaction is allowed to proceed at 70° C. for 3 hours in nitrogen atmosphere.

The amount of the isocyanate compound used in this reaction is selected to adjust the ratio (isocyanate group/hydroxyl group) of the isocyanate groups to the hydroxyl groups contained in the reaction system to 0.5.

Then, 34.3 parts by mass of the above-mentioned isocyanate compound is further added, and the reaction is carried out at 70° C. for another 3 hours in nitrogen atmosphere to obtain a prepolymer.

The total amount of the isocyanate compound used for the preparation of the prepolymer is 40.56 parts by mass.

Next, the prepolymer is heated to 100° C. and defoamed for 1 hour in reduced pressure. Then, 7.14 part by mass of a mixture of 1,4-butanediol and trimethylolpropane (in a weight ratio of 60/40) is added to 100 part by mass of the prepolymer, and the resultant mixture is sufficiently stirred for 3 minutes while preventing entry of foams, and is cured for one hour in a centrifugal molding apparatus whose die is set to 140° C., so that a flat plate is obtained. The flat plate is cooled after crosslinking at 110° C. for 24 hours, and is cut into a predetermined size to obtain a cleaning blade A1 with a thickness of 2 mm.

<Cleaning Blade A2>

The same hard segment material as that used in the production of the cleaning blade A1 and a polybutadiene resin (R-45HT, manufactured by Idemitsu Kosan Co., Ltd.) having two or more hydroxyl groups as a soft segment material are mixed in a ratio of 8:2 (the hard segment materials:the soft segment material=8:2), so that a mixture is obtained.

A cleaning blade A2 is produced in the same manner as Example 1, except that the mixture is used.

<Cleaning Blade A3>

The same hard segment material as that used in the production of the cleaning blade A1 and an epoxy resin (EPICLON EXA-4850-150, manufactured by Dainippon Ink and Chemicals, Inc.) having two or more epoxy groups as a soft segment material are mixed in a ratio of 8:2 (the hard segment materials:the soft segment material=8:2).

A cleaning blade A3 is produced in the same manner as Example 1, except that the mixture is used.

<Cleaning Blade B1>

A cleaning blade B1 is produced in the same manner as Example 1, except that only a polyol component is used in place of the mixture of the hard segment material and the soft segment material, and that 6.8 part by mass of NIPPOLLAN 4038 (manufactured by Nippon Polyurethane Industry Co., Ltd.) as an isocyanate compound is used in combination with 100 parts by mass of CORONATE 4086 (manufactured by Nippon Polyurethane Industry Co., Ltd.) as the polyol component.

<Cleaning Blade B2>

A cleaning blade B2 is produced in the same manner as Example 1, except that only a polyol component is used in place of the mixture of the hard segment material and the soft segment material, and that 75 part by mass of NIPPOLLAN 4379 (manufactured by Nippon Polyurethane Industry Co., Ltd.) as an isocyanate compound is used in combination with 100 parts by mass of CORONATE 4370 (manufactured by Nippon Polyurethane Industry Co., Ltd.) as the polyol component.

<Cleaning Blade B3>

A cleaning blade B3 is produced in the same manner as Example 1, except that only a polyol component is used in place of the mixture of the hard segment material and the soft segment material, and that 85 part by mass of NIPPOLLAN 4379 (manufactured by Nippon Polyurethane Industry Co., Ltd.) as an isocyanate compound is used in combination with 100 parts by mass of CORONATE 4370 (manufactured by Nippon Polyurethane Industry Co., Ltd.) as the polyol component.

Characteristic values of the cleaning blades described above are shown in Table 9 below.

TABLE 9

| | Cleaning Blade | A1 | A2 | A3 | B1 | B2 | B3 |
|---|---|---|---|---|---|---|---|
| Composition | Hard segment material (H) | Polycaprolactam polyol | | | Polyol component (COLONATE 4086) | Polyol component (COLONATE 4370) | Polyol component (COLONATE 4370) |
| | Soft segment material (S) | Acryl resin | Polybutadiene resin | Epoxy resin | | | |
| | Hard segment material ratio [H/(S + H)] (% by mass) | 80 | 80 | 80 | — | — | — |
| Characteristic value | 100% Modulus (MPa) | 10.8 | 7.4 | 11.3 | 3.4 | 11.8 | 33.3 |
| | α [Δstress/Δstrain] (MPa/%) | 0.059 | 0.039 | 0.059 | 0.044 | 0.324 | |
| | Breaking elongation (%) | 420 | 535 | 380 | 300 | 200 | 150 |

-Preparation of Photoreceptor-

<Preparation of Photoreceptor A>

(Preparation of Undercoat Layer)

100 parts by mass of zinc oxide (having an average particle diameter of 70 nm and a specific surface area of 15 $m^2/g$, manufactured by TAYCA Corp.) and 500 parts by mass of tetrahydrofuran are blended under stirring. 1.3 parts by mass of a silane coupling agent (trade name: KBM503, manufactured by Shin-Etsu Chemical Co., Ltd.) is added thereto, and the mixture is stirred for 2 hrs. Thereafter, toluene is distilled away by vacuum distillation, followed by baking at 130° C. for 3 hr. As a result, a zinc oxide pigment whose surface has been treated with a silane coupling agent is obtained.

In the next place, 110 parts by mass of the surface-treated zinc oxide and 500 parts by mass of tetrahydrofuran are blended under stirring, and a solution obtained by dissolving 0.5 parts by mass of alizarine in 50 parts by mass of tetrahydrofuran is added thereto. The mixture is stirred at 50° C. for 5 hrs. Thereafter, zinc oxide modified with alizarine is filtrated by filtration under reduced pressure, and is dried under reduced pressure at 60° C., so that zinc oxide pigment modified with alizarine is obtained.

Thereafter, 25 parts by mass of methyl ethyl ketone are blended with 38 parts by mass of a solution containing 60 parts by mass of the zinc oxide pigment modified with alizarine, 13.5 parts by mass of a curing agent (blocked isocyanate, trade name: SUMIDUR 3175, manufactured by Sumitomo Bayer Urethane Co.,), and 15 parts by mass of a butyral resin (trade name: BM-1, manufactured by Sekisui Chemical Co., Ltd.) dissolved in 85 parts by mass of methyl ethyl ketone. The resultant mixture is dispersed in a sand mill for 2 hrs using 1 mm ϕ glass beads, so that a dispersion liquid is obtained.

To the obtained dispersion liquid, 0.005 parts by mass of dioctyl tin dilaurate as a catalyst and 40 parts by mass of a silicone resin particle (trade name: TOSPAL 145, manufactured by GE-Toshiba Silicones Co., Ltd.) are added to form an undercoat layer coating liquid. The coating liquid is coated on an aluminum substrate having a diameter of 30 mm, a length of 340 mm and a thickness of 1 mm by a dip coating method. Then, the coated layer is dried and cured at 170° C. for 40 min, so that an undercoat layer having a thickness of 18 μm is formed.

(Preparation of Charge Generation Layer)

A mixture of 15 parts of hydroxygallium phthalocyanine as a charge generating substance, 10 parts of a vinyl chloride/vinyl acetate copolymer resin (trade name: VMCH, manufactured by Nippon Unicar Co., Ltd.) as a binder, and 200 parts of n-butyl acetate is dispersed in a sand mill for 4 hrs using 1 mm ϕ glass beads. The hydroxygallium phthalocyanine has diffraction peaks at least at positions corresponding to Bragg angles (2θ±0.2°) of 7.3°, 16.0°, 24.9° and 28.0° in a an X-ray diffraction spectrum using Cu kα line. To the obtained dispersion liquid, 175 parts of n-butyl acetate and 180 parts of methyl ethyl ketone are added, and the mixture is stirred. As a result, a charge generation layer coating liquid is obtained. The charge generation layer coating liquid is dip coated on the undercoat layer, followed by drying at room temperature, so that a charge generation layer having a thickness of 0.2 μm is formed.

(Preparation of Charge Transport Layer)

To 800 parts by mass of chlorobenzene, 45 parts by mass of N,N'-diphenyl-N, N'-bis(3-methylphenyl)-[1,1']biphenyl-4, 4'-diamine and 55 parts by mass of bisphenol Z polycarbonate resin (molecular weight: 40000) are added and dissolved, so that a charge transport layer coating liquid is obtained. The coating liquid is coated on a charge generation layer, followed by drying at 130° C. for 45 min. As a result, a charge transport layer having a film thickness of 15 μm is formed.

(Preparation of Surface Protective Layer)

Next, 3.5 parts by mass of a compound represented by structural formula (A) below, 3 parts by mass of RESITOP PL-4852 (trade name, produced by Gunei Chemical Industry Co., Ltd.), 0.5 part by mass of a polyvinyl phenol resin (manufactured by Aldrich Corp.), 10 parts by mass of isopropyl alcohol, and 0.2 part by mass of 3,5-di-t-butyl-4-hydroxy toluene (BHT) are added. As a result, a protective layer coating liquid is prepared. The coating liquid is coated on the charge transport layer by a dip coating method, followed by drying in air at room temperature for 30 min. Thereafter, the coated layer is cured by being heated to 150° C. for 1 hr, whereby a photoreceptor A having a surface protective layer having a film thickness of approximately 3.5 μm is prepared.

Structural Formula (A)

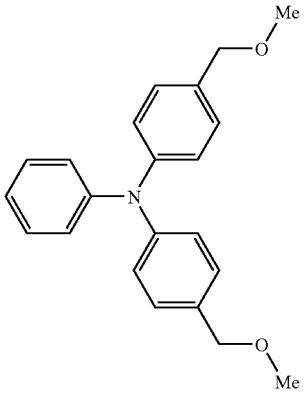

<Preparation of Photoreceptor B>

(Preparation of Undercoat Layer)

On a honed cylindrical A1 substrate having an external diameter of 30 mm ϕ, a solution containing 100 parts of a zirconium compound (trade name: ORGATICS ZC540, manufactured by Matsumoto Chemical Industry Co., Ltd.), 10 parts of a silane compound (trade name: A1100, manufactured by Nippon Unicar Co., Ltd.), 400 parts of isopropanol, and 200 parts of butanol is dip coated. The coated solution is dried by being heated to 150° C. for 10 min, so that an undercoat layer having a thickness of 0.1 μm is formed.

(Preparation of Charge Generation Layer)

One part of hydroxygallium phthalocyanine is blended with 1 part of a polyvinyl butyral (trade name: S-LEC BM-S, manufactured by Sekisui Chemical Co., Ltd.) and 100 parts of n-butyl acetate. The hydroxygallium phthalocyanine has strong diffraction peaks at Bragg angles (2θ±0.2°) of 7.5°, 9.9°, 12.5°, 16.3°, 18.6°, 25.1° and 28.3° in an X-ray diffraction spectrum. The resultant mixture is dispersed in a paint shaker for 1 hr, together with glass beads. The obtained coating liquid is dip coated on the undercoat layer, and the coated layer is dried by being heated to 100° C. for 10 min. As a result, a charge generation layer having a film thickness of approximately 0.15 μm is formed.

(Preparation of Charge Transport Layer)

In the next place, a coating liquid containing 2 parts of a charge transport compound represented by structural formula (B) below and 3 parts of a bisphenol Z polycarbonate resin (molecular weight: 40000, manufactured by Mitsubishi Engineering Plastics Corp.) dissolved in 20 parts of chlorobenzene is coated on the charge generation layer by a dip coating method. The coated layer is heated to 110° C. for 40 min, so that a charge transport layer having a film thickness of 15 μm is formed.

Structural Formula (B)

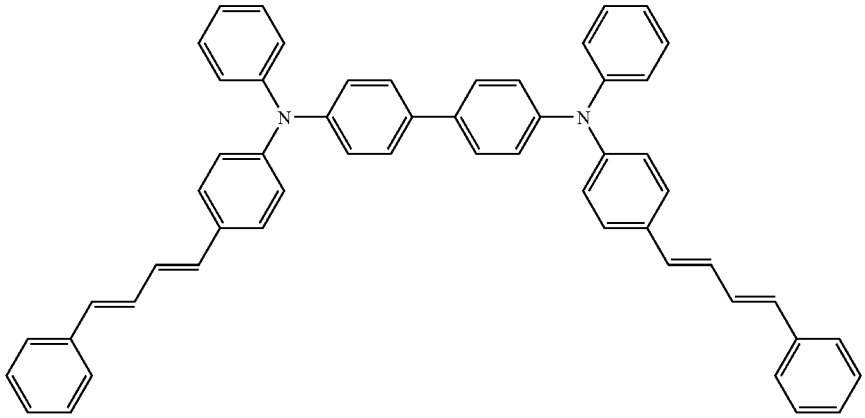

(Preparation of Surface Protective Layer)

The constituent materials shown below are dissolved in a mixture of 5 parts of isopropyl alcohol, 3 parts of tetrahydrofuran, and 0.3 part of distilled water. To the resultant mixture, 0.5 part of an ion exchange resin (AMBER LIST 15E: trade name, manufactured by Rohm & Haas Company) is added, and the mixture is stirred at room temperature to carry out hydrolysis for 24 hrs.

| -Constituent Materials- | |
|---|---|
| Compound shown as a structural formula (C) below: | 2 parts |
| Methyltrimethoxy silane: | 2 parts |
| Tetramethoxy silane: | 0.3 part |
| Colloidal silica (manufactured by Kokusan Kagaku KK): | 0.1 part |
| Fluorine graft polymer (trade name: ZX007C, manufactured by Fuji Kasei KK): | 0.5 part |

A solution containing the hydrolysis product is separated from the ion exchange resin by filtration. To one part of the solution, 0.1 parts of aluminum trisacetyl acetonate (Al(aqaq) 3) and 0.4 parts of 3,5-di-t-butyl-4-hydroxy toluene (BHT) are added to form a coating liquid. The coating liquid is coated on the charge transport layer by a ring type dip coating method, and is dried in air at room temperature for 30 min. Then, the coated layer is cured by being heated to 170° C. for 1 hr, so that a surface protective layer having a film thickness of approximately 3.5 μm is formed. As a result, a photoreceptor B is obtained.

is put in a thermostat set at 50° C. and 85% RH (dew point: 47° C.) to accelerate curing under humidity for 20 min. Thereafter, the substrate is placed in a hot air dryer, and dried at 170° C. for 10 min. As a result, an undercoat layer is formed.

(Formation of Charge Generation Layer)

As a charge generating material, gallium chloride phthalocyanine is used. A mixture of 15 parts by mass of the gallium chloride phthalocyanine, 10 parts by mass of a vinyl chloride-vinyl acetate copolymer (trade name: VMCH, manufactured by Nippon Unicar Co., Ltd.), and 300 parts by mass of n-butyl alcohol is dispersed with a sand mill for 4 hrs to obtain a dispersion liquid. The dispersion liquid is dip coated on the undercoat layer, followed by drying, so that a charge generation layer having a film thickness of 0.2 μm is formed.

(Formation of Charge Transport layer)

A coating liquid is prepared by thoroughly dissolving 40 parts by mass of N, N'-bis(3-methylphenyl)-N,N'-diphenylbenzidine and 60 parts by mass of bisphenol Z polycarbonate resin (molecular weight: 40000) in a mixture of 235 parts by mass of tetrahydrofuran and 100 parts by mass of monochlorobenzene, and the components in the coating liquid is thoroughly mixed. The coating liquid is dip coated on the aluminum substrate on which the layers including the charge generation layer are provided. Then, the substrate is dried at 120° C. for 40 min to form a charge transport layer having a film thickness of 24 μm, so that a photoreceptor C is obtained.

(Preparation of Toner)

-Preparation of Resin Particle Dispersion Liquid-

Structural Formula (C)

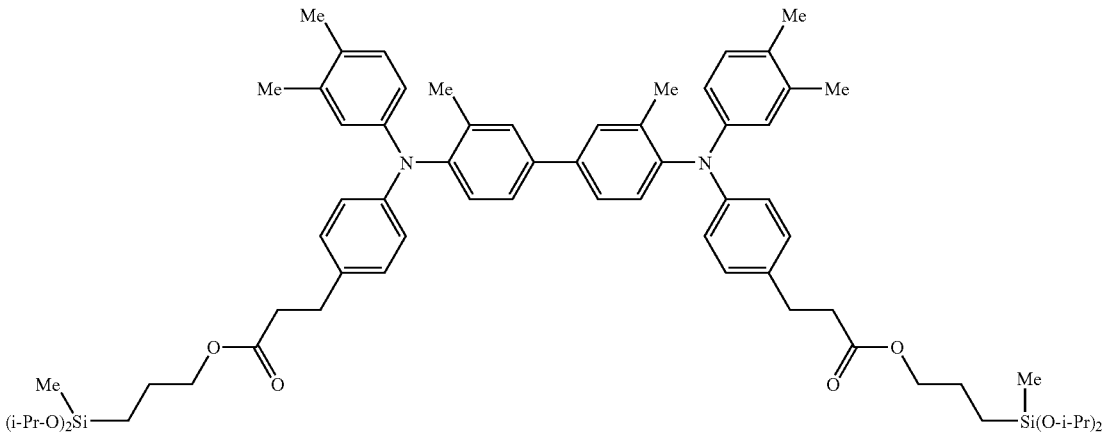

<Preparation of Photoreceptor C>

(Preparation of Undercoat Layer)

To 170 parts by mass of n-butyl alcohol in which 4 parts by mass of a polyvinyl butyral resin (trade name: S-LEC BM-S, manufactured by Sekisui Chemical Co., Ltd.) is dissolved, 30 parts by mass of an organic zirconium compound (acetyl acetone zirconium butyrate) and 3 parts by mass of an organic silane compound (γ-aminopropyltrimethoxysilane) are added. The resultant mixture is stirred to form an undercoat layer coating liquid.

The coating liquid is dip coated on an aluminum substrate roughened by honing and having an external diameter of 30 mm. The coated layer is dried in air at room temperature for 5 min. Then, the substrate is heated to 50° C. for 10 min, and A first solution is obtained by blending 370 g of styrene, 30 g of n-butyl acrylate, 8 g of acrylic acid, 24 g of dodecane thiol, and 4 g of carbon tetrabromide. A second solution is prepared by dissolving 6 g of a nonionic surfactant (trade name: NONIPOL 400, manufactured by Sanyo Chemical Industries, Ltd.) and 10 g of an anionic surfactant (trade name: NEOGEN SC, manufactured by Dai-ichi Kogyo Seiyaku Co., Ltd.) in 550 g of ion-exchange water. In a flask, the first solution is emulsified in the second solution. Then, while the emulsion is stirred slowly for 10 min, 50 g of ion exchange water containing 4 g of ammonium persulfate dissolved therein is added to the emulsion. After the internal air of the flask is substituted with nitrogen, the content in the flask is heated to 70° C. by using an oil bath while being stirred, so that emulsion polymerization is continued in that condition for 5 hrs. As a result, a resin particle dispersion liquid in which resin particles having an average particle diameter of 150 nm, a glass transition temperature Tg of 58° C., and a weight average molecular weight Mw of 11500 is dispersed is prepared. The solid concentration of the dispersion liquid is 40 mass %.

-Preparation of Colorant Dispersion Liquid (1)-

A liquid is prepared by mixing 60 g of carbon black (trade name: MOGAL L, manufactured by Cabot Inc.), 6 g of a nonionic surfactant (trade name: NONIPOL 400, manufactured by Sanyo Chemical Industries, Ltd.), and 240 g of ion-exchange water. The liquid is agitated with a homogenizer (trade name: ULTRA-TURAX T50, manufactured by IKA Works Inc.) for 10 min, and is subjected to a dispersing treatment with an altimizer. As a result, a colorant dispersion liquid (1) in which colorant (carbon black) particles having an average particle diameter of 250 nm are dispersed is obtained.

-Preparation of Colorant Dispersion Liquid (2)-

A liquid is prepared by mixing 60 g of a Cyan pigment (C. I. Pigment Blue 15:3), 5 g of a nonionic surfactant (trade name: NONIPOL 400, manufactured by Sanyo Chemical Industries, Ltd.), and 240 g of ion-exchange water. The liquid is agitated with a homogenizer (trade name: ULTRA-TURAX T50, manufactured by IKA Works Inc.) for 10 min, and is subjected to a dispersing treatment with an altimizer. As a result, a colorant dispersion liquid (2) in which colorant (Cyan pigment) particles having an average particle diameter of 250 nm are dispersed is obtained.

-Preparation of Colorant Dispersion Liquid (3)-

A liquid is prepared by mixing 60 g of a Magenta pigment (C. I. Pigment Red 122), 5 g of a nonionic surfactant (trade name: NONIPOL 400, manufactured by Sanyo Chemical Industries, Ltd.), and 240 g of ion-exchange water. The liquid is agitated with a homogenizer (trade name: ULTRA-TURAX T50, manufactured by IKA Works Inc.) for 10 min, and is subjected to a dispersing treatment with an altimizer. As a result, a colorant dispersion liquid (3) in which colorant (Magenta pigment) particles having an average particle diameter of 250 nm are dispersed is obtained.

-Preparation of Colorant Dispersion Liquid (4)-

A liquid is prepared by mixing 90 g of a Yellow pigment (C. I. Pigment Yellow 180), 5 g of a nonionic surfactant (trade name: NONIPOL 400, manufactured by Sanyo Chemical Industries, Ltd.), and 240 g of ion-exchange water. The liquid is agitated with a homogenizer (trade name: ULTRA-TURAX T50, manufactured by IKA Works Inc.) for 10 min, and is subjected to a dispersing treatment with an altimizer. As a result, a colorant dispersion liquid (4) in which colorant (Yellow pigment) particles having an average particle diameter of 250 nm are dispersed is obtained.

-Preparation of Release Agent Dispersion Liquid-

Then, 100 g of paraffin wax (trade name: HNPO190, manufactured by Nippon Seiro Co., Ltd., melting point: 85° C.), 5 g of a cationic surfactant (trade name: SANISOL B50, manufactured by Kao Corporation), and 240 g of ion exchange water are mixed. The mixture is heated to 95° C., and is dispersed with a homogenizer (trade name: ULTRA-TURAX T50, manufactured by IKA Works Inc.) for 10 min in a round stainless flask. Then, the dispersed mixture is further dispersed with a pressure discharge type homogenizer, so that a release agent dispersion liquid in which release agent particles having an average particle diameter of 550 nm are dispersed is obtained.

-Preparation of Toner Mother Particle K1-

In a round stainless flask, 234 parts of the resin fine particle dispersion liquid, 30 parts of the colorant agent dispersion liquid (1), 40 parts of the release agent dispersion liquid, 0.5 part of polyaluminum hydroxide (trade name: PAHO2S, manufactured by Asada Chemical Co., Ltd.), and 600 parts of ion exchange water are mixed and dispersed with a homogenizer (ULTRA TURRAX T50, manufactured by IKA Works Co.). Thereafter, the mixture in the flask is heated to 40° C. under agitation in a heating oil bath. After the mixture is kept at 40° C. for 30 min, it is confirmed that aggregated particles having a volume average particle diameter $D_{50}$ of 4.5 μm are produced. When the temperature of the heating oil bath is further raised to 56° C. and maintained at that temperature for 1 hr, the volume average particle diameter $D_{50}$ of the aggregated particles becomes 5.3 μm. Then, 26 parts of the resin particle dispersion liquid is added to the dispersion liquid containing the aggregated particles, and the temperature of the heating oil bath is changed to 50° C. and held at that temperature for 30 min. To the dispersion liquid containing the aggregated particles, a 1N sodium hydroxide solution is added to control the pH of the system to 7.0. Then, the stainless flask is hermetically sealed, and the temperature is raised to 80° C. under continuous agitating with a magnetic seal, and is kept at that temperature for 4 hrs. After cooling, the reaction product is filtered out, and is washed four times with ion exchange water. Then, the reaction product is freeze-dried to give toner mother particles K1. The volume average particle diameter $D_{50}$ of the toner mother particles K1 is 5.9 μm, and the average value of the shape factors SF1 thereof is 132.

-Preparation of Toner Mother Particle C1-

Toner mother particles C1 are prepared in the same manner as the preparation of the toner mother particles K1, except that the colorant particle dispersion liquid (2) is used in place of the colorant particle dispersion liquid (1). The volume average particle diameter $D_{50}$ of the toner mother particles C1 is 5.8 μm, and the average value of the shape factors SF1 thereof is 131.

-Preparation of Toner Mother Particle M1-

Toner mother particles M1 are prepared in the same manner as the preparation of the toner mother particles K1, except that the colorant particle dispersion liquid (3) is used in place of the colorant particle dispersion liquid (1). The volume average particle diameter $D_{50}$ of the toner mother particles M1 is 5.5 μm, and the average value of the shape factors SF1 thereof is 135.

-Preparation of Toner Mother particle Y1-

Toner mother particles Y1 are prepared in the same manner as the preparation of the toner mother particles K1, except that the colorant particle dispersion liquid (4) is used in place of the colorant particle dispersion liquid (1). The volume average particle diameter $D_{50}$ of the toner mother particles Y1 is 5.9 μm, and the average value of the shape factors SF1 thereof is 130.

-External Addition of External Additives-

To 100 parts of each of the toner mother particles K1,l C1, M1 and Y1, 1 part of anatase type titanium oxide (average particle diameter: 20 nm, treated with i-butyltrimethoxy silane), 2 parts of silica (prepared according to a sol-gel method, volume average particle diameter: 140 nm, treated with HMDS (hexamethyl disilazane)), 0.8 part of cerium oxide (volume average particle diameter: 0.7 μm), and 0.3 part of zinc stearate (trade name: ZNS-S, manufactured by Asahi Denka Kogyo K.K) are added, followed by blending with a 5 L Henshel mixer at a circumferential velocity of 30 m/s for 15 min. Then, coarse particles are removed therefrom by using a sieve having a 45 μm opening, so that a toner is obtained.

| <Preparation of Carrier> (Preparation of Resin Dispersion Type Carrier) | |
|---|---|
| Phenol: | 10 parts by mass |
| Formaldehyde solution (containing approximately 40% by mass of formaldehyde, approximately 10% by mass of methanol, and water occupying the remaining portion): | 6 parts by mass |
| Magnetite (particle diameter: 0.24 μm, specific resistance: $5 \times 10^5$ Ωcm): | 31 parts by mass |
| $\alpha$-$Fe_2O_3$ (particle diameter: 0.60 μm, specific resistance: $8 \times 10^9$ Ωcm): | 53 parts by mass |

The above materials, 4 parts by mass of an aqueous solution of 28% by mass of ammonia as a basic catalyst, and 15 parts by mass of water are poured into a flask, and the mixture is heated to 85° C. over 40 min under stirring and blending. The mixture is maintained at that temperature to allow the reaction and curing to proceed for 3 hrs. Thereafter, the mixture is cooled to 30° C., and 100 parts by mass of water is added thereto. Then, the supernatant solution is removed, and the precipitate is washed with water and dried in air. Next, the precipitate is dried at a temperature in the range of 50 to 60° C. under reduced pressure (5 mmHg or less), whereby magnetite and hematite are bonded via a phenol resin as a binder. As a result, spherical core particles in which magnetic powder is dispersed in the resin are obtained.

The core particles are classified with a multi-division classifier (trade name: ELBOW JET LABO EJ-L3, manufactured by Nittetu Mining Co., Ltd.), to remove fine powder.

Then, on the surface of the obtained core particles, a thermosetting silicone resin is coated according to a method described below. A 10% by mass carrier coating liquid is prepared using toluene as a solvent such that the coating resin amount becomes 1.2% by mass. The coating liquid is applied onto the core particles and the solvent is evaporated while continuously applying shearing stress.

Thereafter, coated core particles are cured at 250° C. for 1 hr, and then are pulverized. Then, the particles are classified with a 100-mesh sieve, so that carrier particles are obtained. The number average particle diameter of the obtained carrier particles is approximately 40 μm.

(Preparation of Resin-Coated Carrier)

A coating layer forming liquid is prepared by mixing 14 parts of toluene, 2 parts of a styrene-methacrylate copolymer (component ratio=90/10 by mol), and 0.2 part of carbon black (trade name: REGAL 330R, manufactured by Cabot Corp.), and stirring the mixture for 10 min with a stirrer to disperse carbon black. In the next place, this liquid and 100 parts of ferrite particles (volume average particle diameter: 50 μm) are poured into a vacuum deaerating kneader, and stirring is conducted at 60° C. for 30 min. The resultant mixture is deaerated by reducing pressure under heating so as to be dried. As a result, a carrier is obtained.

<Preparation of Developer>

Furthermore, 100 parts of any one of the above obtained carriers and 5 parts of any one of the toners in the respective colors are agitated with a V-blender at 40 rpm for 20 min, followed by sieving with a sieve having a 212 μm opening. As a result, a developer is obtained.

In the description below, in some cases, a developer that is prepared using a resin dispersion type carrier as the carrier is called a developer A, and a developer that is prepared using a resin-coated carrier as the carrier is called a developer B.

<Evaluation>

A cleaning blade selected from the cleaning blades A1 to A3 and B1 to B3, and a photoreceptor selected from the photoreceptors A to C are combined to give the combination described in Table 10 below, and are attached to an image forming apparatus (trade name: DOCUCENTRE Color 400CP, manufactured by Fuji Xerox Co., Ltd.). To each of the configurations, the developer A containing the resin dispersion type carrier or the developer B containing the resin-coated carrier is combined as shown in Table 10 below. In each of the configurations, the circumferential velocities of the photoreceptor and the intermediate transfer member are varied to carry out various evaluations. The results are shown in Table 10 below.

TABLE 10

| | | | Comparative example 1 | Example 1 | Example 2 | Example 3 | Comparative example 2 | Comparative example 3 | Comparative example 4 |
|---|---|---|---|---|---|---|---|---|---|
| Evaluation condition | Cleaning blade | Kind | A1 | A1 | A1 | A1 | B2 | B3 | A1 |
| | | Normal force (N/m) | 40 | 40 | 40 | 40 | 40 | 40 | 40 |
| | Photoreceptor | Kind | A | A | A | A | A | A | C |
| | | Circumferential velocity A (mm/s) | 160 | 160 | 160 | 160 | 160 | 160 | 160 |
| | Intermediate transfer belt | Circumferential velocity B (mm/s) | 160 | 163.2 | 165.6 | 165.6 | 163.2 | 163.2 | 160 |
| | Difference in circumferential velocity between photoreceptor and intermediate transfer belt | 100 × \|A − B\|/B(%) | 0 | 2 | 3.5 | 3.5 | 2 | 2 | 0 |
| | Carrier | Kind | Resin-coated carrier | Resin-coated carrier | Resin-coated carrier | Resin dispersion type carrier | Resin-coated carrier | Resin-coated carrier | Resin-coated carrier |

TABLE 10-continued

| | | | Comparative example 1 | Example 1 | Example 2 | Example 3 | Comparative example 2 | Comparative example 3 | Comparative example 4 |
|---|---|---|---|---|---|---|---|---|---|
| Evaluation result | Image deletion | | G3 | G2 | G0 | G0 | G2 | G2 | G0 |
| | Damage on photoreceptor (surface roughness of photoreceptor) | Surface roughness Ra (μm) before test | <0.01 | <0.01 | <0.01 | <0.01 | <0.01 | <0.01 | <0.01 |
| | | Surface roughness Ra (μm) after test | 0.12 | 0.14 | 0.14 | 0.03 | 0.1 | 0.14 | 0.3 |
| | Wear rate of photoreceptor | (nm/k · cycle) | 7 | 7 | 5 | 4 | 5 | 6 | 40 |
| | Wear of cleaning blade edge | | G4 | G3 | G1 | G0 | G5 | G2 | G1 |
| | Cleaning blade edge chipping | | G3 | G3 | G2 | G0 | G2 | G4 | G3 |

Evaluation methods of the image deletion, damage on the photoreceptor (surface roughness of the photoreceptor), wear rate of the photoreceptor, edge wear and edge chipping shown in Table 10 and evaluation criteria thereof are as shown below.

-Image Deletion-

In the evaluation of the image deletion, a half-tone image having an image area proportion of 30 to 50% is continuously printed over the entire surfaces of one thousand A4 sheets (210×297 mm, trade name: P paper, manufactured by Fuji Xerox Co., Ltd.) under high humidity condition (28° C., 85RH %). The apparatus is left in the same high humidity environment for approximately 10 hrs. Thereafter, a part of the photoreceptor is wiped lightly with a non-woven fabric impregnated with pure water to clean the surface of the photoreceptor.

Then, the same half-tone image is printed again. The obtained samples are evaluated with respect to the image deletion in the following manner. An image density A of an image portion corresponding to the portion on the photoreceptor which has been lightly wiped with the non-woven fabric (an image corresponding to the region on the photoreceptor from which the discharge product that causes the image deletion has been removed) and an image density B of an image portion corresponding to the portion on the photoreceptor that has not been wiped with the non-woven fabric (an image corresponding to the region on which the discharge product that causes the image deletion adheres and accumulates) are measured with a densitometer (trade name: X-RITE 404A, manufactured by X-rite Corp.). The occurrence of the image deletion is evaluated based on the difference between the image densities A and B.

The evaluation criteria of the image deletion are as follows. Allowable ranges are from G0 to G2.

TABLE 11

| Evaluation grade of image deletion | Image density A − image density B |
|---|---|
| G0 | 0 |
| G1 | More than 0 and 0.02 or less |
| G2 | More than 0.02 and 0.05 or less |
| G3 | More than 0.05 |

-Damage on Photoreceptor (Surface Roughness of Photoreceptor)-

The damage on the photoreceptor is evaluated by carrying out measurements of the surface roughness Ra of the surface of the photoreceptor before and after printing on 50000 A4 sheets (210×297 mm, trade name: P paper, manufactured by Fuji Xerox Co., Ltd.).

The surface roughness Ra is measured with a surface roughness meter (trade name: SURFCOM1500D-3DF, manufactured by Tokyo Seimitu Co., Ltd.). The measurement conditions are as follows:

detector: a standard detector for S1500
measurement force: 0.7 mN
measurement probe: DT43801 (conical diamond with a tip shape of 2 μm and R60°)
measurement area: 3×3 mm
measurement pitch: X 0.02 mm, Y0.02 mm
driving speed: 0.6 mm/s.

-Wear Rate of Photoreceptor-

The wear rate of a photoreceptor is obtained as follows: The film thicknesses of the photoreceptor before and after the test are measured with an eddy current type thickness meter, and the difference therebetween is determined. From the difference, the wear rate of the photoreceptor per 1000 cycles of the photoreceptor is calculated.

-Edge Wear-

For evaluating the edge wear, images are formed on A4 sheets (210×297 mm, trade name: P paper, manufactured by Fuji Xerox Co., Ltd.) under a high temperature and high humidity environment (28° C. and 85RH %) until the cumulative number of rotations of the photoreceptor reaches 100 K cycles. The wear of the edge tip of the cleaning blade and cleaning failure after the 100K cycles are both used for the evaluation.

At the test, the image density of the images is set to 1% in order to conduct the evaluation under a severe condition where the lubricating effect at the portion of contact between the photoreceptor and the cleaning blade is reduced.

In the next place, when a wear depth of the edge tip after the test is observed from the cross section side of the cleaning blade with a laser microscope VK-8510 (trade name, manufactured by Keyence Corp.), the maximum depth of the edge chipping at the photoreceptor surface side is measured.

For the evaluation of the cleaning failure, after the above test, an A3 sheet on which an untransfered black solid image (size of black solid image: 400 mm×290 mm) is formed is fed between the photoreceptor and the cleaning blade. Immediately after the lattermost portion of the unfixed image in the transport direction has passed through the contact portion between the photoreceptor and the cleaning blade, the operation of the machine is stopped, and it is visually observed whether there is toner that has past through the contact portion. Passage of a significant quantity of the toner through the contact portion is assumed as the occurrence of the cleaning failure.

When a portion that blocks the toner is missing owing to the wear and the edge tip chipping, a deeper edge wear or deeper edge chipping leads to easier occurrence of cleaning failure in the above test. Accordingly, the above test is effective in quantitatively evaluating the wear and the edge tip chipping.

The evaluation criteria of the edge wear are shown in Table 12 below. Allowable ranges are from G0 to G2.

TABLE 12

| Edge wear evaluation grade | Depth of edge wear | Cleaning failure |
|---|---|---|
| G0 | 3 μm or less and null after wear | Not occur |
| G1 | 3 μm or less | Not occur |
| G2 | More than 3 μm but not more than 5 μm | Not occur |
| G3 | More than 3 μm but not more than 5 μm | Occur |
| G4 | More than 5 μm but not more than 10 μm | Occur |
| G5 | More than 10 μm | Occur |

-Edge Chipping-

The edge chipping is caused when foreign matters adhered onto the surface of the photoreceptor pass through many times the portion of contact between the photoreceptor and the cleaning blade. For the evaluation, the photoreceptor drum is run 100 K cycles while forming a toner band having a width of 5 mm every 5 K cycles, in a low temperature and low humidity (10° C. and 15% RH) environment, which is a condition in which the elasticity of the cleaning blade is lowered to increase the stress upon collision of the foreign matters against the cleaning blade. After completion of the 100K cycles, the depth and number of the edge chippings are measured.

The depth of the edge chipping is obtained by measuring the edge chipping depth on the photoreceptor surface side when the cross section side of the cleaning blade is observed with a laser microscope VK-8510 (trade name, manufactured by Keyence Corp.). The number of chippings having a width of 5 μm or more is evaluated. Evaluation criteria of the edge chipping are shown in Table 13 below. Allowable ranges are from G0 to G2.

TABLE 13

| Edge chipping evaluation grade | Number of chippings of 5 μm or more |
|---|---|
| G0 | 0 |
| G1 | 1 to 5 |
| G2 | 6 to 10 |
| G3 | 11 to 20 |
| G4 | 21 to 30 |
| G5 | 31 or more |

The foregoing description of the exemplary embodiments of the invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

All publications, patent applications, and technical standards mentioned in this specification are herein incorporated by reference to the same extent as if each individual publication, patent application, or technical standard was specifically and individually indicated to be incorporated by reference.

What is claimed is:

1. An image forming method comprising:

charging a surface of an image carrier that has a surface layer containing a resin having a crosslinking structure, the image carrier being rotatable in one direction;

forming an electrostatic latent image by exposing the charged surface of the image carrier to light;

developing the electrostatic latent image with a developer containing a toner to form a toner image;

electrostatically transferring the toner image formed on the surface of the image carrier onto a surface of a rotatable intermediate transfer member that contacts the surface of the image carrier; and cleaning the surface of the image carrier with a cleaning blade that contacts the surface of the image carrier after the toner image is transferred onto the intermediate transfer member, a portion of the cleaning blade that contacts the surface of the image carrier having a material that satisfies Formulas (1) to (3) below, an absolute value of a difference in circumferential velocity between the image carrier and the intermediate transfer member being substantially larger than zero, and a polishing agent being present at least at a portion where the image carrier and the intermediate transfer member contact each other:

$$3.92 \leqq M \leqq 29.42 \quad \text{Formula (1)}$$

$$0 < \alpha \leqq 0.294 \quad \text{Formula (2)}$$

$$S > 350 \quad \text{Formula (3)}$$

in Formulas (1) to (3), M representing 100% modulus (MPa); α representing a ratio (MPa/%) of a change in stress (Δ stress) to a change in a strain amount (Δ strain amount) from 100% strain to 200% strain {Δ stress/Δ strain amount=(stress at a strain amount of 200%−stress at a strain amount of 100%)/(200−100)} in a stress-strain curve; and S representing a breaking elongation (%) measured using a dumbbell type #3 test piece.

2. The image forming method according to claim 1, wherein the developer includes the toner and a carrier, and the carrier includes a resin matrix and a magnetic powder dispersed in the resin matrix.

3. The image forming method according to claim 1, wherein the polishing agent is cerium oxide.

4. The image forming method according to claim 1, wherein the cleaning is carried out in the presence of the polishing agent and a lubricant at a portion where the surface of the image carrier and the cleaning blade contact each other, and the lubricant is zinc stearate.

5. The image forming method according to claim 1, wherein a normal force of the cleaning blade against the image carrier is about 35 N/m or more.

6. The image forming method according to claim 1, wherein |(circumferential velocity of the image carrier−circumferential velocity of the intermediate transfer member)|/(circumferential velocity of the intermediate transfer member) is in a range of about 1 to 5%.

7. The image forming method according to claim 1, wherein |(circumferential velocity of the image carrier−circumferential velocity of the intermediate transfer member)|/(circumferential velocity of the intermediate transfer member) is in a range of about 2 to 4%.

8. The image forming method according to claim 1, wherein the toner has a volume average particle diameter of 2 μm to 8 μm.

9. The image forming method according to claim 1, wherein the toner has a shape factor SF1 of less than 140.

10. The image forming method according to claim 1, wherein the portion of the cleaning blade that contacts the surface of the image carrier has a glass transition temperature Tg of not more than 10° C.

11. The image forming method according to claim 1, wherein the portion of the cleaning blade that contacts the surface of the image carrier has a rebound resilience R of 10% or more in an environment of a temperature of not lower than 10° C.

12. An image forming apparatus comprising:

an image carrier that has a surface layer containing a resin having a crosslinking structure, the image carrier being rotatable in one direction;

a charging unit that charges the surface of an image carrier;

an electrostatic latent image forming unit that exposes the charged surface of the image carrier to light to form an electrostatic latent image;

a developing unit that develops the electrostatic latent image with a developer containing a toner to form a toner image;

a rotatable intermediate transfer member having a surface onto which the toner image transferred onto the surface of the image carrier is electrostatically transferred while the intermediate transfer member contacts the surface of the image carrier; and a cleaning blade that contacts the surface of the image carrier and cleans the surface of the image carrier after the toner image is transferred onto the intermediate transfer member, a portion of the cleaning blade that contacts the surface of the image carrier having a material that satisfies Formulas (1) to (3) below, an absolute value of a difference in circumferential velocity between the image carrier and the intermediate transfer member being substantially larger than zero, and a polishing agent being present at least at a portion where the image carrier and the intermediate transfer member contact each other:

$$3.92 \leqq M \leqq 29.42 \quad \text{Formula (1)}$$

$$0 < \alpha \leqq 0.294 \quad \text{Formula (2)}$$

$$S > 350 \quad \text{Formula (3)}$$

in Formulas (1) to (3), M representing 100% modulus (MPa); α representing a ratio (MPa/%) of a change in stress (Δ stress) to a change in a strain amount (Δ strain amount) from 100% strain to 200% strain {Δ stress/Δ strain amount=(stress at a strain amount of 200%−stress at a strain amount of 100%)/(200−100)} in a stress-strain curve; and S representing a breaking elongation (%) measured using a dumbbell type #3 test piece.

13. The image forming apparatus according to claim 12, wherein the developer includes the toner and a carrier, and the carrier includes a resin matrix and a magnetic powder dispersed in the resin matrix.

14. The image forming apparatus according to claim 12, wherein the polishing agent is cerium oxide.

15. The image forming apparatus according to claim 12, wherein the cleaning is carried out in the presence of the polishing agent and a lubricant at a portion of contact between the surface of the image carrier and the cleaning blade, and the lubricant is zinc stearate.

16. The image forming apparatus according to claim 12, wherein a normal force of the cleaning blade against the image carrier is about 35 N/m or more.

17. The image forming apparatus according to claim 12, comprising a process cartridge that is separable from the body of the image forming apparatus, the process cartridge including at least the image carrier and the cleaning blade.

18. The image forming apparatus according to claim 12, wherein |(circumferential velocity of the image carrier−circumferential velocity of the intermediate transfer member)|/(circumferential velocity of the intermediate transfer member) is in a range of about 2 to 4%.

19. The image forming apparatus according to claim 12, wherein the portion of the cleaning blade that contacts the surface of the image carrier has a glass transition temperature Tg of not more than 10° C.

20. The image forming apparatus according to claim 12, wherein the portion of the cleaning blade that contacts the surface of the image carrier has a rebound resilience R of 10% or more in an environment of a temperature of not lower than 10° C.

21. An image forming apparatus comprising:

an image carrier that has a surface layer containing a resin having a crosslinking structure, the image carrier being rotatable in one direction;

a charging unit that charges the surface of an image carrier;

an electrostatic latent image forming unit that exposes the charged surface of the image carrier to light to form an electrostatic latent image;

a developing unit that develops the electrostatic latent image with a developer containing a toner to form a toner image;

a rotatable intermediate transfer member having a surface onto which the toner image transferred onto the surface of the image carrier is electrostaically transferred while the intermediate transfer member contacts the surface of the image carrier; and a cleaning blade that contacts the surface of the image carrier and cleans the surface of the image carrier after the toner image is transferred onto the intermediate transfer member, a portion of the cleaning blade that contacts the surface of the image carrier having a material that satisfies Formulas (1) to (3) below, an absolute value of a difference in circumferential velocity between the image carrier and the intermediate transfer member being substantially larger than zero, and a polishing agent being present at least at a portion where the image carrier and the intermediate transfer member contact each other:

$$3.92 \leqq M \leqq 29.42 \quad \text{Formula (1)}$$

$$0 < \alpha \leqq 0.294 \quad \text{Formula (2)}$$

$$S > 350 \quad \text{Formula (3)}$$

in Formulas (1) to (3), M representing 100% modulus (MPa); α representing a ratio (MPa/%) of a change in stress (Δ stress) to a change in a strain amount (Δ strain amount) from 100% strain to 200% strain {Δ stress/Δ strain amount=(stress at a strain amount of 200%−stress at a strain amount of 100%)/(200−100)} in a stress-strain curve; and S representing a breaking elongation (%) measured using a dumbbell type #3 test piece, and

|(circumferential velocity of the image carrier−circumferential velocity of the intermediate transfer member)|/(circumferential velocity of the intermediate transfer member) is in a range of about 1 to 5%.

22. The image forming apparatus according to claim 21, wherein the portion of the cleaning blade that contacts the surface of the image carrier has a glass transition temperature Tg of not more than 10° C.

23. The image forming apparatus according to claim 21, wherein the portion of the cleaning blade that contacts the surface of the image carrier has a rebound resilience R of 10% or more in an environment of a temperature of not lower than 10° C.

24. An image forming apparatus comprising:

an image carrier means for carrying an image, the image carrier means having a surface layer containing a resin having a crosslinking structure, the image carrier being rotatable in one direction;

a charging means for charging the surface of an image carrier;

an electrostatic latent image forming means for exposing the charged surface of the image carrier to light to form an electrostatic latent image;

a developing means for developing the electrostatic latent image with a developer containing a toner to form a toner image;

a rotatable intermediate transfer means for contacting the surface of the image carrier, the toner image transferred onto the surface of the image carrier being electrostatically transferred onto a surface of the rotatable intermediate transfer means while the rotatable intermediate transfer means contacting the surface of the image carrier; and a cleaning blade means for contacting the surface of the image carrier and cleaning the surface of the image carrier after the toner image is transferred onto the intermediate transfer means, a portion of the cleaning blade means that contacts the surface of the image carrier means having a material that satisfies Formulas (1) to (3) below, an absolute value of a difference in circumferential velocity between the image carrier means and the intermediate transfer means being substantially larger than zero, and a polishing agent being present at least at a portion where the image carrier means and the intermediate transfer means contact each other:

$$3.92 \leqq M \leqq 29.42 \quad \text{Formula (1)}$$

$$0 < \alpha \leqq 0.294 \quad \text{Formula (2)}$$

$$S > 350 \quad \text{Formula (3)}$$

in Formulas (1) to (3), M representing 100% modulus (MPa); $\alpha$ representing a ratio (MPa/%) of a change in stress ($\Delta$ stress) to a change in a strain amount ($\Delta$ strain amount) from 100% strain to 200% strain {$\Delta$ stress/$\Delta$ strain amount=(stress at a strain amount of 200%−stress at a strain amount of 100%)/(200−100)} in a stress-strain curve; and S representing a breaking elongation (%) measured using a dumbbell type #3 test piece.

25. The image forming apparatus according to claim 24, wherein the portion of the cleaning blade that contacts the surface of the image carrier has a glass transition temperature Tg of not more than 10° C.

26. The image forming apparatus according to claim 24, wherein the portion of the cleaning blade that contacts the surface of the image carrier has a rebound resilience R of 10% or more in an environment of a temperature of not lower than 10° C.

* * * * *